US008151397B2

(12) United States Patent
Moskovich et al.

(10) Patent No.: US 8,151,397 B2
(45) Date of Patent: Apr. 10, 2012

(54) ORAL CARE IMPLEMENT HAVING FLEXIBLY SUPPORTED CLEANING ELEMENTS EXTENDING IN OPPOSITE DIRECTIONS

(75) Inventors: Robert Moskovich, East Brunswick, NJ (US); Douglas Hohlbein, Pennington, NJ (US); Bruce Russell, Howell, NJ (US)

(73) Assignee: Colgate-Palmolive Company, New York, NY (US)

( * ) Notice: Subject to any disclaimer, the term of this patent is extended or adjusted under 35 U.S.C. 154(b) by 865 days.

(21) Appl. No.: 12/146,913

(22) Filed: Jun. 26, 2008

(65) Prior Publication Data

US 2009/0025165 A1 Jan. 29, 2009

Related U.S. Application Data

(63) Continuation-in-part of application No. 11/624,947, filed on Jan. 19, 2007, now Pat. No. 7,930,792, and a continuation-in-part of application No. 11/429,677, filed on May 8, 2006, now Pat. No. 7,841,041, which is a continuation-in-part of application No. 11/256,790, filed on Oct. 24, 2005, now Pat. No. 7,614,111, which is a continuation-in-part of application No. 11/122,224, filed on May 5, 2005, now Pat. No. 7,845,042, which is a continuation-in-part of application No. 10/768,363, filed on Jan. 30, 2004, now Pat. No. 7,703,163, which is a continuation-in-part of application No. 10/697,213, filed on Oct. 30, 2003, now Pat. No. 7,757,326, (Continued)

(51) Int. Cl.

| | |
|---|---|
| ***A46B 7/02*** | (2006.01) |
| ***A46B 9/04*** | (2006.01) |
| ***A61B 17/24*** | (2006.01) |

(52) U.S. Cl. ..... 15/201; 15/106; 15/110; 15/111; 15/167.1; 606/161

(58) Field of Classification Search ..... 15/106, 15/110, 111, 167.1, 188, 201; 606/161; *A46B 9/04*
See application file for complete search history.

(56) References Cited

U.S. PATENT DOCUMENTS 585,358 A 6/1897 Gould (Continued)

FOREIGN PATENT DOCUMENTS

CN 99225704.2 2/1999

(Continued)

OTHER PUBLICATIONS

Computer generated English Translation of JP 2002-142867, published May 21, 2002.

(Continued)

*Primary Examiner* — Mark Spisich
*Assistant Examiner* — Michael Jennings
(74) *Attorney, Agent, or Firm* — Amy M. Fernandez

(57) ABSTRACT

An oral care implement is provided includes a head platform having a plurality of faces with cleaning elements extending therefrom. The oral care implement can have flexibly mounted cleaning elements extending in opposite directions. The oral care implement can include a handle and a head with tooth cleaning elements extending from fixed pods and one or more central pods suspended between the fixed pods via a bridge. The bridge may be formed from an elastomer and permit the one or more central pods to move from an initial position toward and away from the head platform during use. The one or more central pods can include first cleaning elements extending in a first direction toward the first face and second cleaning elements extending in a second direction opposite the first direction. The second cleaning elements can extend through one or more apertures in the head platform.

18 Claims, 36 Drawing Sheets

Related U.S. Application Data application No. 12/146,913, which is a continuation-in-part of application No. 11/019,671, filed on Dec. 23, 2004, now Pat. No. 7,721,376, which is a continuation-in-part of application No. 10/869,922, filed on Jun. 18, 2004, now Pat. No. 7,143,462, which is a continuation-in-part of application No. 10/601,106, filed on Jun. 20, 2003, now abandoned, said application No. 11/019,671 is a continuation-in-part of application No. PCT/US03/30633, filed on Sep. 26, 2003, said application No. 11/019,671 is a continuation-in-part of application No. PCT/US03/29497, filed on Sep. 17, 2003, said application No. 11/019,671 is a continuation-in-part of application No. 10/989,267, filed on Nov. 17, 2004, now Pat. No. 7,607,189, which is a continuation-in-part of application No. 29/209,242, filed on Jul. 14, 2004, now abandoned, application No. 12/146,913, which is a continuation-in-part of application No. 10/989,267, filed on Nov. 17, 2004, now Pat. No. 7,607,189, which is a continuation-in-part of application No. 29/209,242, and a continuation-in-part of application No. 29/209,244, filed on Jul. 14, 2004, now abandoned, application No. 12/146,913, which is a continuation-in-part of application No. 10/902,257, filed on Jul. 30, 2004, now Pat. No. 7,047,591, which is a continuation-in-part of application No. PCT/US03/29497, filed on Sep. 17, 2003, said application No. 10/902,257 is a continuation-in-part of application No. 29/189,729, filed on Sep. 10, 2003, now Pat. No. Des. 517,812, application No. 12/146,913, which is a continuation-in-part of application No. 11/053,583, filed on Feb. 8, 2005, now Pat. No. 7,360,270, which is a continuation of application No. PCT/US03/24878, filed on Aug. 8, 2003, application No. 12/146,913, which is a continuation-in-part of application No. 11/053,589, filed on Feb. 8, 2005, now Pat. No. 7,725,981, which is a continuation of application No. PCT/US03/24879, filed on Aug. 8, 2003.

(60) Provisional application No. 60/414,117, filed on Sep. 27, 2002, provisional application No. 60/418,776, filed on Oct. 16, 2002, provisional application No. 60/419,425, filed on Oct. 18, 2002, provisional application No. 60/412,290, filed on Sep. 20, 2002, provisional application No. 60/402,170, filed on Aug. 9, 2002, provisional application No. 60/402,670, filed on Aug. 12, 2002, provisional application No. 60/402,165, filed on Aug. 9, 2002.

(56) References Cited

U.S. PATENT DOCUMENTS

| | | | | |
|---|---|---|---|---|
| 697,336 | A | | 4/1902 | Hagerty |
| 726,727 | A | | 4/1903 | Mills |
| 864,054 | A | | 5/1907 | Peck |
| 907,842 | A | | 12/1908 | Meuzies |
| 1,002,468 | A | | 9/1911 | Strangman |
| 1,006,630 | A | | 10/1911 | Clarke |
| 1,125,532 | A | | 1/1915 | Himmei |
| 1,128,139 | A | | 2/1915 | Hoffman |
| 1,142,698 | A | | 6/1915 | Crumbaugh |
| 1,153,409 | A | | 9/1915 | Wheeler |
| 1,191,556 | A | | 7/1916 | Blake |
| 1,251,250 | A | | 12/1917 | Libby |
| 1,268,544 | A | | 6/1918 | Cates |
| 1,405,279 | A | | 1/1922 | Cassedy |
| 1,470,710 | A | | 10/1923 | Davis |
| 1,495,675 | A | | 5/1924 | Colt |
| 1,598,224 | A | | 8/1926 | Van Sant |
| 1,658,706 | A | | 2/1928 | Carrott |
| D75,971 | S | | 8/1928 | Faubert et al. |
| 1,704,564 | A | | 3/1929 | Friedland |
| 1,705,109 | A | | 3/1929 | Essbach |
| 1,728,956 | A | | 9/1929 | Darmitzel |
| 1,741,143 | A | | 12/1929 | Chin |
| 1,770,195 | A | | 7/1930 | Burlew |
| 1,796,001 | A | | 3/1931 | Church |
| 1,816,582 | A | | 7/1931 | Heron |
| 1,817,585 | A | | 8/1931 | Samuel |
| 1,860,924 | A | | 5/1932 | Cooke |
| 1,861,347 | A | | 5/1932 | Johnson |
| 1,872,832 | A | | 8/1932 | Silverberg |
| 1,891,864 | A | | 12/1932 | Barrett |
| 1,892,068 | A | | 12/1932 | Metzler |
| 1,903,161 | A | | 3/1933 | Barkan |
| 2,083,217 | A | | 7/1934 | Brothers et al. |
| 1,993,662 | A | | 3/1935 | Green |
| 1,993,763 | A | | 3/1935 | Touchstone |
| D99,352 | S | | 4/1936 | Grapp |
| 2,042,239 | A | | 5/1936 | Planding |
| 2,049,956 | A | | 8/1936 | Greenberg |
| 2,059,914 | A | | 11/1936 | Rosenberg |
| 2,079,728 | A | | 5/1937 | Arnold |
| 2,129,082 | A | | 9/1938 | Byrer |
| 2,161,349 | A | | 6/1939 | Hadden |
| 2,186,005 | A | | 1/1940 | Casto |
| 2,263,885 | A | | 5/1940 | McGauley |
| D122,815 | S | | 10/1940 | Crosby |
| 2,218,072 | A | | 10/1940 | Runnels |
| 2,225,331 | A | | 12/1940 | Campbell |
| 2,233,936 | A | | 3/1941 | Campbell |
| 2,244,098 | A | | 6/1941 | Busick |
| 2,253,210 | A | | 8/1941 | Pshiharis |
| 2,253,910 | A | | 8/1941 | Luenz |
| 2,263,802 | A | | 11/1941 | Grusin |
| 2,266,195 | A | | 12/1941 | Lay |
| 2,405,029 | A | | 7/1946 | Gallanty et al. |
| 2,418,485 | A | | 4/1947 | Shipley |
| 2,491,274 | A | | 12/1949 | McNeill |
| 2,512,059 | A | | 6/1950 | Haeusser |
| 2,651,068 | A | | 11/1950 | Seko |
| 2,543,999 | A | | 3/1951 | Voss |
| D162,941 | S | | 4/1951 | Ehrman |
| 2,554,777 | A | | 5/1951 | Dangin |
| 2,574,654 | A | | 11/1951 | Moore |
| 2,583,750 | A | | 1/1952 | Runnels |
| 2,642,604 | A | | 6/1953 | Ferrari |
| 2,708,762 | A | | 6/1953 | Kling et al. |
| 2,686,325 | A | | 8/1954 | Silver |
| 2,702,914 | A | | 3/1955 | Kittle et al. |
| 2,706,825 | A | | 4/1955 | Blakeman |
| 3,103,027 | A | | 9/1963 | Birch |
| 3,103,680 | A | | 9/1963 | Krichmar |
| 3,129,449 | A | * | 4/1964 | Cyzer ..... 15/28 |
| 3,153,800 | A | | 10/1964 | Trotin |
| 3,181,193 | A | | 5/1965 | Nobles et al. |
| 3,185,582 | A | | 5/1965 | Viator |
| 3,195,537 | A | | 7/1965 | Blasi |
| 3,196,299 | A | | 7/1965 | Herbert |
| 3,254,356 | A | | 6/1966 | Yao et al. |
| 3,258,805 | A | | 7/1966 | Rossnan |
| 3,316,576 | A | | 5/1967 | Urbush |
| 3,337,893 | A | | 8/1967 | Fine et al. |
| 3,398,421 | A | | 8/1968 | Rashbaum |
| D213,669 | S | | 4/1969 | Miller |
| 3,509,874 | A | | 5/1970 | Stillman |
| 3,610,043 | A | | 10/1971 | Wemyss |
| 3,633,237 | A | | 1/1972 | Bagube |
| 4,114,222 | A | | 9/1978 | Serediuk |
| 4,291,431 | A | | 9/1981 | Lewis, Jr. |
| 4,299,208 | A | | 11/1981 | Blanc |
| 4,328,604 | A | | 5/1982 | Adams |
| 4,356,585 | A | | 11/1982 | Protell et al. |
| 4,364,142 | A | | 12/1982 | Pangle |
| D272,683 | S | | 2/1984 | Stocchi |
| D272,687 | S | | 2/1984 | Stocchi |
| D272,689 | S | | 2/1984 | Stocchi |
| D272,690 | S | | 2/1984 | Stocchi |
| D273,635 | S | | 5/1984 | Stocchi |

4,455,704 A 6/1984 Williams
4,488,327 A 12/1984 Snider
4,610,043 A 9/1986 Vezjak
D287,072 S 12/1986 Pfleger
4,628,564 A 12/1986 Youssef
4,654,922 A 4/1987 Chen
4,694,844 A 9/1987 Berl et al.
4,721,021 A 1/1988 Kusznir
D295,695 S 5/1988 Golzari
4,783,869 A 11/1988 Lee
4,827,551 A 5/1989 Maser et al.
4,888,844 A 12/1989 Maggs
D309,528 S 7/1990 Valenti
5,005,246 A 4/1991 Yen-Hui
D317,986 S 7/1991 Huang
5,027,796 A 7/1991 Linzey
5,032,082 A 7/1991 Herrera
5,033,797 A 7/1991 Rueb
5,040,260 A 8/1991 Michaels
5,054,154 A 10/1991 Schiffer et al.
5,120,225 A 6/1992 Amit
5,165,761 A 11/1992 Dirksing
5,176,427 A 1/1993 Weihrauch
D334,288 S 3/1993 Witzig-Jaggi
5,226,197 A 7/1993 Nack et al.
5,230,118 A 7/1993 Chamma
5,242,235 A 9/1993 Li
5,249,327 A 10/1993 Hing
5,273,425 A 12/1993 Hoagland
5,305,489 A 4/1994 Lage
5,305,492 A 4/1994 Guiliani et al.
5,325,560 A 7/1994 Pavone et al.
5,339,482 A 8/1994 Desimone et al.
D350,851 S 9/1994 Spence, Jr.
5,345,560 A 9/1994 Miura et al.
5,355,546 A 10/1994 Scheier et al.
5,392,483 A 2/1995 Heinzelman et al.
5,396,678 A 3/1995 Bredall et al.
5,398,366 A * 3/1995 Bradley ..... 15/167.1
5,398,369 A 3/1995 Heinzelman et al.
D358,938 S 6/1995 Schneider et al.
5,438,726 A 8/1995 Leite
5,445,825 A 8/1995 Copelan et al.
5,481,775 A 1/1996 Gentile et al.
5,483,722 A 1/1996 Scheier et al.
5,491,866 A 2/1996 Simonds
D368,163 S 3/1996 Overthun
5,511,273 A 4/1996 Carroll
5,511,275 A 4/1996 Volpenhein et al.
5,524,319 A 6/1996 Avidor
5,528,786 A 6/1996 Porat et al.
D371,680 S 7/1996 Juhlin et al.
5,530,981 A 7/1996 Chen
5,535,474 A 7/1996 Salazar
5,546,624 A 8/1996 Bock
5,555,590 A 9/1996 Blum et al.
5,570,487 A 11/1996 Schneider
D376,695 S 12/1996 Tveras
5,584,690 A 12/1996 Maassarani
5,604,951 A 2/1997 Shipp
5,613,262 A 3/1997 Choy-Maldonado
5,625,916 A 5/1997 McDougall
5,628,082 A 5/1997 Moskovich
5,630,244 A 5/1997 Chang
5,651,158 A 7/1997 Halm
5,673,454 A 10/1997 Quintanilla et al.
5,689,850 A 11/1997 Shekalim
D386,905 S 12/1997 Brady et al.
5,709,004 A 1/1998 Paduano et al.
D390,706 S 2/1998 Hohlbein et al.
D391,769 S 3/1998 Kling et al.
5,735,011 A 4/1998 Asher
5,735,012 A 4/1998 Heinzelman et al.
5,735,864 A 4/1998 Heisinger, Jr.
5,758,380 A 6/1998 Vrignaud
5,765,252 A 6/1998 Carr
5,766,193 A 6/1998 Millner
D396,288 S 7/1998 Samuel
5,778,475 A 7/1998 Garcia
5,778,476 A 7/1998 Squillaci et al.
5,779,654 A 7/1998 Foley et al.
5,781,958 A 7/1998 Meessman et al.
D397,219 S 8/1998 Rangel et al.
5,792,159 A 8/1998 Amin
5,802,656 A 9/1998 Dawson et al.
5,810,856 A 9/1998 Tveras
5,813,079 A 9/1998 Halm
D399,349 S 10/1998 Barth
5,817,114 A 10/1998 Anderson et al.
5,818,856 A 10/1998 Injeyan et al.
RE35,941 E 11/1998 Stansbury, Jr.
D401,069 S 11/1998 Lamond et al.
5,839,148 A 11/1998 Volpenhein et al.
5,839,149 A 11/1998 Scheier et al.
D402,116 S 12/1998 Magloff et al.
5,845,358 A 12/1998 Woloch
D403,510 S 1/1999 Menke et al.
D404,205 S 1/1999 Hohlbein
D404,206 S 1/1999 Hohlbein
5,860,183 A 1/1999 Kam
D405,272 S 2/1999 Khalaj et al.
D407,221 S 3/1999 Van Gelder
D407,222 S 3/1999 Van Gelder
D407,223 S 3/1999 Van Gelder
5,875,510 A 3/1999 Lamond et al.
5,896,614 A 4/1999 Flewitt
5,908,038 A 6/1999 Bennett
5,913,346 A 6/1999 Narwani
5,915,433 A 6/1999 Hybler
D412,064 S 7/1999 Achepohl et al.
5,920,941 A 7/1999 Iannotta
5,926,901 A 7/1999 Tseng et al.
5,928,254 A 7/1999 Jensen
5,930,860 A * 8/1999 Shipp ..... 15/110
5,938,673 A 8/1999 DePierro et al.
D413,728 S 9/1999 Waguespack et al.
5,946,759 A 9/1999 Cann
5,951,578 A 9/1999 Jensen
5,957,942 A 9/1999 Yudelman
D415,352 S 10/1999 Beals et al.
5,964,508 A 10/1999 Maurer
5,967,152 A 10/1999 Rimkus
5,970,564 A 10/1999 Inns et al.
D416,685 S 11/1999 Overthun
5,980,541 A 11/1999 Tenzer
5,980,542 A 11/1999 Saldivar
5,984,935 A 11/1999 Welt et al.
5,987,688 A 11/1999 Roberts et al.
5,991,959 A 11/1999 Raven et al.
6,000,083 A 12/1999 Blaustein et al.
6,004,334 A 12/1999 Mythen
D418,979 S 1/2000 Moskovich et al.
D419,304 S 1/2000 Moskovich et al.
6,015,293 A 1/2000 Rimkus
D419,773 S 2/2000 Beals et al.
D420,515 S 2/2000 Van Gelder
D420,802 S 2/2000 Cheong et al.
D420,804 S 2/2000 Juhlin et al.
D421,184 S 2/2000 Koh et al.
D421,841 S 3/2000 Achepohl et al.
D421,844 S 3/2000 Stark et al.
6,032,315 A 3/2000 Liebel
6,041,467 A 3/2000 Roberts et al.
D422,413 S 4/2000 Goldfinger et al.
6,049,936 A 4/2000 Holley
D423,785 S 5/2000 Karallis
D423,786 S 5/2000 Zelinski
D423,787 S 5/2000 Musciano
D424,808 S 5/2000 Beals et al.
D424,809 S 5/2000 Bernard
D425,306 S 5/2000 Beals et al.
6,058,541 A 5/2000 Masterman et al.
6,088,870 A 7/2000 Hohlbein
D428,702 S 8/2000 Van Gelder
D429,566 S 8/2000 Yoshimoto et al.
D429,567 S 8/2000 Yoshimoto et al.
6,098,233 A 8/2000 Chen
6,105,191 A 8/2000 Chen et al.

6,108,849 A 8/2000 Weihrauch
6,108,851 A 8/2000 Bredall et al.
6,108,869 A 8/2000 Meessmann et al.
6,115,870 A 9/2000 Solanki et al.
6,119,296 A 9/2000 Noe et al.
6,131,228 A 10/2000 Chen et al.
6,141,817 A 11/2000 Dawson
6,151,745 A * 11/2000 Roberts et al. ..... 15/167.1
D434,906 S 12/2000 Beals et al.
6,161,245 A 12/2000 Weihrauch
6,171,323 B1 1/2001 Potti et al.
6,178,582 B1 1/2001 Halm
6,179,503 B1 1/2001 Taghavi-Khanghah
D439,412 S 3/2001 Volpenhein et al.
D440,767 S 4/2001 Moskovich et al.
6,219,874 B1 4/2001 van Gelder et al.
D441,958 S 5/2001 Rueb
6,230,365 B1 * 5/2001 Lu ..... 16/342
6,254,390 B1 7/2001 Wagner
6,260,227 B1 7/2001 Fulop
D446,021 S 8/2001 Jen
D447,238 S 8/2001 Tang
6,276,021 B1 8/2001 Hohlbein
D448,174 S 9/2001 Harris et al.
6,289,545 B1 9/2001 Molster
6,290,303 B1 9/2001 Boucherie
D448,569 S 10/2001 Harris et al.
D448,570 S 10/2001 Harris et al.
D448,571 S 10/2001 Harris et al.
6,298,516 B1 10/2001 Beals et al.
D450,457 S 11/2001 Hohlbein
6,311,358 B1 11/2001 Soetewey et al.
6,311,360 B1 11/2001 Lanvers
6,314,606 B1 * 11/2001 Hohlbein ..... 15/167.1
6,319,332 B1 11/2001 Gavney, Jr. et al.
6,322,573 B1 11/2001 Murayama
6,332,233 B1 12/2001 Proulx
D452,615 S 1/2002 Cheong et al.
6,338,176 B1 1/2002 Smith et al.
D453,270 S 2/2002 Choong
6,345,405 B1 2/2002 Brackin
D453,998 S 3/2002 Ping
D454,252 S 3/2002 Lee
6,352,545 B1 3/2002 Wagner
6,353,958 B2 3/2002 Weihrauch
D456,139 S 4/2002 Hohlbein
6,374,448 B2 4/2002 Seifert
D456,607 S 5/2002 Carlucci et al.
D457,323 S 5/2002 Hohlbein
D457,325 S 5/2002 Wilson et al.
6,383,202 B1 5/2002 Rosenblood
D458,453 S 6/2002 Baertschi
D459,086 S 6/2002 Belton et al.
D459,087 S 6/2002 Pfleger
6,402,768 B1 6/2002 Liebel
6,408,476 B1 6/2002 Cann
6,421,867 B1 7/2002 Weihrauch
D461,313 S 8/2002 Hohlbein
D461,959 S 8/2002 Chan et al.
6,440,149 B1 8/2002 Potti
D462,178 S 9/2002 Moskovich et al.
D462,527 S 9/2002 Ping
D462,528 S 9/2002 Crossman et al.
D463,131 S 9/2002 Winter et al.
D463,132 S 9/2002 Winter et al.
D463,133 S 9/2002 Hohlbein
6,442,786 B2 9/2002 Halm et al.
6,446,295 B1 9/2002 Calabrese
D463,668 S 10/2002 Yoshimoto et al.
D464,796 S 10/2002 Winter et al.
6,463,618 B1 10/2002 Zimmer
6,463,619 B2 10/2002 Gavney, Jr.
D465,847 S 11/2002 Jacobs
D466,302 S 12/2002 Ping
D467,430 S 12/2002 Ping
6,496,999 B1 12/2002 Gleason et al.
D469,958 S 2/2003 Saindon et al.
D471,276 S 3/2003 Potti
6,546,586 B2 4/2003 Cho
6,553,604 B1 4/2003 Braun et al.
D474,608 S 5/2003 Hohlbein
6,564,416 B1 5/2003 Claire et al.
D475,531 S 6/2003 Klimeck et al.
D476,158 S 6/2003 Ling
6,571,417 B1 6/2003 Gavney, Jr.
D476,487 S 7/2003 Saindon et al.
D477,465 S 7/2003 Reilly et al.
D478,211 S 8/2003 Ping
D478,213 S 8/2003 Ping
D478,424 S 8/2003 Saindon et al.
D478,425 S 8/2003 Ping
D478,727 S 8/2003 Wong
D478,728 S 8/2003 Wong
6,601,272 B2 8/2003 Stvartak et al.
D479,047 S 9/2003 Wong
D479,914 S 9/2003 Choong
6,625,839 B2 9/2003 Fischer
D480,213 S 10/2003 Ping
D480,214 S 10/2003 Kling et al.
D480,877 S 10/2003 Crossman et al.
D482,199 S 11/2003 De Salvo
6,641,764 B2 11/2003 Lanvers
6,647,581 B1 11/2003 Persad et al.
D483,184 S 12/2003 Geiberger et al.
D483,568 S 12/2003 Jamson
D483,569 S 12/2003 Wong
D485,989 S 2/2004 Winkler
D486,649 S 2/2004 Sprosta et al.
6,687,940 B1 2/2004 Gross et al.
D487,195 S 3/2004 Winkler
6,702,394 B2 3/2004 Boucherie
6,708,364 B1 * 3/2004 Huber ..... 15/167.1
D488,621 S 4/2004 Wong
6,729,789 B2 5/2004 Gordon
6,779,851 B2 8/2004 Bouchiere et al.
6,792,642 B2 9/2004 Wagstaff
6,802,097 B2 10/2004 Hafliger et al.
6,817,054 B2 11/2004 Moskovich et al.
6,820,299 B2 11/2004 Gavney, Jr.
6,865,767 B1 3/2005 Gavney, Jr.
D503,538 S 4/2005 Desalvo
6,886,207 B1 5/2005 Solanki
6,895,629 B1 5/2005 Wenzler
6,931,688 B2 8/2005 Moskovich et al.
6,988,777 B2 1/2006 Pfenniger et al.
7,020,928 B2 4/2006 Hohlbein
2001/0014232 A1 8/2001 Suda et al.
2001/0023516 A1 9/2001 Driesen et al.
2001/0041903 A1 11/2001 Richard
2001/0042280 A1 11/2001 Moskovich et al.
2001/0047556 A1 12/2001 Weihrauch
2001/0050507 A1 12/2001 Boucherie
2002/0004964 A1 1/2002 Luchino et al.
2002/0019645 A1 2/2002 Fischer et al.
2002/0100134 A1 8/2002 Dunn et al.
2002/0108194 A1 8/2002 Carlucci et al.
2002/0120991 A1 9/2002 Cacka et al.
2002/0124333 A1 9/2002 Hafliger et al.
2002/0124337 A1 9/2002 Calabrese et al.
2002/0138926 A1 10/2002 Brown, Jr. et al.
2002/0138928 A1 10/2002 Calabrese
2002/0138931 A1 10/2002 Davies
2002/0166188 A1 11/2002 Driesen et al.
2002/0170145 A1 11/2002 Stvartak et al.
2003/0009837 A1 1/2003 Cann
2003/0115699 A1 6/2003 Wagstaff
2003/0132661 A1 7/2003 Sato et al.
2003/0159224 A1 8/2003 Fischer et al.
2003/0163149 A1 8/2003 Heisinger, Jr.
2003/0167582 A1 9/2003 Fischer et al.
2003/0182744 A1 10/2003 Fattori
2003/0208865 A1 11/2003 Davies
2003/0216762 A1 11/2003 Levit
2003/0229959 A1 12/2003 Gavney et al.
2004/0006837 A1 1/2004 Cann
2004/0010876 A1 1/2004 Kraemer
2004/0025272 A1 2/2004 Stvartak et al.
2004/0025275 A1 2/2004 Moskovich et al.

| | | | |
|---|---|---|---|
| 2004/0031115 | A1 | 2/2004 | Gavney, Jr. |
| 2004/0068810 | A1 | 4/2004 | Lee |
| 2004/0134007 | A1 | 7/2004 | Davies |
| 2004/0168269 | A1 | 9/2004 | Kunita et al. |
| 2004/0177462 | A1 | 9/2004 | Brown, Jr. et al. |
| 2004/0200016 | A1 | 10/2004 | Chan et al. |
| 2004/0221409 | A1 | 11/2004 | Gavney, Jr. |
| 2004/0231076 | A1 | 11/2004 | Gavney, Jr. |
| 2004/0237236 | A1 | 12/2004 | Gavney, Jr. |
| 2004/0255416 | A1 | 12/2004 | Hohlbein |
| 2005/0000049 | A1 | 1/2005 | Hohlbein |
| 2005/0015904 | A1 | 1/2005 | Gavney, Jr. |
| 2005/0038461 | A1 | 2/2005 | Phillips |
| 2005/0069372 | A1 | 3/2005 | Hohlbein et al. |
| 2006/0200925 | A1 | 9/2006 | Moskovich et al. |
| 2006/0272113 | A1 | 12/2006 | Cato et al. |

FOREIGN PATENT DOCUMENTS

| | | | |
|---|---|---|---|
| DE | 857128 | | 11/1952 |
| DE | 3114507 | A1 | 3/1983 |
| DE | 3620846 | | 12/1987 |
| DE | 2930459 | | 2/1989 |
| DE | 195 00 107 | A1 | 7/1996 |
| DE | 3639424 | A1 | 6/1998 |
| DE | 19817704 | A1 | 10/1999 |
| DE | 10258519 | A1 | 7/2004 |
| EP | 0567672 | A2 | 3/1993 |
| EP | 0 613 636 | | 9/1994 |
| EP | 0875169 | A | 4/1998 |
| EP | 0 930 030 | A2 | 7/1999 |
| EP | 0972464 | A1 | 7/1999 |
| EP | 1 034 721 | | 9/2000 |
| EP | 1 059 049 | A | 12/2000 |
| EP | 1308108 | | 5/2003 |
| EP | 1 350 442 | | 10/2003 |
| FR | 537979 | | 6/1922 |
| FR | 38440 | | 5/1930 |
| FR | 2594307 | A1 | 4/1987 |
| GB | 17643 | | 0/1912 |
| GB | 495982 | | 11/1938 |
| GB | 1 330 606 | A | 9/1973 |
| GB | 2 371 217 | | 7/2002 |
| GB | 2391462 | | 2/2004 |
| JP | 401214306 | A | 8/1989 |
| JP | 5-76416 | A | 3/1993 |
| JP | 408322641 | A | 12/1996 |
| JP | 2000-278899 | | 10/2000 |
| JP | 2000-308522 | | 11/2000 |
| JP | 2001-190333 | | 7/2001 |
| JP | 2001190333 | A | 7/2001 |
| JP | 2001-314232 | | 11/2001 |
| JP | 2002-10832 | | 1/2002 |
| JP | 2002-142867 | | 5/2002 |
| SU | 1687243 | A1 | 10/1991 |
| WO | 9422346 | A1 | 10/1994 |
| WO | WO98/05241 | | 2/1998 |
| WO | WO 98/08458 | | 3/1998 |
| WO | WO98/09573 | | 3/1998 |
| WO | WO99/49754 | A1 | 10/1999 |
| WO | WO 00/64306 | | 11/2000 |
| WO | WO 00/64307 | | 11/2000 |
| WO | WO01/17433 | A1 | 3/2001 |
| WO | WO01/45573 | | 6/2001 |
| WO | WO 01/45573 | | 6/2001 |
| WO | 0180686 | A2 | 11/2001 |
| WO | WO 01/80686 | A2 | 11/2001 |
| WO | WO 02/062174 | | 8/2002 |
| WO | WO 02/071967 | A2 | 9/2002 |
| WO | WO03/030680 | A | 4/2003 |
| WO | WO 03/037210 | | 5/2003 |
| WO | WO 03/043459 | | 5/2003 |
| WO | WO03/196283 | A1 | 10/2003 |
| WO | WO 03/090639 | A | 11/2003 |
| WO | WO 03/229959 | A1 | 12/2003 |
| WO | WO 2004/019801 | A | 3/2004 |
| WO | WO 2004/082428 | | 9/2004 |
| WO | 2008/093300 | A | 8/2008 |

OTHER PUBLICATIONS

Computer generated English Translation of JP 2001-190333.
English translation of Abstract of JP 2002-10832, Suzuki, Jan. 2002.
Computer generated English translation of JP 2002-10832, Suzuki, Jan. 2002.
Decision on Grant from the Patent Office of Russia from corresponding Russian Patent Application No. 2008148126 [English translation].
International Search Report PCT/US2008/069389 Mailed Jul. 15, 2009.

* cited by examiner

ORAL CARE IMPLEMENT HAVING FLEXIBLY SUPPORTED CLEANING ELEMENTS EXTENDING IN OPPOSITE DIRECTIONS

CROSS-REFERENCE TO RELATED APPLICATIONS

This application is a continuation in part application of U.S. application Ser. No. 11/624,947, now U.S. Pat. No. 7,930,792 filed Jan. 19, 2007.

In addition, this application is a continuation in part application of U.S. application Ser. No. 11/429,677, now U.S. Pat. No. 7,841,041 filed May 8, 2006, which is a continuation in part application of U.S. application Ser. No. 11/256,790, now U.S. Pat. No. 7,614,111, filed Oct. 24, 2005, which is a continuation in part application of U.S. application Ser. No. 11/122,224, now U.S. Pat. No. 7,845,042, filed May 5, 2005, which is a continuation in part application of U.S. application Ser. No. 10/768,363, now U.S. Pat. No. 7,703,163, filed Jan. 30, 2004, which is a continuation in part application of U.S. application Ser. No. 10/697,213, now U.S. Pat. No. 7,757,326, filed Oct. 30, 2003.

Further, this application is a continuation in part application of U.S. application Ser. No. 11/019,671, filed Dec. 23, 2004 now U.S. Pat. No. 7,721 376, which: (1) is a continuation in part application of U.S. application Ser. No. 10/869,922, filed Jun. 18, 2004 now U.S Pat. No. 7,143,462, which is a continuation in part application of U.S. application Ser. No. 10/601,106, filed Jun. 20, 2003 now abandoned; (2) is a continuation in part application of International Application PCT/US03/030633 filed Sep. 26, 2003, which claims the benefit of U.S. Application 60/414,117 filed Sep. 27, 2002, U.S. Application 60/418,776, filed Oct. 16, 2002, and U.S. Application 60/419,425, filed Oct. 18, 2002; (3) is a continuation in part application of International Application PCT/US03/29497, filed Sep. 17, 2003, which claims the benefit of U.S. Application 60/412,290, filed Sep. 20, 2002; (4) is a continuation in part application of U.S. application 29/189,729, filed Sep. 10, 2003 now U.S Pat. No. D. 517,812; and (5) is a continuation in part application of U.S. application Ser. No. 10/989,267, filed Nov. 17, 2004 now U.S. Pat. No. 7,607,189, which is a continuation in part application of U.S. Application 29/209,242, now abandoned, filed Jul. 14, 2004.

Additionally, this application is a continuation in part application of U.S. application Ser. No. 10/989,267, filed Nov. 17, 2004 now U.S Pat. No. 7,607,189, which is a continuation in part application of U.S. application Ser. No. 29/209,242, filed Jul. 14, 2004 now abandoned, and a continuation in part application of U.S. application Ser. No. 29/209,244, filed Jul. 14, 2004 now abandoned.

Further, this application is a continuation in part application of U.S. application Ser. No. 10/902,257 now U.S. Pat No. 7,047,591, filed Jul. 30, 2004, which (1) is a continuation in part application of International Application PCT/US03/029497, filed Sep. 17, 2003, which claims priority to U.S. Application 60/412,290, filed Sep. 20, 2002; and (2) is a continuation in part application of U.S. application Ser. No. 29/189,729, filed Sep. 10, 2003 now U.S. Pat. No. D. 517,821.

In addition, this application is a continuation in part application of U.S. application Ser. No. 11/053,583, now U.S. Pat. No. 7,360,270 filed Feb. 8, 2005, which is a continuation of International Application PCT/US03/024878, filed Aug. 8, 2003, which claims priority to U.S. Applications 60/402,162 filed Aug. 9, 2002, 60/402,170 filed Aug. 9, 2002 and 60/402,670 filed Aug. 12, 2002.

Further, this application is a continuation in part application of U.S. application Ser. No. 11/053,589, now U.S. Pat. No. 7,725,981 filed Feb. 8, 2005, which is a continuation of International Application PCT/US03/024879, filed Aug. 8, 2003, which claims priority to U.S. Application 60/402,165 filed Aug. 9, 2002.

The contents of the above-noted applications are each expressly incorporated herein by reference.

FIELD OF THE INVENTION

The present invention pertains to an oral care implement having various features that may include a cleaner for cleaning soft tissue surfaces in a user's mouth, tooth cleaning or tooth treating elements, movable cleaning features, vibratory mechanisms, and/or handle gripping features.

BACKGROUND OF THE INVENTION

A toothbrush is used to clean teeth by removing plaque and debris from surfaces of the teeth as well to clean gum tissue surrounding teeth. Conventional toothbrushes typically have a head having tufts of bristles and may also have other types of cleaning structures. A variety of toothbrush configurations exist that have stationary and or mechanically driven movable cleaning elements. These conventional toothbrushes are dedicated to tooth cleaning/polishing operations and typically include a head portion directed to the cleaning/polishing operations, and a handle portion. The head typically has a flat or slightly altered surface to which the cleaning elements are attached, or to which mechanically-driven movable carriers for the cleaning elements are attached.

Tongue scrapers exist as devices for removing micro debris disposed on a user's tongue. Conventional tongue scrapers are stand-alone devices directed to the singular purpose of scraping a user's tongue. These conventional devices typically include a handle and scraper portion without including other cleaning elements.

Users manipulate conventional toothbrushes and tongue scrapers by grasping their handle portions. The handles are typically simple, linear rods of a relatively rigid material, which are neither comfortable for the user nor given to easy manipulation. As these devices are commonly used in wet conditions, their handles are often slippery during use.

Many people use multiple oral care implements, such as toothbrushes and tongue scrapers, on a daily basis to accomplish multiple oral care tasks. For instance, a user may use a toothbrush to clean his teeth and then use a tongue scraper to remove debris from his tongue. The user may then re-use the toothbrush to further clean his tongue. Thus, the user may switch between various oral care implements during a single session in a wet environment.

FIG. 30 schematically illustrates a conventional toothbrush 19010, which has a head 19012 and a handle 19014. As shown, the head has bristles 19016 extending from a front face of its head platform 19018. The overall thickness H1 of the head, including the bristles, ranges from 15 mm to 20 mm to permit comfortable use of the toothbrush by most adults.

FIG. 31 schematically illustrates a conventional combination toothbrush/tongue cleaner device 19030, which is generally the same as toothbrush 19010 except that it includes a tongue cleaner 19020 on its rear face. The overall thickness H2 of the head ranges from 16 mm to 20 mm to accommodate the tongue cleaner and to permit comfortable use of the device by most adults. As shown in FIG. 31, the head platform of conventional toothbrushes has a thickness T of 5 mm to 8 mm.

Conventional toothbrushes have cleaning elements that extend from a rigid head. Teeth and gums by nature have a complex intricate contour. Due to the rigid nature of the attachment of the cleaning elements to the head of the toothbrush, the orientation of the cleaning elements is not flexible and thus conventional toothbrushes do not provide optimal cleaning of teeth and gums. Conventional toothbrushes therefore have great difficulty in contacting areas of the teeth located at a greater distance from the head, including interproximal spaces between teeth.

BRIEF SUMMARY OF THE INVENTION

The present invention pertains to an oral care implement that provides several advantages and that may be used for multiple functions. In one embodiment of the invention, an oral care implement is provided that has a plurality of cleaning elements extending from the head, which are attached to a support that is flexibly attached to the head. The cleaning elements may include forward angled cleaning elements and/or rearward angled cleaning elements. The cleaning elements may further include a central support at a central portion of the support.

Embodiments of the invention may be multi-functional and include various combinations of features in advantageous combinations. Some embodiments include a soft tissue cleaner in combination with tooth cleaning features and/or in combination with gripping features on the handle that improve the user's grip and handling thereof. The embodiments may be manual or mechanically-driven devices, or combinations thereof.

One embodiment of an oral care implement includes a head platform having a plurality of faces with cleaning elements extending therefrom. The oral care implement can have flexibly mounted cleaning elements extending in opposite directions. The oral care implement can include a handle and a head with tooth cleaning elements extending from fixed pods and one or more central pods suspended between the fixed pods via a bridge. The bridge may be formed from an elastomer and permit the one or more central pods to move from an initial position toward and away from the head platform during use. The one or more central pods can include first cleaning elements extending in a first direction toward the first face and second cleaning elements extending in a second direction opposite the first direction. The second cleaning elements can extend through one or more apertures in the head platform.

Other features and advantages of the invention will become apparent from the following description taken in conjunction with the following drawings.

DETAILED DESCRIPTION OF THE INVENTION

Figure 1:
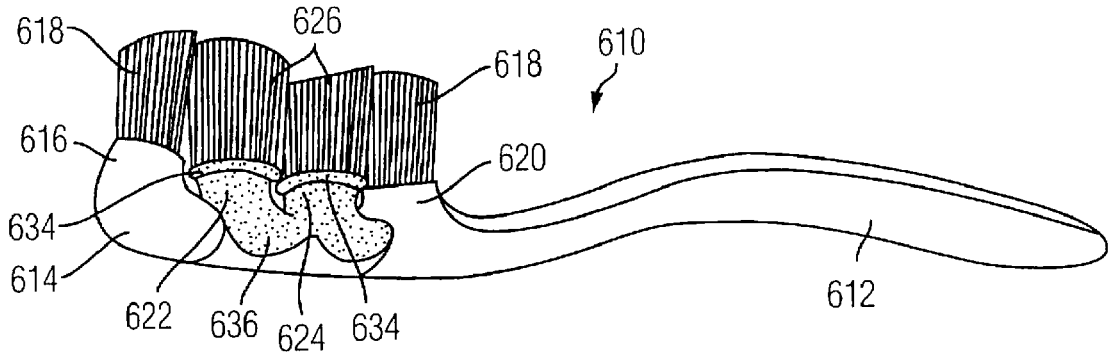
FIG. 1 is a perspective view of an embodiment of an oral care implement such as a toothbrush in accordance with this invention.

The following describes aspects of the invention in the form of various oral care implement configurations that provide a variety of features and functions. Although these aspects are disclosed in the context of particular exemplary embodiments, the invention provides an oral care implement that includes one or more of the features described herein. The oral care implement may include a first feature described in one example configuration herein, as well as a second feature described in another example configuration herein.

In other words, the invention contemplates mixing and matching features from the disclosed embodiments and configurations in various combinations into a single oral care implement. The present invention thus makes it possible to select a combination of cleaning element configurations, tissue cleaner configurations, handle features, gripping features, mechanical driving features, materials and orientations, etc. to achieve intended results, and to deliver additional oral health benefits, such as enhanced cleaning, tooth polishing, tooth whitening, tongue cleaning, massaging of gums, etc.

The term "cleaning elements" is intended to be used in a generic sense which could include elements for cleaning, treating, polishing, whitening, scraping, scrubbing, etc. Cleaning elements may include, but are not limited to, nylon or fiber bristles, massage elements, and elastomeric fingers or walls arranged in a circular cross-sectional shape or any type of desired shape including straight portions or sinusoidal portions. In the form of bristles, the cleaning elements may be secured to a flexible membrane or web via in-molded technology, mounting the tuft blocks or sections by extending them through suitable openings in the flexible membrane, or other mechanisms.

A variety of oral care implement configurations are disclosed herein. One configuration is an oral care implement having multiple groupings of cleaning elements that are uniquely mounted to the head of the oral care implement to facilitate flexible orientation of some groupings relative to the teeth and gums being cleaned. For example, groupings of the head may cooperate to "wrap around" individual teeth resulting in deeper penetration of cleaning/treating elements between teeth. Such configurations can provide effective overall cleaning, for example, by independent movement of groups of cleaning elements relative to the head and each other. This configuration and others are described below.

FIGS. 1-4 illustrate a toothbrush 610 in accordance with one embodiment of this invention. As shown therein toothbrush 610 includes an elongated handle 612 with a head 614 connected to and extending from the handle. The head 614 is divided into a plurality of separate cleaning areas which are spaced from each other. As illustrated the cleaning areas include a base 616 located at the distal end of the head 614 and projecting outwardly from the main body portion 930 (FIG. 4) of the head. Base 616 includes at least one and preferably a plurality of cleaning elements 618. Head 614 further includes a base or supporting member 620 at the proximal end of head 614. Cleaning elements 618 also extend outwardly from base 620.

Mounted between the cleaning areas that incorporate bases 616 and 620 are a pair of pods 622, 624. Each pod is provided with at least one and preferably a plurality of cleaning elements. As later described the pods 622, 624 have greater degrees of freedom than do the bases 616, 620. In a preferred practice of the invention the pods 622, 624 are resilient members so that the pod cleaning elements add a motion range beyond the cleaning elements 618 which are generally static or non-movable. Because the various cleaning elements are separated from each other such as by channels 728, which extend completely across head 614 in a transverse direction, and because of the elastic nature of pods 622, 624, the cleaning elements 626 may be capable of 360 degrees rotation about the vertical axis of each individual pod. The angle of the bend may be dictated by the ability of the material to bend.

Toothbrush 610 thus provides a head 614 wherein the front (distal end) and the back (proximal end) areas are in a relatively fixed position and wherein the cleaning/treating elements, such as bristle strands, 618 do not have any extra degree of motion. The middle portion of head 614, however, has two areas of cleaning elements 626, which are capable of 360 degree rotation.

Figure 4:
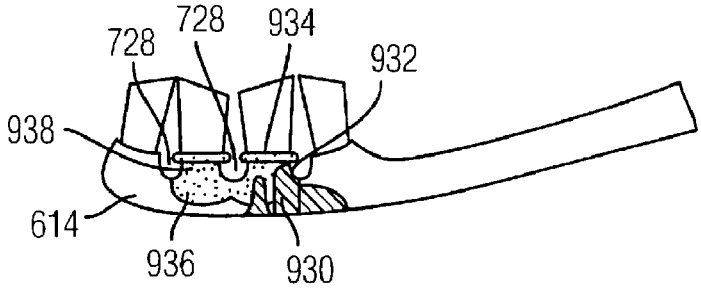
FIG. 4 is a side elevational view similar to FIG. 2 shown partially broken away.

As shown in FIG. 4, the head 614 includes a main body portion 930 which supports the bases and pods. Body portion 930 and bases 616 and 620 are preferably made from conventional hard plastic materials, such as polypropylene for example, commonly used in the making of toothbrush handles and heads. Pods 622, 624, however, are made so as to be resilient. In a preferred practice of this invention, the resiliency of pods 622, 624 is achieved by providing a thin diameter beam 932 which extends from the main body portion 930 of the head of the toothbrush. Beam 932 is joined into the bottom of a thin pad or plate 934 which provides a support area onto which the cleaning elements 626 are affixed. The manner of mounting the cleaning elements 626 to the support pads 934 can be achieved utilizing various cleaning elements, such as bristles and other cleaning materials, in known attachment methods.

The desired flexibility or resiliency of the pods 622, 624 is enhanced by enclosing the thin beams 932 in elastic material 936 during a multi-injection molding process. The elastic material 936 is resilient such that the beams 932 return to their original form or initial position. This return action creates an active motion in the opposite direction of the beam bend which aids in the cleaning of teeth by introducing extra brushing strokes.

Figure 2:
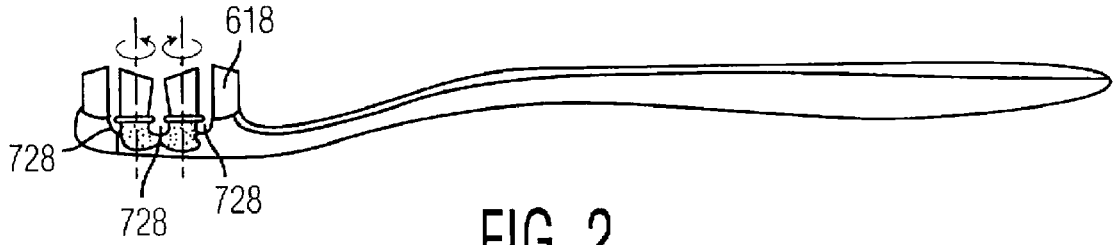
FIG. 2 is a side elevational view, in partial section, of the toothbrush shown in FIG. 1.

As best shown in FIGS. 1, 2 and 4 the pods 622, 624 include a widened portion disposed toward the body 930. The support pads 934 are also widened. Each pod has a narrow or reduced diameter central portion 938 longitudinally intermediate the length of each pod. Thus, each pod is of generally mushroom shape.

Beam 932 could be of any suitable shape such as having a cross-section which is circular, square or any other geometric shape that provides a thin dimension or thin diameter to the beam to facilitate the bendability of the beam. The elastomer 936 may be considered as a continuous layer of any suitable thickness which covers the entire central area of head 614 as illustrated so that both pods 622, 624 are incorporated as part of the same elastic material. The portion of the head 614 which includes pods 622, 624 may be formed as a separate subassembly similar to the subassembly later described with respect to FIGS. 5 and 6.

Although the invention could be practiced with a single base and a single pod and could be practiced with the base having some, but a lesser degree of flexibility than the pod, the invention is preferably practiced wherein the base is generally static or non-movable. In addition, the invention is preferably practiced where there are a plurality of such bases and a plurality of pods. The drawings illustrate a configuration of the invention where there are a total of four separate cleaning areas with the pods being located in the central portion of head 614. The invention may be practiced in a configuration in which the cleaning elements comprise a plurality of bristles or strands on each base and each pod.

Figure 3:
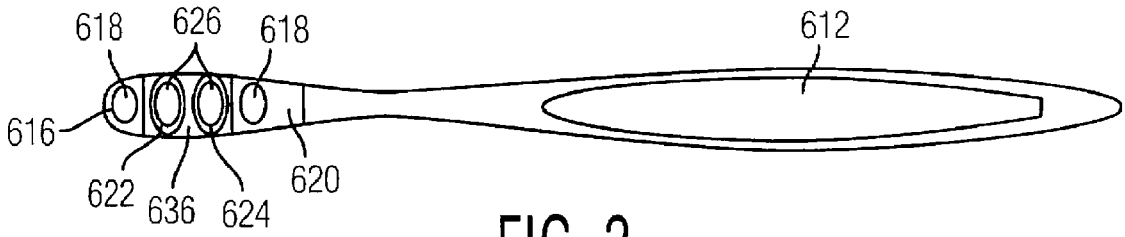
FIG. 3 is a top, plan view of the toothbrush shown in FIGS. 1 and 2.

As illustrated in FIGS. 3 and 4 each base 616 and 620 and each pod 622 and 624 may have a generally oval outer surface. The bases and pods are longitudinally aligned, but spaced from each other by the depressions or open areas which form the channels 728. As also illustrated in FIG. 3, the pods may have a larger outer surface or cleaning element carrying surface than do the bases.

As shown in FIG. 2 the terminal surfaces of the cleaning elements 618 and 626 are tapered so that the terminal surfaces of the cleaning elements 618 taper outwardly in a direction toward the center of head 614 while the terminal surfaces of cleaning elements 626 taper outwardly in a direction away from the center of head 614. Thus, the highest points of each set of cleaning elements 618 and its adjacent set of cleaning elements 626 are generally disposed toward each other for each pair of base and pod 616, 622 and 620, 624.

Any suitable form of cleaning elements may be used as the cleaning elements 618 and 626 in the broad practice of this invention. The term "cleaning elements" is intended to be used in a generic sense as described above. Using different cleaning materials as cleaning elements of the toothbrushes may yield different effects. In an attempt to provide better stain removal, a rubber-like material or elastomer can be used in combination with conventional bristles or used by itself to "brighten/whiten" the teeth.

It is to be understood that the specific illustration of the cleaning elements is merely for exemplary purposes. The invention can be practiced with various combinations of the same or different cleaning element configurations (such as stapled, anchor-free tufted (AFT) bristles or in-molded technology (IMT) bristles, etc.) and/or with the same bristle or cleaning elements materials (such as nylon bristles, spiral bristles, rubber bristles, etc.) Similarly, while FIG. 2 illustrates the cleaning elements to be generally perpendicular to the outer surface of head 614, some or all of the cleaning elements may be angled at various angles with respect to the outer surface of head 614. It is thereby possible to select the combination of cleaning element configurations, materials and orientations to achieve specific intended results to deliver additional oral health benefits, like enhanced cleaning, tooth polishing, tooth whitening and/or massaging of the gums.

Figure 5:
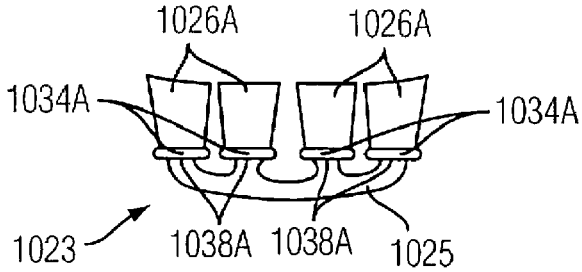
FIG. 5 is a side elevational view showing a subassembly of the bristle containing portion of a brush head in accordance with an aspect of the invention.
Figure 6:
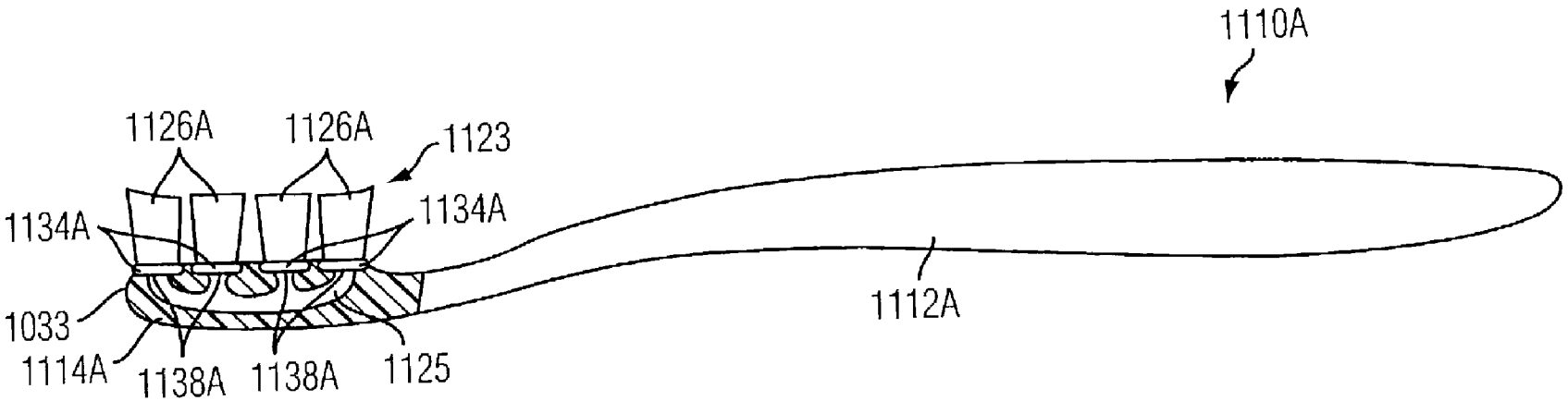
FIG. 6 is a side elevational view, in partial section, showing the subassembly of FIG. 5 incorporated in a completed toothbrush according to an embodiment of the invention.

FIGS. 5-6 illustrate a further embodiment of this invention. The toothbrush 1110A has the ability to provide flexible support for the bristles 1026A, 1126A in designated areas. The flexibility is provided by designing the tuft holding areas 1034A, 1134A as plates, which in combination with the stems 1038A, 1138A form pods of mushroom shape. The mushroom stem 1038A, 1138A is made flexible to allow the plate 1034A, 1134A populated with bristles or cleaning elements 1026A, 1126A to move in different directions while brushing, as described with respect to the flexible pods of FIGS. 1-4.

FIGS. 5-6 show the toothbrush 1110A and in particular the cleaning element or bristle carrying portion 1023, 1123 of the head 1114A. As shown in FIG. 5, the bristle or cleaning element carrying portion 1023 forms an initial subassembly. This subassembly is made by introducing the cleaning elements 1026A into the mold cavity into which a plastic material is injected. As the material injected cools off it permanently traps the bristles or cleaning elements 1026A to form a brush or subassembly 1023.

To achieve a functional flexibility and proper tuft retention the portion of the bristle holding part or subassembly 1023 which comprises the plates 1034A, stems 1038A and interconnecting support 1025 is preferably a blend of polypropylene (PP) and soft TPE. Once the PP/TPE blend is combined with the bristles 1026A, the subassembly 1023 is formed. The subassembly 1023 is then overmolded with an entire toothbrush handle 1112A and head 1114A during a second injection cycle to form the completed toothbrush 1110A shown in FIG. 6. If desired or required the entire handle 1112A and head 1114A absent the subassembly 1123 could be made first and the subassembly or bristle retaining portion 1123 made second. While an IMT process has been described, the subassembly could also be formed using an AFT process, wherein the cleaning elements are fused together and then captured within the plates, for example.

It is to be understood that the invention described in FIGS. 5-6 could be practiced where all portions of the head 1114A include the flexible mushroom sections without having less flexible base portions such as bases 616 and 620 of FIGS. 1-4. Similarly, the subassembly two shot techniques of FIGS. 5-6 could be utilized in the embodiment of FIGS. 1-4 for forming the two or more central pods as a single subassembly initially made separate from the remainder of the head 1114A. The final toothbrush would be made in a second injection molding process wherein the subassembly having interconnected pods 622, 624 would be molded to the handle 612 and head 614 made of more rigid material.

As noted, FIG. 2 illustrates the terminal surfaces of the cleaning elements 618 and 626 to be tapered in an up and down or zigzag manner. FIGS. 5-6 show an alternative taper wherein the terminal surfaces form a smooth, gentle, concave shape. If desired, other shapes may be used such as a planar shape for the terminal surfaces or a convex shape as well as the zigzag or up and down shape shown in FIG. 2. Similarly, the terminal ends of the cleaning elements in the FIGS. 1-4 embodiment, as well as those of FIGS. 5-6, could have the various shapes such as zigzag, convex, concave or planar.

FIGS. 7-25E show additional embodiments of the invention that further illustrate the combinability of various aspects, features and functions disclosed herein into single oral care implement configurations. FIGS. 7-25E disclose oral care implement configurations that provide a tooth cleaner having separate groups of cleaning elements, which may each be mounted on a fixed base or a flexible pod, and which may provide a soft tissue cleaner in addition to the tooth cleaner. The configurations may be powered or manual devices, and the handles may include gripping features. As such, the oral care implements disclosed in FIGS. 7-25E generally include the aspects discussed along with FIGS. 1-6 pertaining to groups of cleaning elements that may include flexible pods. It is understood that other features may used along with these configurations, such as mechanical drive features discussed in co-pending U.S. application Ser. Nos. 11/122,224 and 10/768,363 (i.e., the heads of the various embodiments described, herein could be vibrating heads) and tooth cleaning features discussed throughout the specification.

Figure 7:
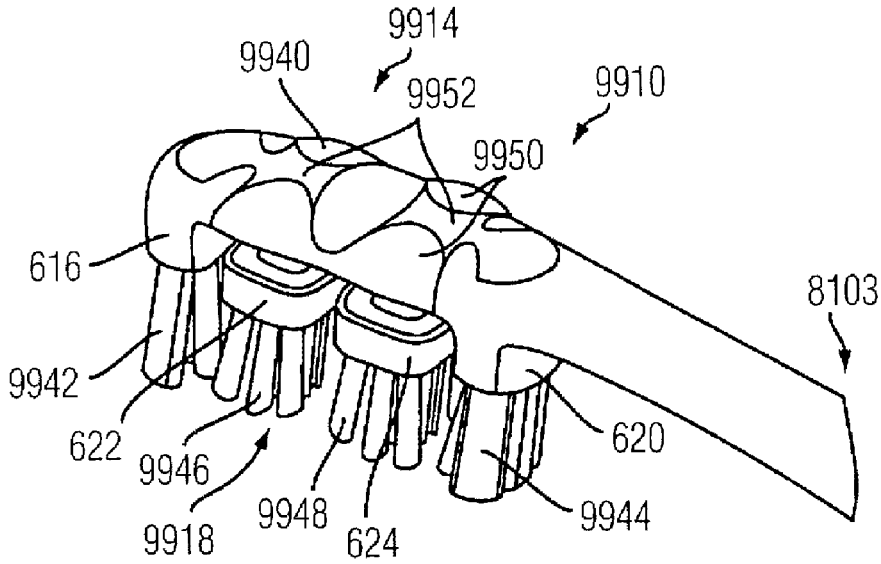
FIG. 7 is a perspective view of a head portion of an oral care implement in accordance with an embodiment of the invention.
Figure 8:
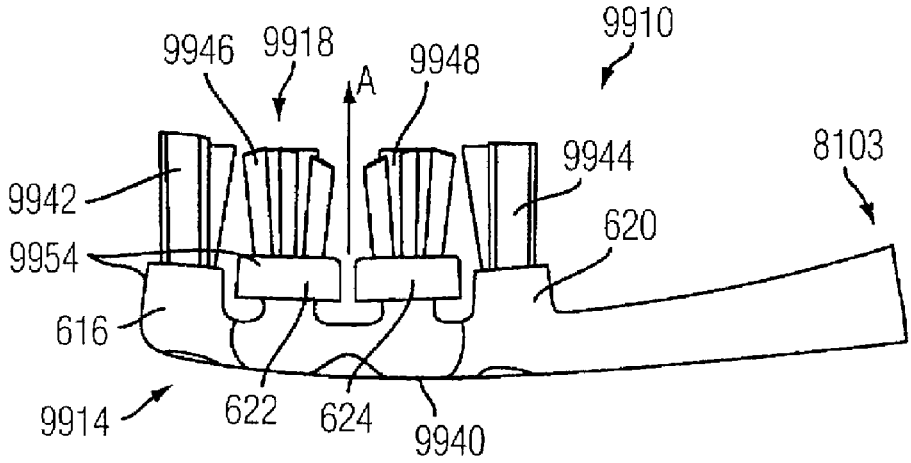
FIG. 8 is a side view of the head portion shown in FIG. 7.
Figure 9:
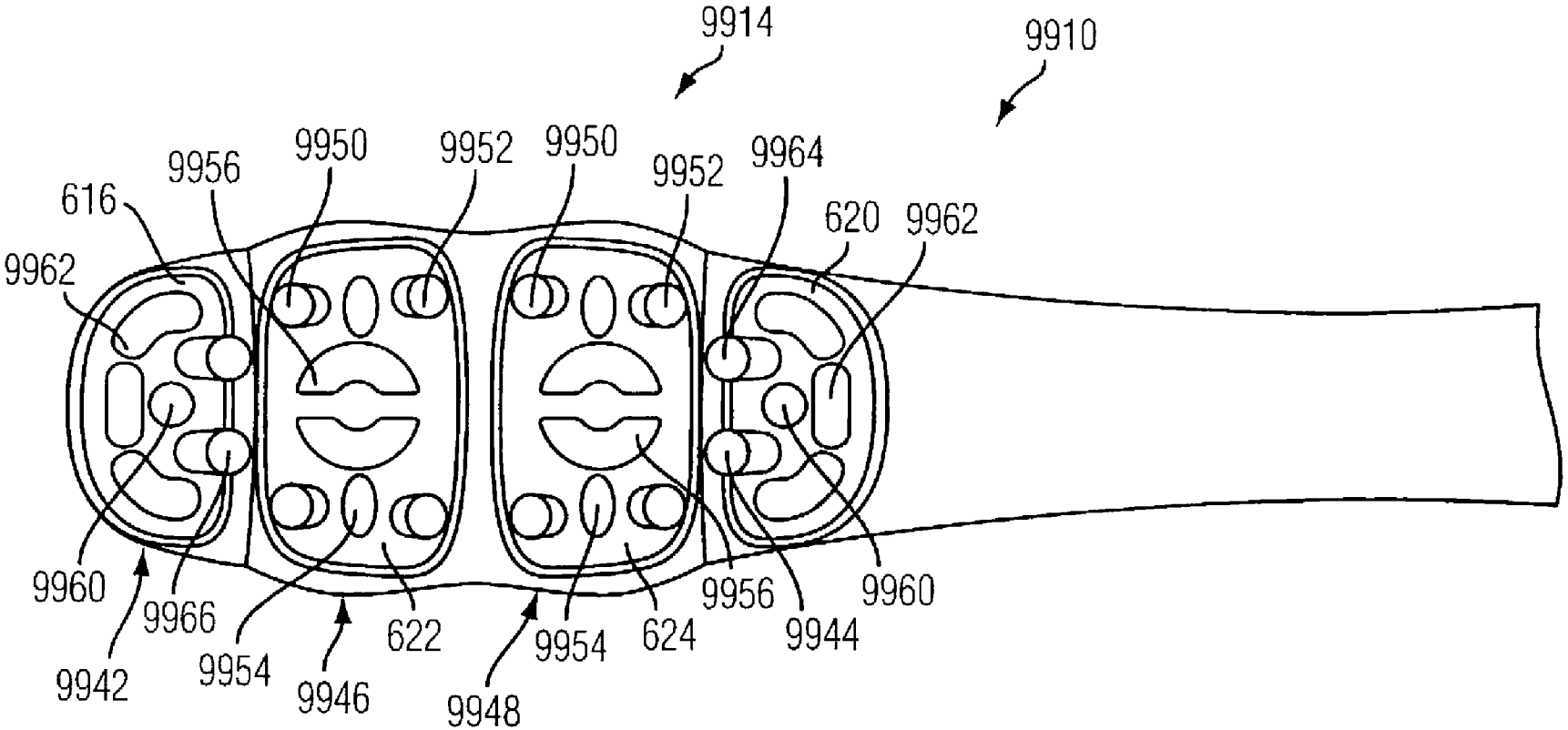
FIG. 9 is a top view of the head portion shown in FIGS. 7 and 8.

FIGS. 7-9 illustrate an oral care implement 9910, such as a toothbrush, in accordance with another embodiment of the invention. As shown therein, toothbrush 9910 includes a head 9914 and a handle 8103. Handle 8103 may be formed in accordance with the teachings of U.S. application Ser. No. 10/902,257, filed Jul. 30, 2004, incorporated by reference herein, although other handle configurations may be used, such as handle 612, 1112A shown in FIGS. 1-6. Head 9914 is generally the same as head 614 discussed along with FIGS. 1-6, with the exception of cleaning elements 9918 and the contoured surface 9940 disposed on an opposite side of the head from the cleaning elements. Thus, head 9914 generally includes bases 616 and 620 that respectively support cleaning elements 9942 and 9944 in a substantially static configuration. Head 9914 also includes pods 622 and 624 disposed between the bases for respectively supporting cleaning elements 9946 and 9948. As discussed along with FIGS. 1-6, pods 622 and 624 can provide flexible mounts for cleaning elements 9946 and 9948 attached thereto, and may permit rotation and/or oscillation of the cleaning elements 9946 and 9948.

FIG. 7 shows a contoured surface 9940 disposed on an opposite side of the head from the cleaning elements. Contoured surface 9940 includes hills 9950 and valleys 9952 to provide a rolling or undulating surface on a rear face of the head. Surface 9940 may be relatively smooth for use with massaging oral tissues and, as illustrated in FIGS. 10 and 12-18, the surface may include soft tissue cleaning elements for engaging soft oral tissues and provide cleaning benefits thereto.

FIG. 9 is top view of head 9914, which shows a configuration of tooth cleaning elements 9918 for use with head 9914. Cleaning elements 9918 may be formed of elastomeric wall members, elongate bristle tufts, or other types of cleaning elements, which are independently flexible. In this way, the cleaning elements are able to provide a limited and controlled flow of the dentifrice, as well as maintain sufficient flexibility to provide improved cleaning of a user's teeth and stimulation of the user's gums via the cleaning elements.

Cleaning elements 9918 are oriented for engaging surfaces to be cleaned in a generally intended application direction A (see FIG. 8), which is generally perpendicular to the face of head 9914. Cleaning elements 9918, however, include a mixture of cleaning elements that are aligned with (non-angled) and oblique to direction A (angled). The arrangement of angled and non-angled cleaning elements provides effective engagement and cleaning of oral surfaces, which is further enhanced by the movable pods configuration. The cleaning elements 9946 and 9948 mounted on pods 622 and 624 are adapted to engage a user's teeth, gums and other surfaces in a various ways that take advantage of their flexible support configuration. As such, cleaning elements 9946 and 9948 include forward elements 9950 angled toward the tip end of the head, and rearward elements 9952 angled toward the handle. As shown, the forward and rearward elements 9950, 9952 are preferably placed on the forward and rearward sides of their respective pods, and more preferably, are placed in the corner regions of the pods. Such a location and orientation increases the likelihood that elements 9950 and 9952 will initially engage a surface to be cleaned prior to other cleaning elements on the respective pod, which encourages the respective pod to flex as the remaining cleaning elements thereon are engaging the surface.

For instance, as oral care implement 9910 is moved forward such that head 9914 leads the toothbrush, forward elements 9950 will initially engage surfaces to be cleaned prior to rearward elements 9952 or other cleaning elements disposed between elements 9950 and 9952. The forward angle of elements 9950 will encourage pods 622 and 624 to bend rearward when the forward elements contact a surface to be cleaned while the toothbrush is moving forward. The rearward bending of the pods, and their action of springing forward in response to the bending, enhances the cleaning effectiveness of the cleaning elements 9946 and 9948 disposed on the pods. The angled configuration of elements 9950 and 9952 improves the bending of the pods in comparison with alternate embodiments wherein the cleaning elements are disposed perpendicular to the toothbrush face 9954 and are angled neither forward nor rearward Cleaning elements 9946 and 9948 of the pods also include non-angled cleaning elements 9954, which are beneficial for penetrating surfaces to be cleaned. In addition, cleaning elements 9946 and 9948 include a pair of bent, upstanding walls 9956 in a central portion of the pods. Such walls could be formed as a densely packed bristle tuft by an IMT or AFT process, or such walls could include elastomeric elements. Other configurations are contemplated. Each one of the walls in the pair 9956 has a concave side opposing the concave side of the other wall in the pair. The bent configuration and opposed convex sides of upstanding walls 9956 improve retention of dentifrice therebetween during use of the oral care implement. In addition, the bent configuration provides a pair of rigid walls, which, in their central location of the pod, supports the pod to prevent overflexing of the cleaning elements 9946, 9948.

Cleaning elements 9942 and 9944 disposed on static bases 616 and 620 are configured to cooperate with cleaning elements 9946 and 9948 on the movable pods, as well as to effectively clean oral surfaces. The bases each include a bristle bundle 9960, a series of upstanding walls 9962, and angled cleaning elements 9964, 9966. Bristle bundle 9960 is generally a non-angled column that effectively penetrates gaps and recesses between oral structures (e.g., teeth).

The series of upstanding walls 9962 are arranged to generally form a concave wall directed toward the remaining cleaning elements 9918. Thus, the concave wall 9962 of the front base 616 has its concave side directed rearward toward the handle, and the concave wall on the rear base 620 has its concave side directed forward toward the remainder of bristles 9918. In such a configuration, the opposing concave walls work in concert to retain dentifrice within the field of bristles 9918 via their concave shape that cups the dentifrice, as well as via small gaps between the upstanding walls that form the concave walls, which reduce the flow of dentifrice therebetween. In addition, the upstanding walls forming the concave walls are non-angled cleaning elements that provide support to the head 9914 during use and resist overflexing of the cleaning elements when excessive downward force is applied by the user.

Angled cleaning elements 9962 and 9964 are angled toward the movable pods 622 and 624 to cooperate with cleaning elements 9946 and 9948 attached thereto for effectively cleaning oral surfaces. As such, rear base 620 includes forward angled elements 9964, and front base 616 includes rearward angled elements 9966. Angled cleaning elements 9962 and 9964 are disposed close to one another inward of a respective pair of angled cleaning elements 9950 and 9952 of the movable pods. Thus, as the pods flex back and forth, angled cleaning elements 9962 and 9964 interpose between corresponding angled cleaning elements 9964 and 9966. This provides a scissor-like action that enhances cleaning effectiveness and avoids interference between opposing cleaning elements 9964, 9966 and 9962, 9964 that may limit movement of the pods.

The cleaning elements described in connection with the embodiment of FIGS. 7-9, as well as the embodiments to follow, are preferably formed using an AFT technique as is known in the art. This technique facilitates the arrangement of cleaning element constructions that depart from the traditional stapled perpendicular tuft. With AFT technology, the anchored ends of the cleaning elements are melted together to form a block of cleaning elements, that can then be arranged on a head plate with various dimensions, angles and orientations. Thus, the blocks of cleaning elements are generally captured within the pod structures, not embedded in a supporting medium.

Figure 10:
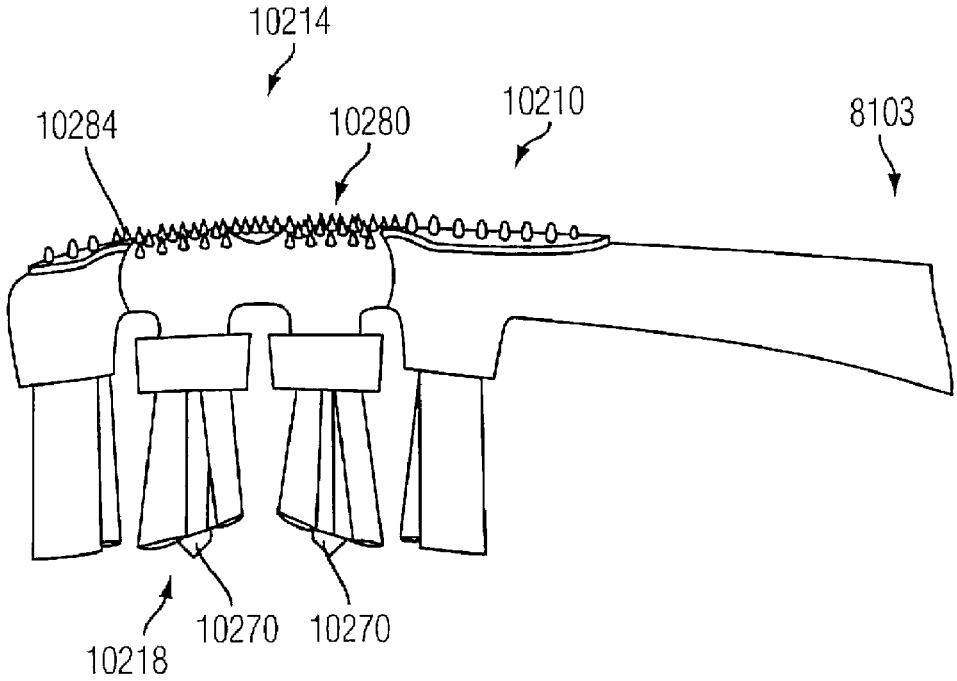
FIG. 10 is a side view of a head portion of an oral care implement in accordance with an embodiment of the invention.

Referring now to FIGS. 10-13, an oral care implement 10210 is shown in accordance with a further embodiment of the invention. As shown therein, oral care implement 10210 includes a handle 8103, a head 10214 having cleaning elements 10218 attached thereto on a first side of the head, and a soft tissue cleaner 10280 disposed on a second side of the head that is opposite to the first side. Oral care implement 10210 generally includes the aspects and features of oral care implement 9910, except as pertaining to the configuration of cleaning elements and the soft tissue cleaning features. Cleaning elements 10218 primarily include upstanding walls, which may include an elastomeric element, or may be formed as a densely packed bristle tuft by an IMT or AFT process. Other configurations are contemplated. The upstanding walls provide beneficial wiping and polishing of teeth, in addition to cleaning benefits. Cleaning elements 10218 also include a central columnar cleaning element 10270, which may be a bristle bundle, for penetrating oral surfaces. As shown in FIG. 10, each central cleaning element 10270 extends beyond other cleaning elements proximate thereto on the same pod. In addition, central cleaning element has a pointed tip. As such, central cleaning element 10270 effectively penetrates and engages oral surfaces and gaps between surfaces.

Figure 11:
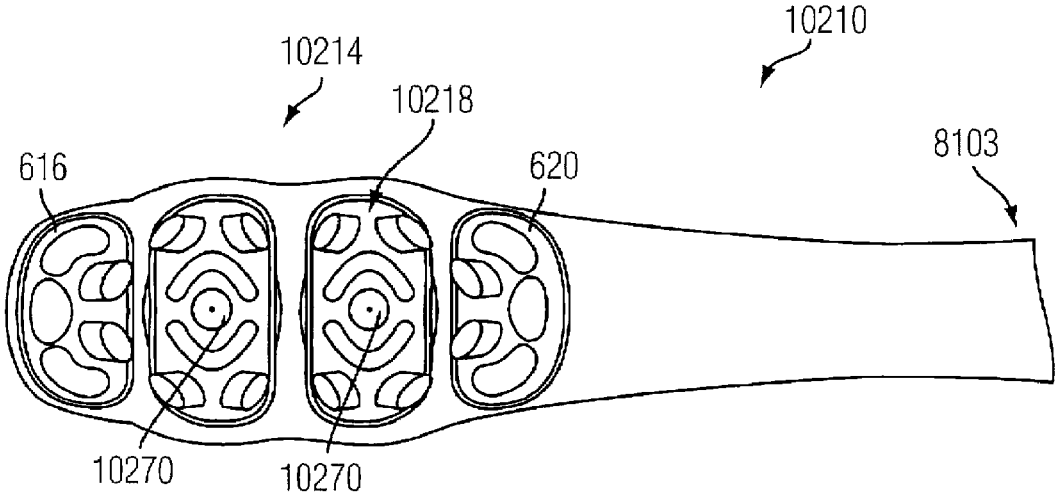
FIG. 11 is a top view of the head portion shown in FIG. 10.
Figure 12:
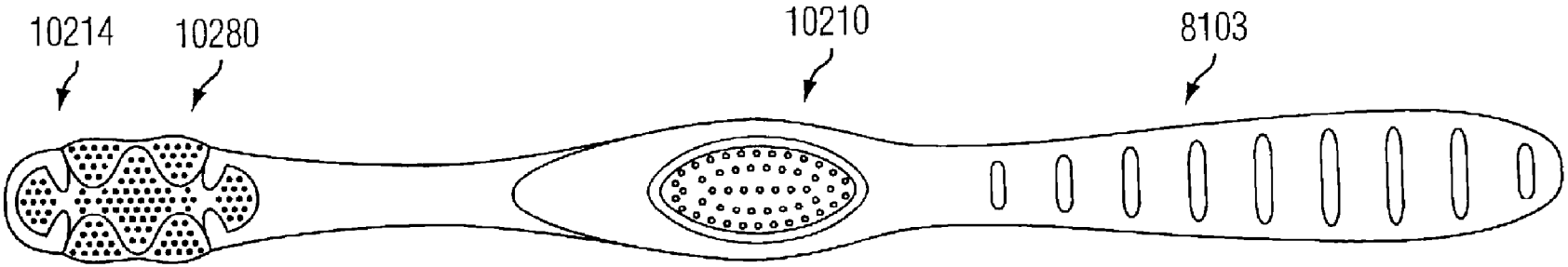
FIG. 12 is a top view of a soft tissue cleaner side of an oral care implement in accordance with a further embodiment of the invention.

Similar to the configuration of FIGS. 4 and 7, and as shown in FIG. 11, the tips or terminal ends of cleaning elements 10218 are tapered such that the pods are respectively encouraged toward their adjacent static base while engaging surfaces to be cleaned. Thus, during use, cleaning elements 9948 are generally biased toward engagement with cleaning elements 9944 on rear base 620, and cleaning elements 9946 are generally biased toward engagement with cleaning elements 9942 on front base 616. This bias can work along with movement of the pods that is imparted via engagement of angled cleaning elements with cleaning surfaces when the device is being moved. Increasing movement and the flexing of bases 622 and 624 further enhances the cleaning effectiveness of the oral care implement.

The soft tissue cleaner 10280 includes a plurality of projections 10281 extending from a face 10284 on a second side of head 10214, which is generally opposite from the direction in which tooth cleaning elements 10218 extend. Soft tissue cleaner 10280 is disposed on a contoured surface, such as contoured surface 9940 shown in FIG. 7, which includes hills 9950 and valleys 9952 to provide a rolling or undulating surface on a second face of the head. Projections 10281 may be separately molded and glued to the contoured surface or otherwise attached thereto. In addition, they may be integrally formed with the head 10214. The projections could each be made from a material different from other projections and/or different from other parts. Soft materials, such as a TPE or the like, can be fixed to head 10214 to form the projections. However, a harder material or virtually any known material used to make oral care implements may be appropriate for the projections.

Projections 10281 include a plurality of nubs 10282, which extend from contoured surface 9940 to engage the soft tissue in a user's mouth. The projections 10281 could have a variety of shapes, patterns, cross-sections, configurations, etc., and the soft tissue cleaner could have a variety of configurations for the projections.

Figure 13:
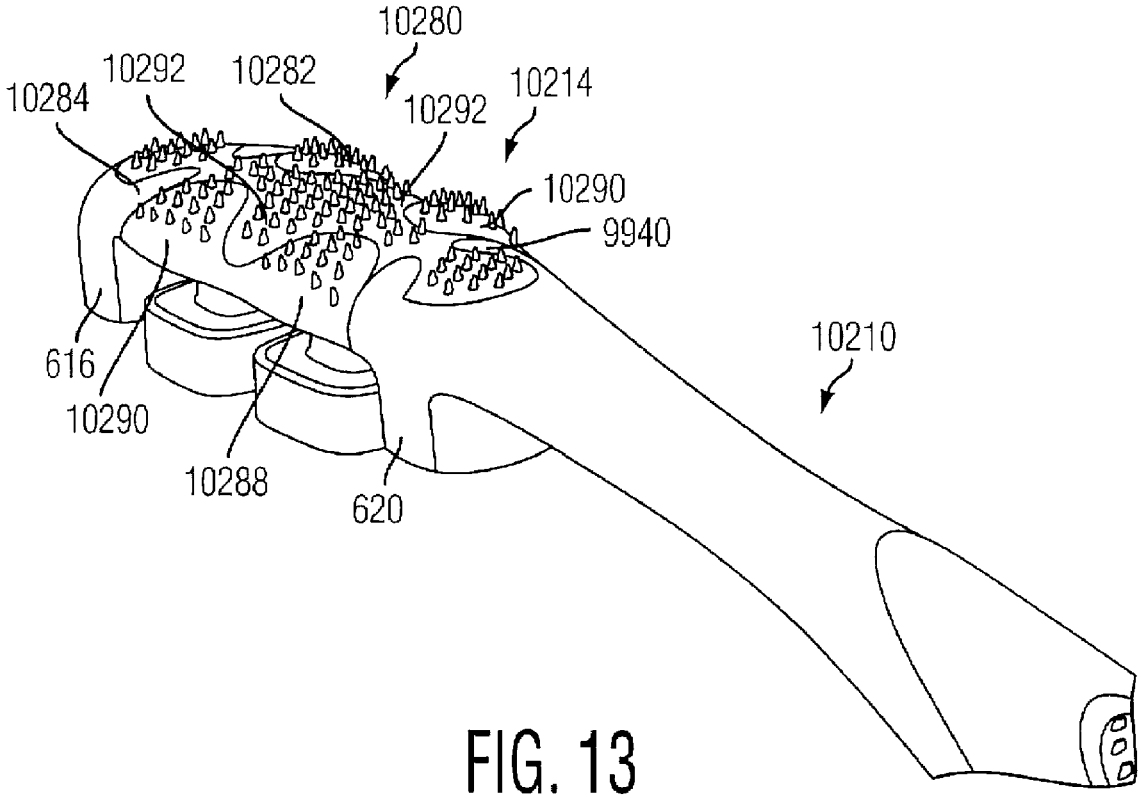
FIG. 13 is a partial perspective view of the oral care implement of FIG. 12 without tooth cleaning elements.

As shown in FIG. 13, nubs 10282 generally cover rear face 10284 in a cleaner field 10288, which extends from a region opposite the rear base 620 at a lower portion of the head to a region opposite the front base 616 at a tip portion of the head. The nubs are dispersed in a substantially continuous pattern over the cleaner field. The cleaner field includes hills 10290 proximate edge portions of face 10284, and valleys 10292 disposed between the hills and at a central portion of the face. The configuration of hills and valleys enhances the effectiveness of the soft tissue cleaner by concentrating the applied force at the hill portions during initial contact with a user's soft tissue, which can increase penetration into the soft tissue versus a relatively flat configuration. As the user applies additional force, the valleys contact the soft tissue to aid in cleaning the soft tissues. If excessive force is applied, the valleys help to limit excessive penetration. When the nubs in the valley regions engage the soft tissue, they provide the added benefit of dislodging debris that is loosened by the deeper penetration of nubs on the hills. Thus, projections on the hills and valleys work in concert to initially loosen and then dislodge debris in a user's soft tissue.

Figure 14:
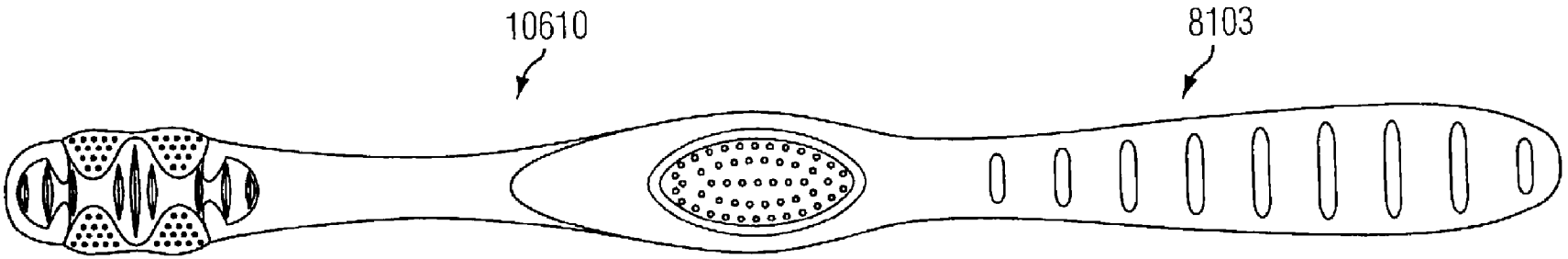
FIG. 14 is a top view of an oral care implement in accordance with a further embodiment of the invention.
Figure 15:
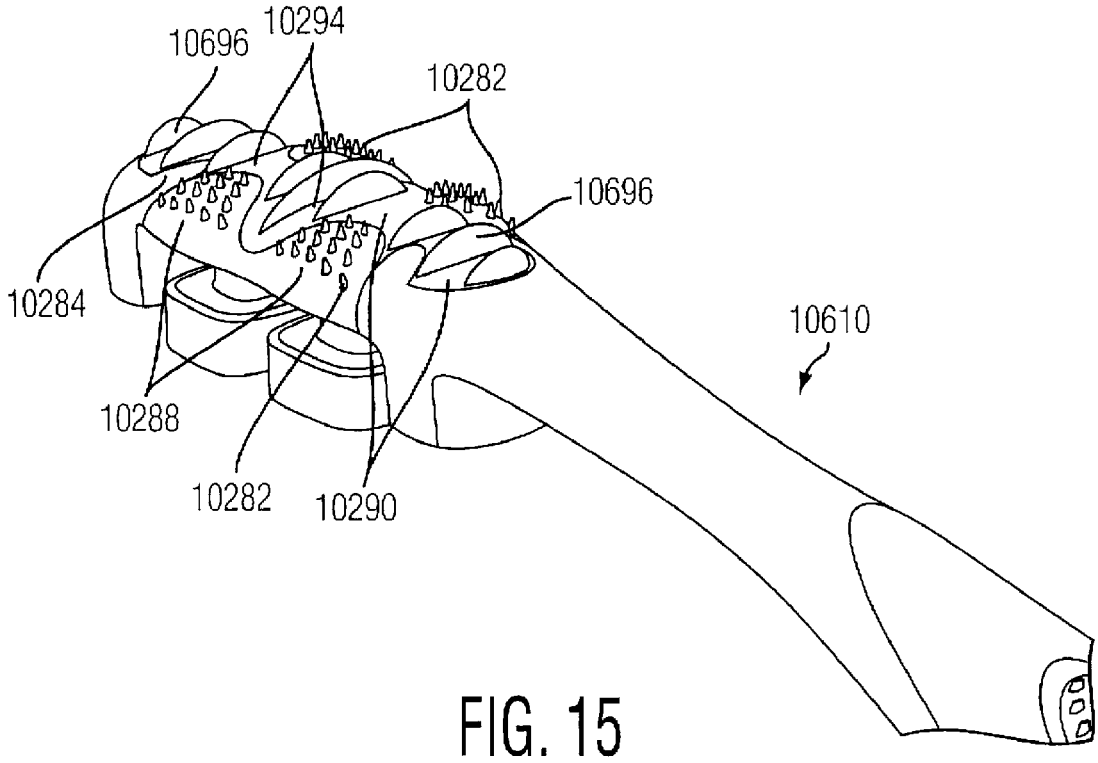
FIG. 15 is a partial perspective view of the oral care implement of FIG. 14 without tooth cleaning elements.

FIGS. 14 and 15 illustrate another embodiment 10610 of an oral care implement according to the invention. Oral care implement 10610 generally includes the same aspects and features of oral care implement 10210, except with respect to the configuration of projections on the soft tissue cleaner 10680. Rather than having nubs across the cleaner field, soft tissue cleaner 10680 only includes nubs 10282 on the hills 10288. Instead, multiple ridges 10294 are disposed in some of the valley regions 10290 including a central portion of face 10284. The ridges can be made from the same or a different material than the nubs. For instance, the nubs and ridges may be made of the same type of elastomer; however, the elastomer for the ridges may be more rigid than that for the nubs.

Ridges 10294 have variable lengths that provide variable levels of soft tissue engagement during use. As such, longer and shorter ridges can work in concert to loosen and dislodge debris as the different lengths of ridges successively engage portions of soft tissue. Ridges 10294 taper from a wide base region disposed proximate the face 10284, to a narrower tip 10696. Thus, increasing levels of soft tissue engagement are provided depending on the amount of user force applied.

Figure 16:
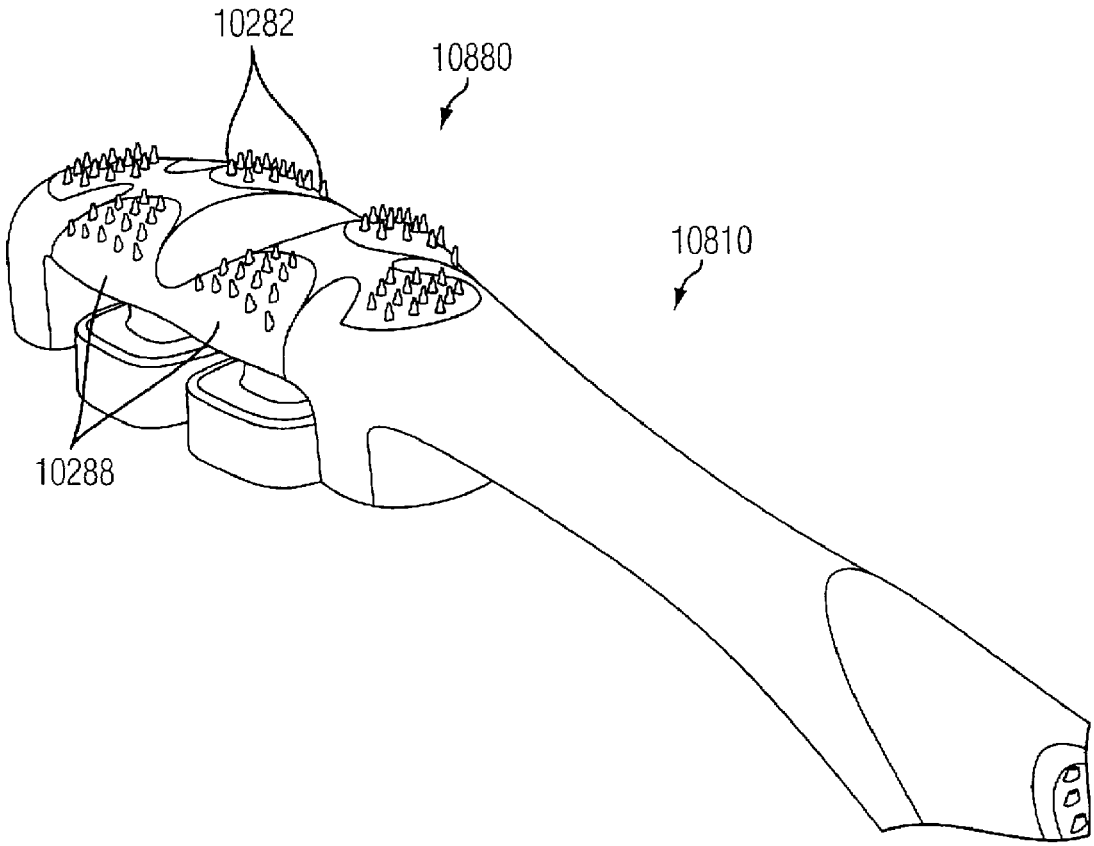
FIG. 16 is a partial perspective view of an oral care implement according to a further embodiment of the invention without tooth cleaning elements.

FIG. 16 illustrates another embodiment 10810 of an oral care implement according to the invention. Oral care implement 10810 generally includes the same aspect and features of oral care implement 10610, except with respect to the configuration of projections on the soft tissue cleaner 10880. Soft tissue cleaner 10880 differs from soft tissue cleaner 10680 in that it does not include ridges 10294. Thus, soft tissue cleaner includes nubs 10282 that are only located on hills 10288 along the side portions of face 10284. As such, gentle cleaning is provided via the nubs located on the hills. The gentle cleaning is beneficial for simultaneous functionality of the oral care implement, such as when a user cleans his teeth while simultaneously engaging soft tissues inside his cheek via soft tissue cleaner 10880. The gentle engagement can provide pleasant sensory stimulation along with gentle cleaning of the soft tissues.

Figure 17:
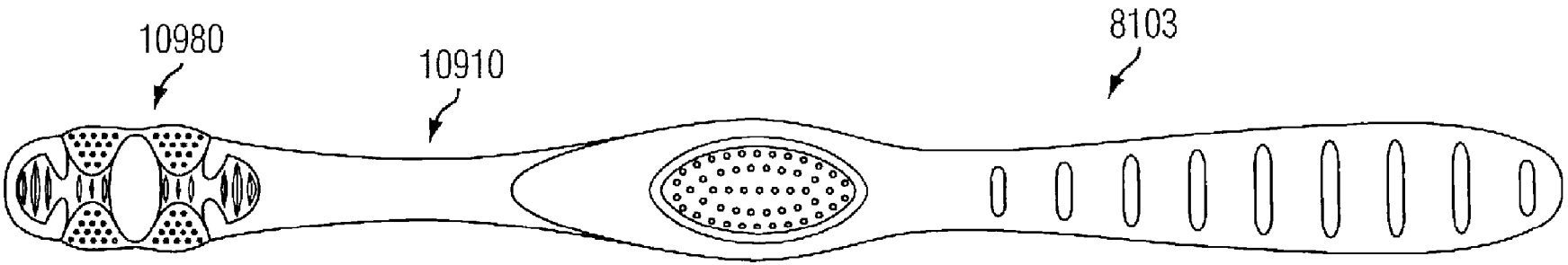
FIG. 17 is a top view of an oral care implement in accordance with a further embodiment of the invention.
Figure 18:
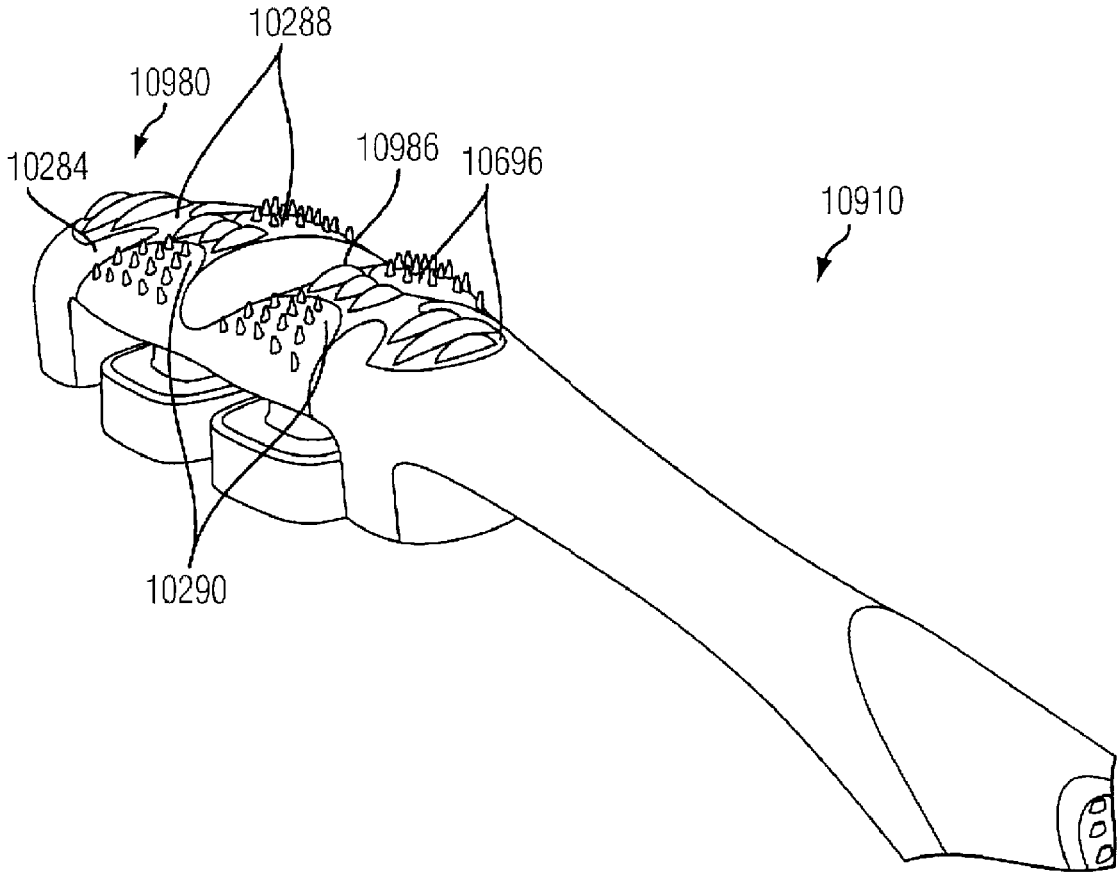
FIG. 18 is a partial perspective view of the oral care implement of FIG. 17 without tooth cleaning elements.

FIGS. 17 and 18 illustrate another embodiment 10910 of an oral care implement according to the invention. Oral care implement 10910 generally includes the same aspects and features of oral care implement 10610, except with respect to the configuration of projections on the soft tissue cleaner 10980. Soft tissue cleaner 10980 differs from soft tissue cleaner 10680 in that ridges 10994 are not provided in the central portion of face 10284, but are provided in valleys 10290 disposed between adjacent pairs of hills 10288. In addition, ridges 10994 are generally smaller than ridges 10294. As such, gentle cleaning is provided, which, similar to oral care implement 10810, can be beneficial during simultaneous functionality of the device.

Figure 19:
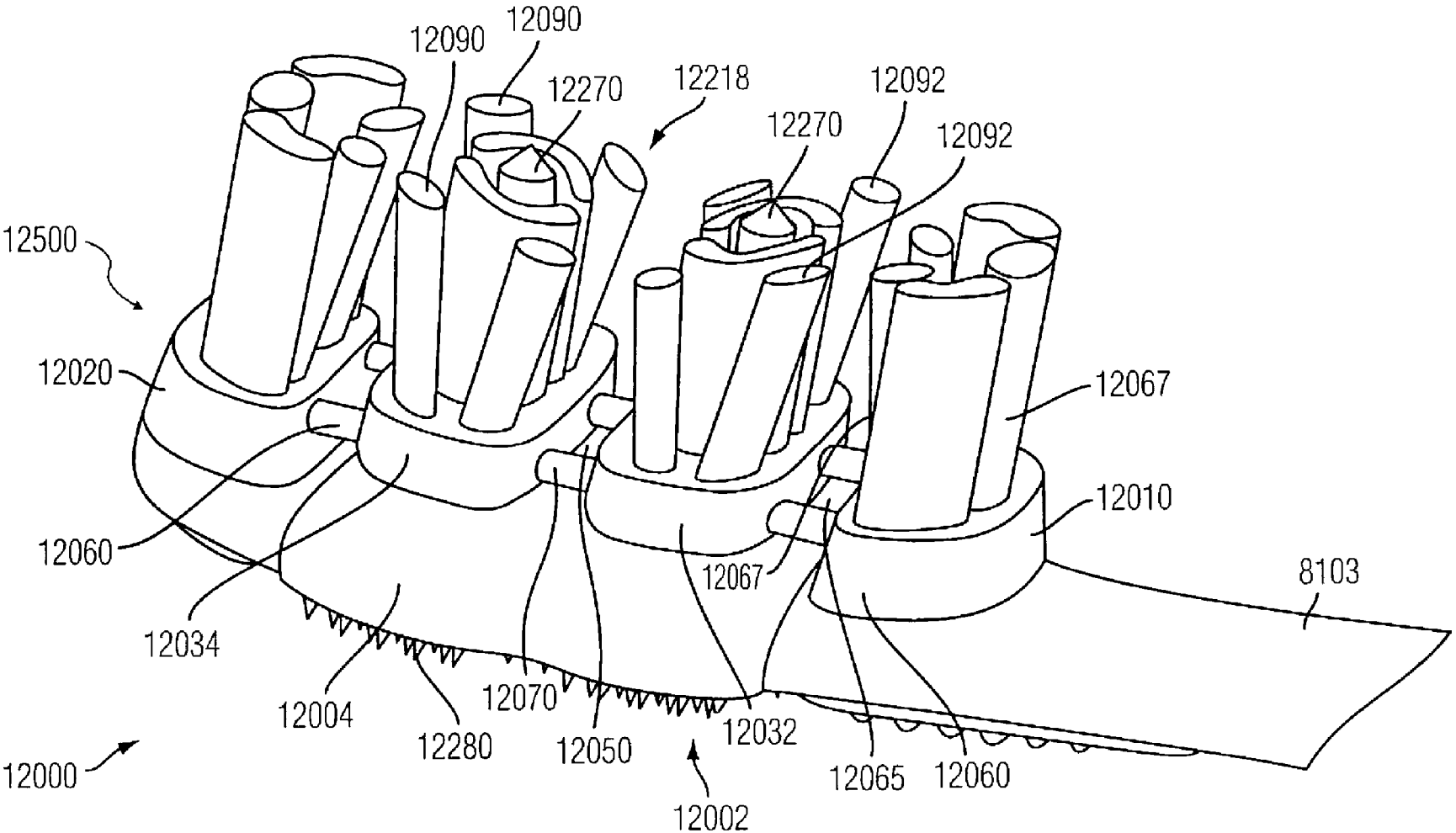
FIG. 19 is partial perspective view of an oral care implement according to an embodiment of the invention.
Figure 20:
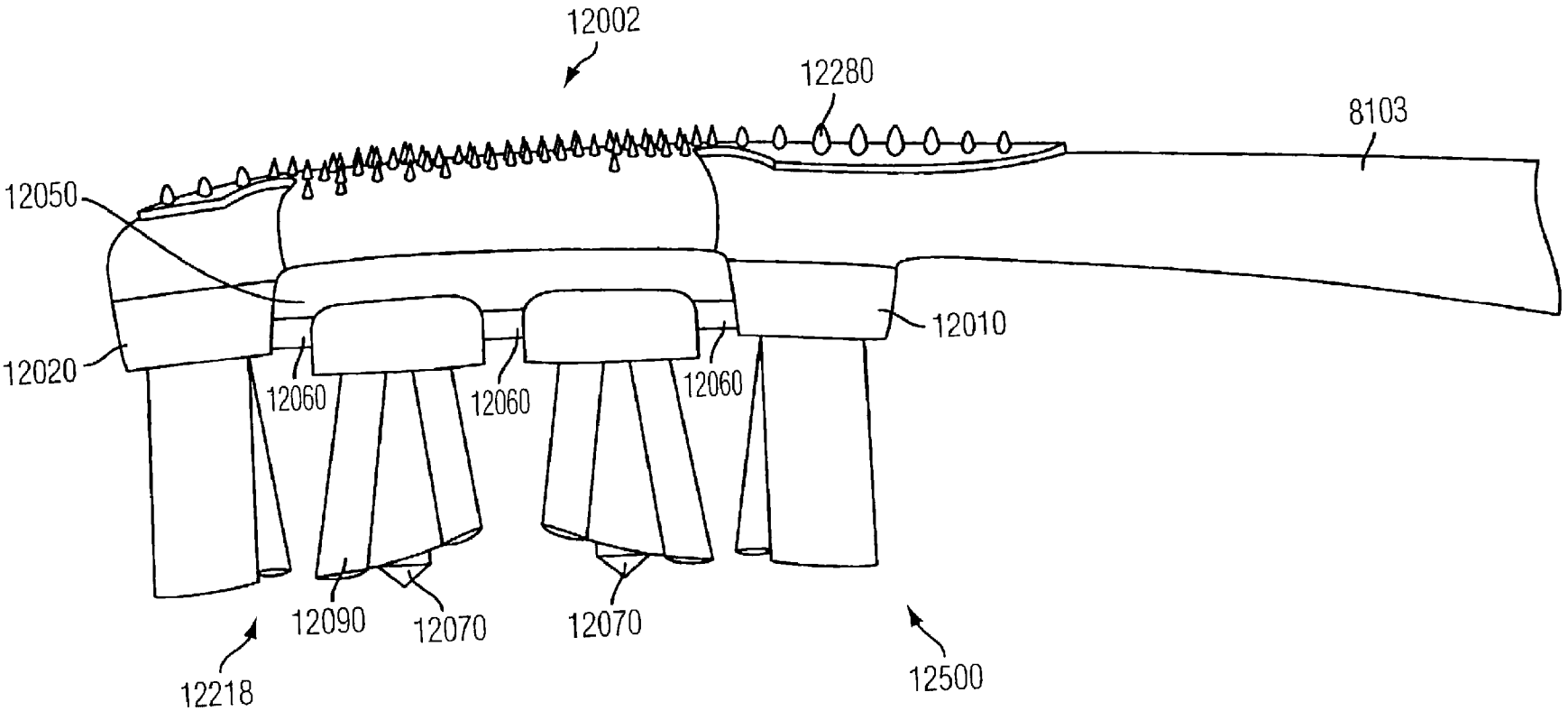
FIG. 20 is a side elevational view of the oral care implement of FIG. 19.

Referring now to FIGS. 19-20 an oral care implement 12000 is shown in accordance with a further embodiment of the invention. As shown therein, oral care implement 12000 includes a handle 8103, a head 12002 having a frame 12004, bases or pods 12010, 12020, 12032 and 12034 on a front side of the head, cleaning elements 12218 extending from the pods, and a soft tissue cleaner 12280 disposed on a rear side of the head that is opposite to the front side. Oral care implement 12000 generally includes the aspects and features of oral care implement 10210 shown in FIGS. 10-13, except as discussed hereafter. The soft tissue cleaner 12280 is generally the same as soft tissue cleaner 10280. However, various soft tissue cleaner configurations may be used, such as, for example, the soft tissue cleaners of FIGS. 14-18.

Oral care implement 12000 shown in FIGS. 19 and 20 is illustrated as having four pods: a proximal pod 12010, a distal pod 12020 and two central pods 12032 and 12034. The proximal and distal pods extend from frame 12004, which is on a rear portion of the head. The embodiment shown in FIGS. 19 and 20 differs from the embodiments shown in FIGS. 1-18 in that the central pods 12032 and 12034 are not connected directly to the rear, frame portion, of head 12002, but rather are suspended between the proximal pod 12010 and the distal pod 12020. The proximal pod and the distal pod are attached to the frame, whereas the central pods are suspended over the frame. As such, the central pods are spaced from the frame such that a gap 12050 is disposed therebetween.

Central pods 12032 and 12034 are suspended via bridge supports 12060, 12070 which may include a pair of substantially parallel supports. A first bridge support 12060 extends longitudinally between the proximal pod 12010 and central pod 12034, and a second pair of bridge supports 12060 extends longitudinally between distal pod 12020 and central pod 12034. In addition, a bridge support 12070 extends longitudinally between central pods 12032 and 12034. Thus, each central pod is supported by a pair of opposite bridge supports.

While the illustrated embodiment shows pairs of supports 12060 and 12070 on each side of each central pod, other configurations are contemplated. For example, instead of a pair of supports, a single bridge element may be disposed between the proximal or distal pod and the adjacent central pod, and between the two central pods. Such a single bridge support could be wider than each of the individual pair of supports 12060 and 12070 such that the width of the single bridge support generally equals the width of the pair of supports plus the gap therebetween.

The central pods 12032 and 12034 generally have greater degrees of freedom than do the proximal and distal pods. In one configuration, bridge supports 12060 and 12070 are substantially rigid. Even so, the suspension arrangement can provide a moderate amount of flexibility to the central pods. In a preferred, more flexible configuration, bridge supports 12060 and 12070 are flexible features that permit the cleaning elements extending from the central pods 12032 and 12034 to have a much larger range of motion than the cleaning elements extending from the proximal and distal pods 12010 and 12020, respectively, which are generally static or non-movable. The flexible bridge supports may be formed from a resilient material, such as a thermoplastic elastomer. Other rubber-like materials may be used, such as other thermoplastics, a thermoplastic urethane, or a thermoplastic plastomer, or any combination thereof. In one configuration, the bridge supports 12060 and 12070 are made from the thermoplastic polypropylene, which provides a robust, yet flexible, connection between the central pods and the proximal and distal pods.

In a flexible configuration, bridge supports 12060 and 12070 are resilient and allow the central pods to twist about their support axis and/or move toward frame 12004 when downward force is applied to the central pods during use of the implement. Further, the elastic nature of the bridge supports may permit the central pods to return to their original form or initial position when the force is decreased. In addition, when the oral care implement is moved in a longitudinal direction parallel to the handle 8103, the central pods can deflect longitudinally as they engage a surface to be cleaned. The deflection of the central pods in the longitudinal direction may also be due to the elastic nature of the support bridges 12060 and 12070. Such return action can create an active motion in the opposite direction of the direction of movement, which aids in the cleaning of teeth by introducing extra brushing strokes.

The distance between the proximal pod 12010 and the distal pod 12020 may be greater than the width of the each of the central pods 12032 and 12034, and in the illustrated embodiment of FIG. 19 is approximately twice the width of one of the central pods. Further, in the illustrated embodiment, the central pods 12032 and 12034 are suspended away from the frame a distance slightly less than the thickness of the central pods 12032 and 12034. The length of the support bridges 12060 and 12070 may be significantly less than the length of the central pods 12032 and 12034, and, in the configuration shown in FIGS. 19 and 20, is approximately 115 the length of the central pods. As a result, with two central pods of the configuration shown in FIGS. 19 and 20, the support bridges 12060 and 12070 span less than 25% of the total distance between the proximal and distal pods 12010 and 12020, respectively.

In addition, the configuration shown in FIGS. 19 and 20 includes a unitary assembly 12500 that includes proximal pod 12010, distal pod 12020, bridge supports 12060 and 12070 and central pods 12032 and 12034, which can be molded as a single unit from the same material. The unitary assembly 12500 may be made from an elastomeric material, such as a soft thermoplastic elastomer (TPE). Again, other rubber-like materials may be used, such as other thermoplastics (e.g., polypropylene), a thermoplastic urethane, a thermoplastic plastomer, or any combination thereof. The proximal and distal pods can be attached to protrusions (not shown) extending from the underlying head 12002, thereby providing sufficient support and strength to the proximal and distal pods.

Alternatively, these features could be formed as differentiated features, such as the proximal and distal pods being formed as unitary features along with the frame of the head, such as from a unitary plastic mold, and the central pods being formed separately from the proximal and distal pods. When formed as differentiated features, the proximal and distal pods could be formed from the same or different materials than the frame, the bridge supports and/or the central pods. For instance, the bridge supports and central pods could be made from a first thermoplastic material, and the proximal and distal pods could be formed separately from a second thermoplastic material, such as polypropylene. In such a configuration, the bridge supports and the central pods could be made as a unitary construction that is welded or adhered to the proximal and distal pods. Further, the bridge supports, the central pods, and the proximal and distal pods could be formed as a unitary member that is attached to the frame. For instance, the central pods, the proximal and distal pods, and the bridge supports could be molded as a unitary cleaning elements assembly. The cleaning elements could be attached to the pods and pod components thereafter, such as via AFT techniques. Optionally, an elastic membrane, such as membrane 13070 and 13670 shown in FIGS. 21A and 21B, could be formed around the proximal and distal pods, the central pods, and the bridge supports.

As discussed with regard to the embodiment shown in FIGS. 7 and 8, the cleaning elements 12218 mounted on the central pods can be adapted to engage a user's teeth, gums and other surfaces in a various ways that take advantage of their flexible support configuration. For instance, as shown in FIG. 19, the cleaning elements provided on the central pods can include forward elements 12090 angled toward the tip end of the head, and rearward elements 12092 angled toward the handle end. The location and orientation of these forward and rearward elements can increase the likelihood such elements will initially engage a surface to be cleaned prior to other cleaning elements on the respective pod, thereby encouraging the respective pod to flex as the remaining cleaning elements thereon engage the surface.

As further shown in FIG. 19, cleaning elements 12218 may include upstanding walls 12094, which may be elastomeric or bristle-based as discussed above. The upstanding walls can provide beneficial wiping and polishing of teeth in addition to cleaning benefits. Cleaning elements 12218 may further include a central columnar cleaning element 12270, which may include one or more bristles for penetrating oral surfaces. The columnar cleaning elements may extend beyond other cleaning elements proximate thereto on the same pod, and they may have a generally pointed tip. As such, central cleaning element 12270 can effectively penetrate and engage oral surfaces and gaps between surfaces.

The tips or terminal ends of cleaning elements 12218 may be tapered such that the suspended pods are respectively encouraged toward their adjacent proximal or distal pod 12020 and 12010, respectively, while engaging surfaces to be cleaned. Thus, during use, cleaning elements extending from central pod 12032 may generally be biased toward engagement with cleaning elements extending from proximal pod 12010, whereas cleaning elements extending from central pod 12034 may generally be biased toward engagement with cleaning elements extending from distal pod 12020. This bias can cooperate with movement of the pods imparted via engagement of angled cleaning elements with cleaning surfaces when the device is being moved. Increasing movement and the flexing of the suspended central pods 12032 and 12034 further enhances the cleaning effectiveness of the oral care implement.

Figure 21A:
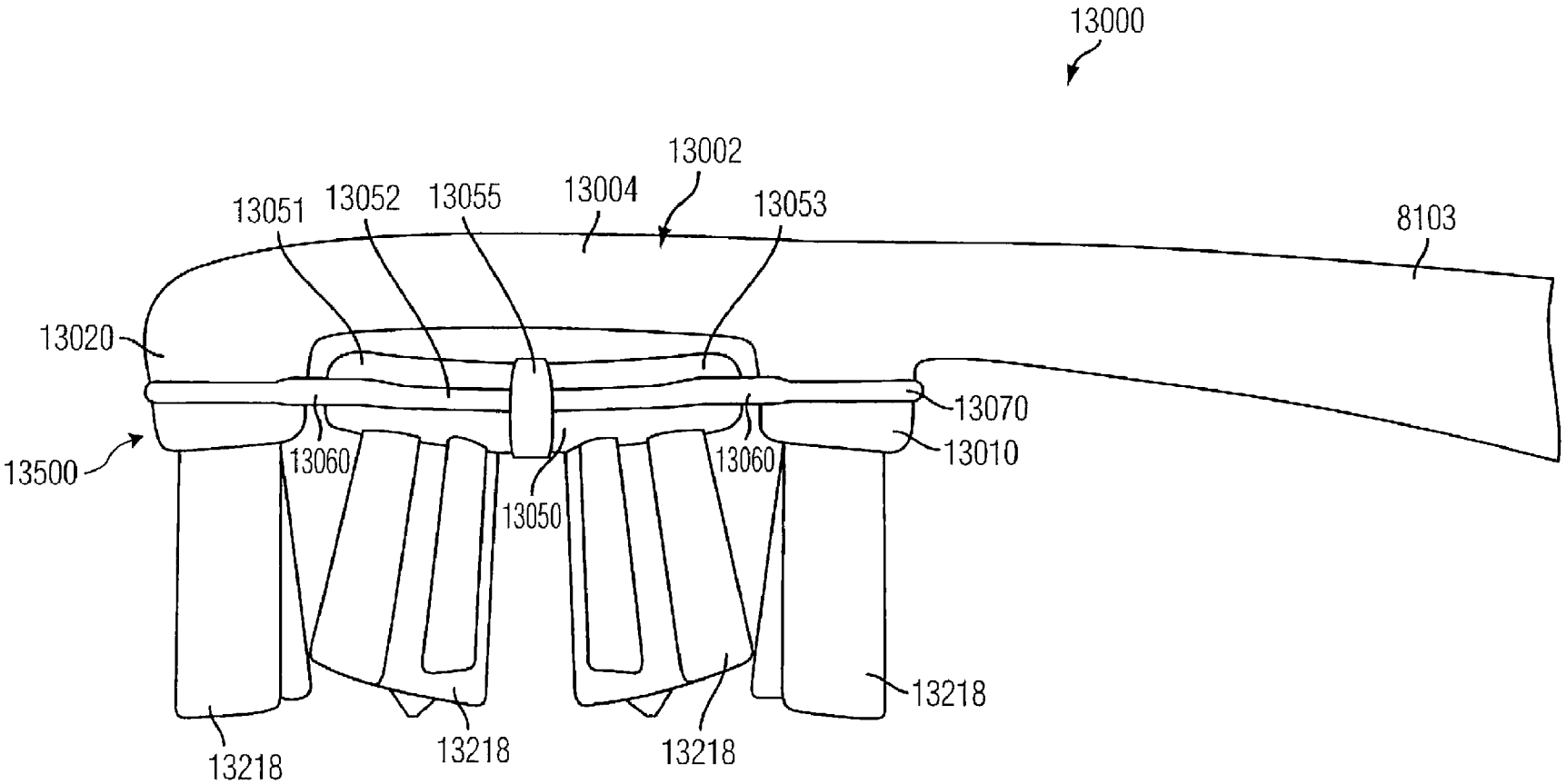
FIG. 21A is a side elevational view of a further embodiment of an oral care implement.

Referring now to FIG. 21A, a toothbrush 13000 is shown that is similar to the embodiment illustrated in FIGS. 19 and 20 and generally has the same the aspects and features, except as pertaining to its central pod and the configuration of cleaning elements 13218 and its lack of a soft tissue cleaner. Toothbrush 13000 includes a handle 8103 and a head 13002 having a combination of fixed and suspended cleaning elements. Head 13002 includes a frame 13004, proximal and distal pods 13010 and 13020, and a single central pod 13050 suspended between the proximal and distal pods. The handle 8103, head 13002 and proximal and distal pods 13010 and 13020 may be formed as a unitary construction from a thermoplastic, such as polypropylene. Further, similar to toothbrush 12000 shown in FIGS. 19 and 20, toothbrush 13000 could include a unitary cleaning elements assembly 13500 that includes proximal pod 13010, distal pod 13020, central pods 13032 and 13034, bridge supports 13060, and (optionally) membrane 13070.

As with unitary cleaning elements assembly 12500, unitary cleaning elements assembly 13500 can be formed from proximal pod 13010, distal pod 13020, central pod 13050 and bridge supports 13060, which can be molded as a single unit from the same material. Bridge supports 13060 can be formed from portions of membrane 13070 disposed between the central pod and an adjacent pod. The membrane can be formed from a thermoplastic elastomer that is molded about the proximal and distal pods and the central pod to form a unitary assembly. Optionally, bridge supports 13060 could also include reinforcing bridge supports (not shown in FIG. 21A), such as bridge supports 12060 shown in FIGS. 19 and 20, as well as the bridge supports that are formed from portions of membrane 13070. The reinforcing bridge supports can be formed from a more robust material than the membrane, such as from polypropylene. The portions of membrane 13070 can be molded around the reinforcing bridge supports to partially or completely encapsulate them within the membrane material. In such a configuration, the reinforcing bridge supports can be fairly rigid supports that reinforce the flexible connection provided by the membrane. The reinforcing bridge supports (e.g., bridge supports 12060 of FIGS. 19 and 20) can be formed via injection molding along with the central pod and the proximal and distal pods as a unitary assembly with the pods, and the membrane 13070 can be formed thereafter.

Single central pod 13050 has an elastomeric section 13055 disposed in a middle portion of the central pod. The elastomeric section is preferably made from a resilient material, such as a soft thermoplastic elastomer (TPE), while the central pod is preferably made from a more rigid material, such as polypropylene. The central pod 13050 is held in place by a molded TPE membrane 13070 that connects with the proximal and distal pods 13010 and 13020 to form bridge supports 13060. The membrane 13070 may form a loop that encompasses the pair of fixed proximal and distal pods 13010 and 13020 and attaches to opposing sides of central pod 13050. Grooves (not shown) in side portions of the proximal and distal pods, as well as the central pod, may receive membrane 13070. In addition, membrane 13070 may be attached to the pods via an adhesive and/or a melt bond.

Membrane 13070 allows the central pod 13050 to move toward frame 13004 when sufficient force is applied during a cleaning operation. When such force is applied to the central pod, opposite halves 13051 and 13053 of the central pod will also flex about the elastomeric section 13055. As a result, the two sets of cleaning elements 13218 extending from either end of the central pod 13050 can rotate toward one another. The central pod 13050 can flex back to its original position when the force on the central pod moving it toward the head 13002 diminishes.

Cleaning elements 13218 extending from central pod 13050 are generally centrally-tapered, which is generally an opposite orientation to the configuration of cleaning elements shown in FIGS. 10 and 11 and FIGS. 19 and 20. The central taper encourages cleaning elements 13218 to penetrate interproximal spaces of the user's teeth while applying moderate force to toothbrush 13000 against their teeth. When the user applies more excessive force to the toothbrush, central pod 13050 moves into contact with frame 13004 and causes the central pod to bend about elastomeric section 13055 and further engage the interproximal space to which the cleaning elements are applied.

Figure 21B:
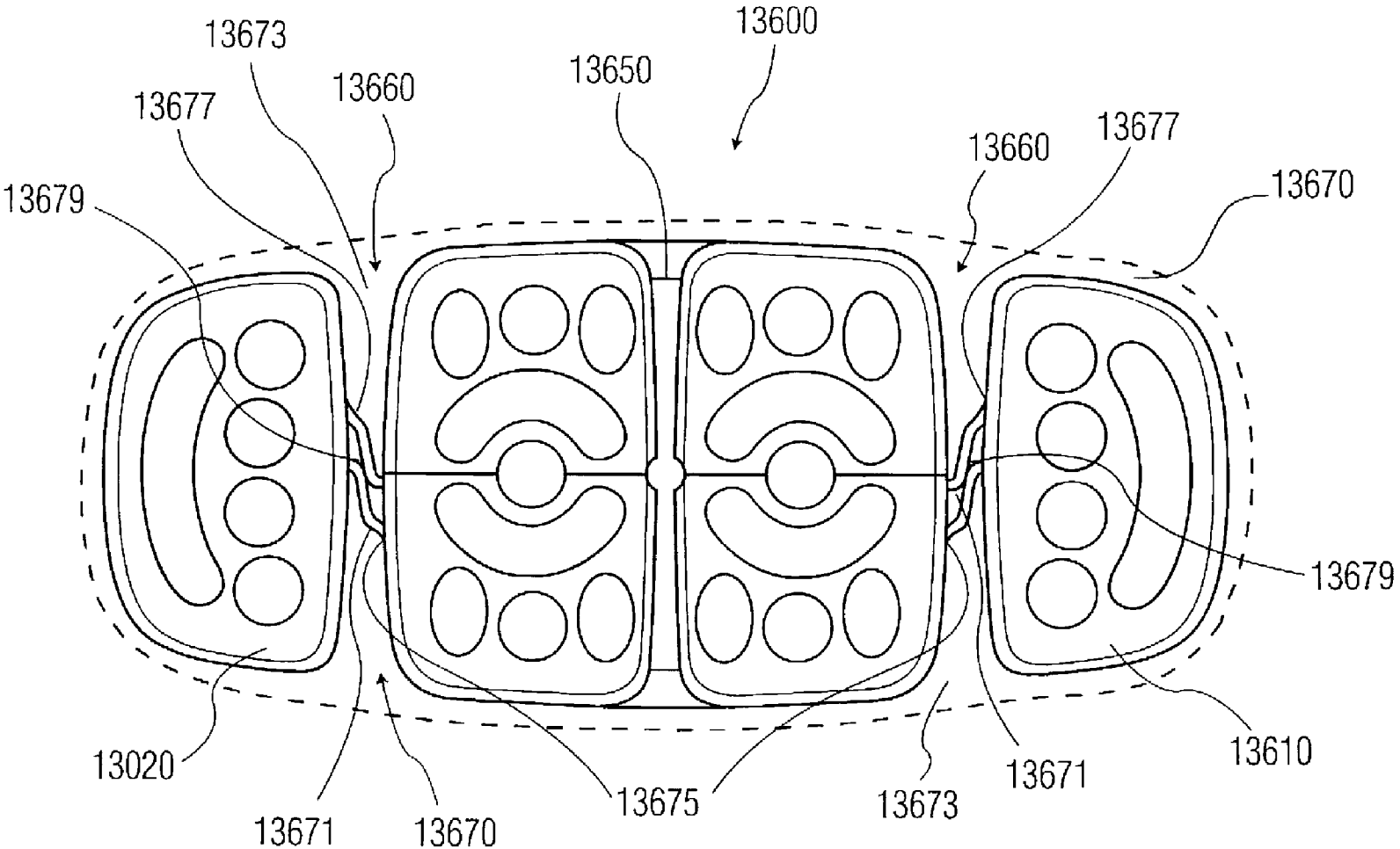
FIG. 21B is a top view of a unitary cleaning elements assembly of an oral care implement.

FIG. 21B shows an optional unitary cleaning elements assembly 13600 that could be used with toothbrush 13000 instead of unitary cleaning elements assembly 13500. Cleaning elements unitary assembly 13600 generally includes the aspects and preferences of cleaning elements 13500, except with respect to reinforcement connectors 13671 and as discussed hereafter. As shown, unitary cleaning elements assembly 13600 includes proximal pod 13610, distal pod 13620, bridge supports 13660, central pod 13650, and membrane 13670 (shown in broken line). Cleaning elements assembly 13600 differs from unitary assembly 13500 in that its bridge supports 13660 include reinforcement connectors 13671 having an offset configuration, as well as portions 13673 of membrane 13670 that are disposed between adjacent pods.

As shown in FIG. 21B, reinforcement connectors 13671 connect central pod 13650 to adjacent pods 13610 and 13620 in an offset configuration. In such a configuration, the connection points 13675 between the movable central pod and each reinforcement connector is laterally offset with respect to the toothbrush head from corresponding connection points 13677, which are disposed between the fixed pods 13610 and 13620 and the reinforcement connectors. As shown in the configuration of FIG. 21B, connection points 13675 and 13677 can have greater cross-sections than the intermediate or neck portion 13679 of each connector, which can encourage the reinforcement connectors to flex primarily at their neck portions during use. An offset reinforcement connector can provide a sturdy connection between the movable central pod and the fixed pods while providing flexibility in the desired up and down directions relative to the head platform or frame. This can be due, at least in part, by the neck portions 13679 acting as torsional living hinges that are twisted as the movable central pod moves toward and away from the head platform. Lateral movement of the central pod toward and away from the fixed pods can be limited via interference between the relatively thick connection points 13677, 13679 and the adjacent pod. A desired amount of connector flexibility can be provided based on selected thickness of the neck and the type of connector material. In one configuration, the offset reinforcement connector can be made from a relatively stiff, but flexible, material, such as polypropylene or high density polyethylene. Further, the offset reinforcement connectors 13671 can be made from the same material as the proximal pod 13610, distal pod 13620, bridge supports 13660 and central pod 13650, which can be molded as a single unit.

Figure 22A:
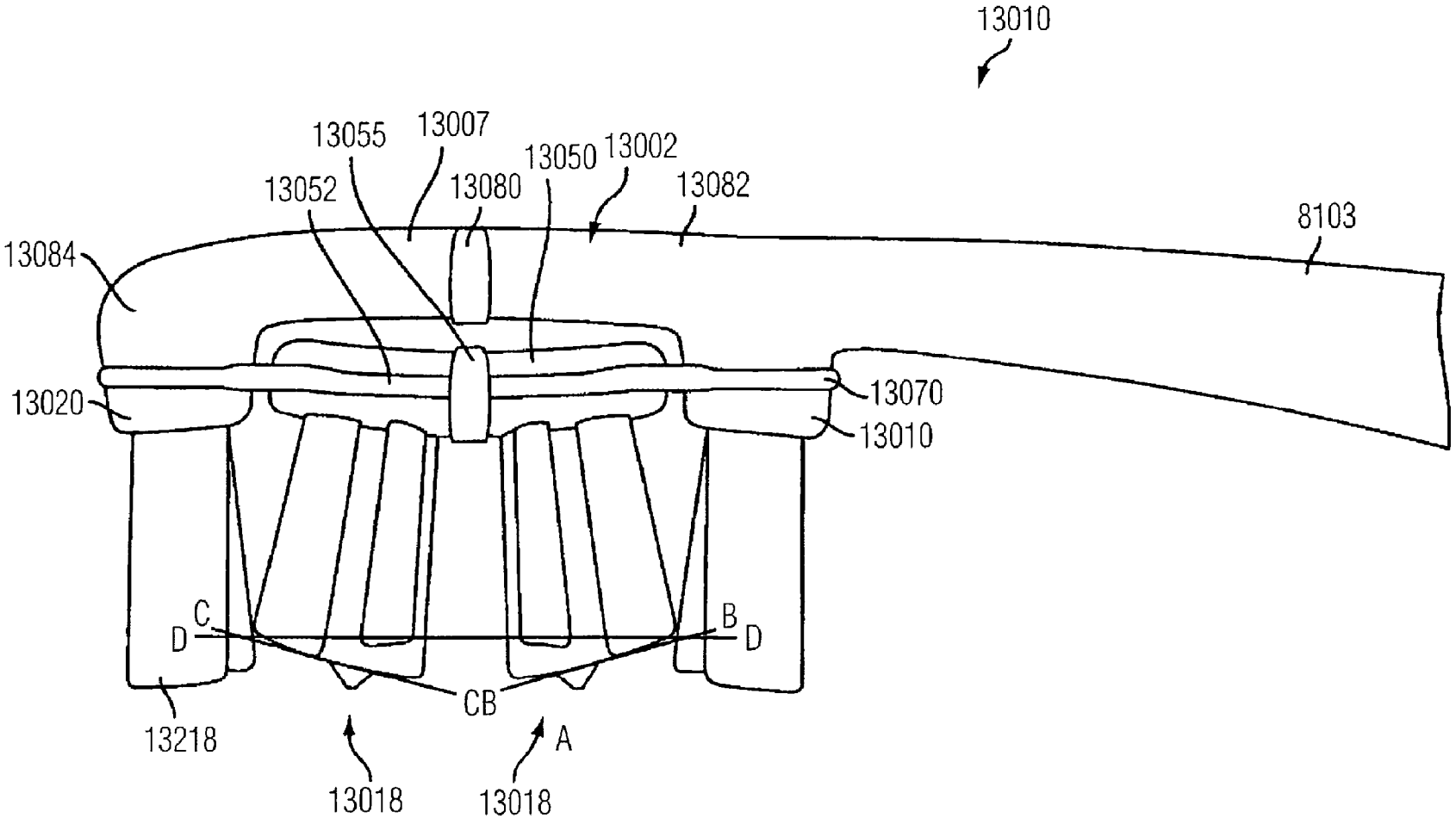
FIG. 22A is a side elevational view of another embodiment of an oral care implement.
Figure 22B:
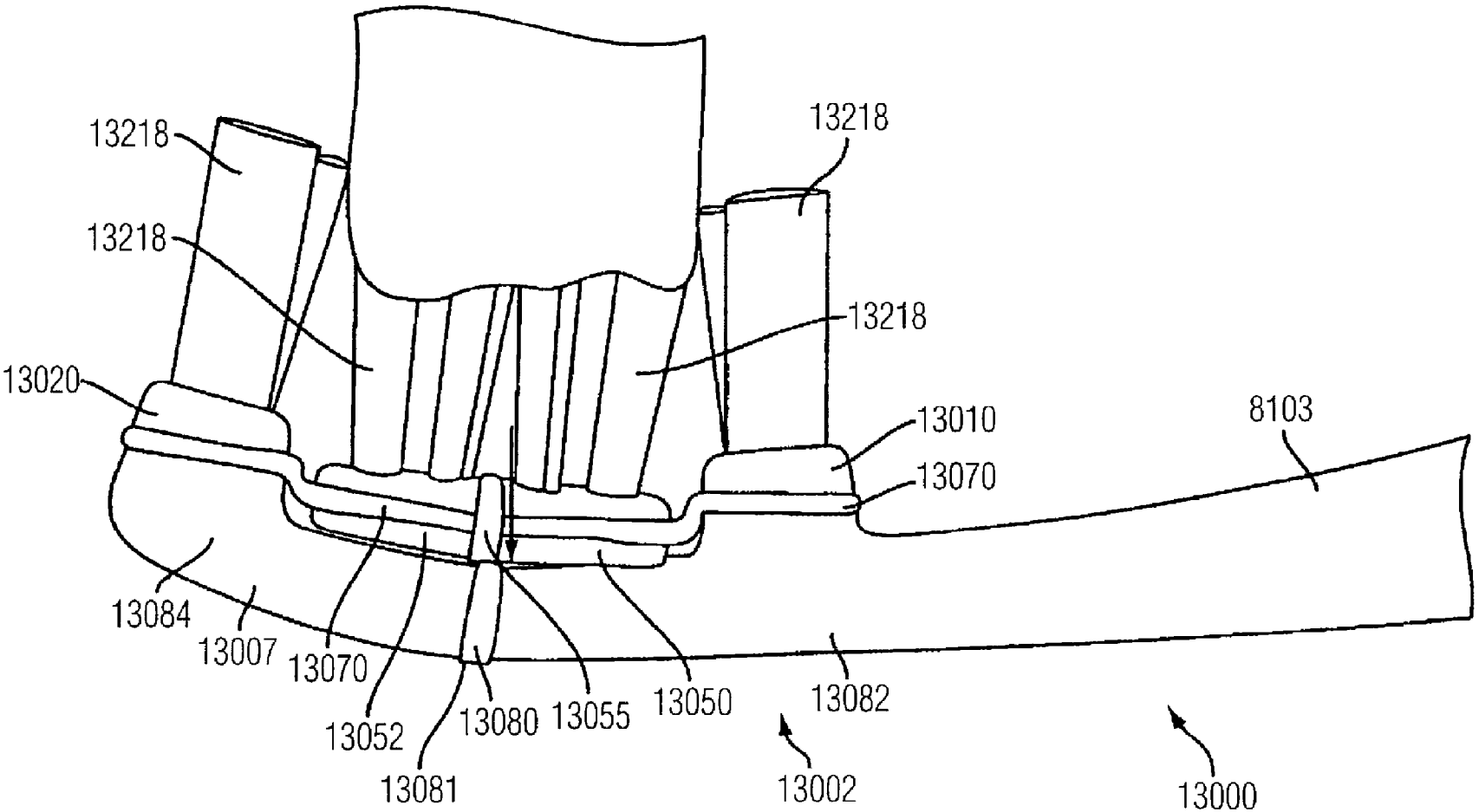
FIG. 22B shows the oral care implement of FIG. 22A while engaging a tooth.

Referring now to FIGS. 22A and 22B, a toothbrush 13010 is shown that is similar to the embodiment illustrated in FIG. 21A and generally has the same the aspects and features as toothbrush 13000, except as pertaining to its frame. As shown, frame 13007 includes a resilient hinge element 13080 located in a central portion of the frame and traversing its width. The hinge element may be formed from a TPE or other resilient material that is more flexible than other portions of the frame. The hinge element may also include a reduced thickness region of the frame about which a TPE or other resilient material is disposed. For instance, a proximal portion 13082 of the frame and a distal portion 13084 of the frame may be formed from a relatively rigid material, such as a polypropylene material, and may include a thin neck region (not shown) disposed therebetween. The neck region may permit the proximal and distal portion of the frame to rotate with respect to each other. A resilient material 13081 may surround the neck to dampen rotation about the neck. The resilient material may be adhered to the frame via an adhesive bond, a melt bond or other attachment mechanism, such as a compression fit about the neck.

Hinge element 13080 permits proximal and distal portions 13082 and 13084 respectively of frame 13004 to rotate with respect to one another during use. Thus, head 13010 can generally curl or bend around a surface to be cleaned, such as a user's tooth as illustrated in FIG. 22B. In addition, hinge element 13080 can simply improve the overall flexibility of the head for adapting to a variety of cleaning-features, orientations of use, and applied forces. For instance, as shown in FIG. 22B, hinge element 13080 can permit frame 13007 to flex like a bow. In another example (not shown), hinge element 13080 can permit the tip portion of the head to be flexed rearward, which will encourage central pod 13050 to move away from the frame as the bridge supports are stretched taut.

Figure 23A:
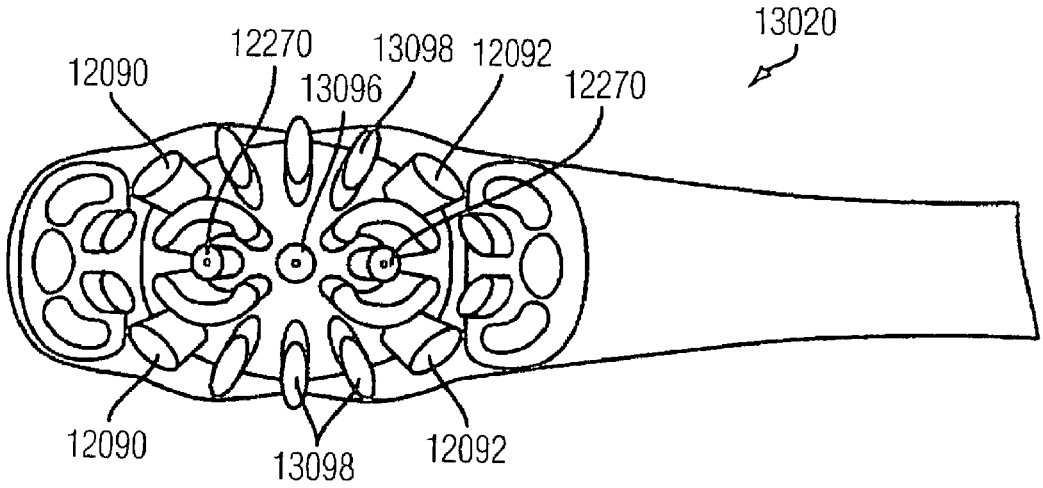
FIG. 23A is a top view of an oral care implement according to another embodiment of the invention.
Figure 23B:
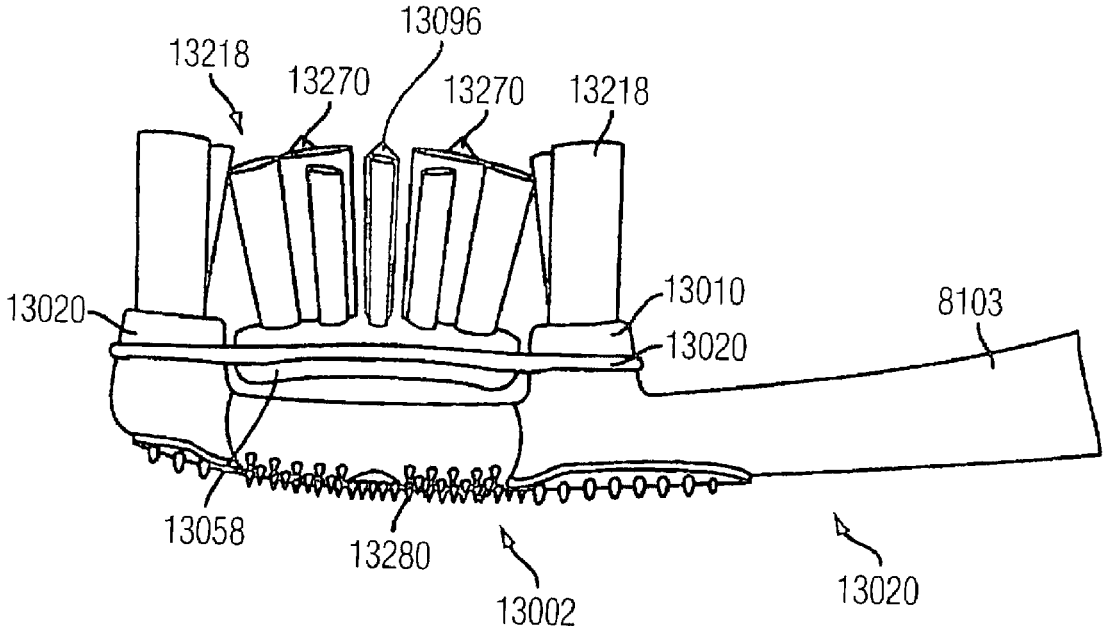
FIG. 23B is a side elevational view of the oral care implement of FIG. 23A.

Referring now to FIGS. 23A and 23B, an oral care implement 13020 is shown that is similar to the embodiment illustrated in FIG. 21A and generally has the same the aspects and features as toothbrush 13000, except as pertaining to its central pod, the arrangement of cleaning elements 13218, and the existence of a soft tissue cleaner 13280 disposed on a rear side of its head that is opposite to the front side. The soft tissue cleaner 13280 is generally the same as soft tissue cleaners 10280 and 12280 of FIGS. 10-13 and 19-20 respectively. However, various soft tissue cleaner configurations may be used, such as the soft tissue cleaners of FIGS. 14-18. Toothbrush 13020 includes a central pod 13058 that is substantially unitary and lacks elastomeric section 13055 of toothbrush 13000. Thus, the central pod can provide relatively firm engagement of oral features to be cleaned via the larger rigid central pod, while retaining benefits provided via its suspended configuration. As such, central pod can adapt to the cleaning forces applied to the head by moving fore, aft, sideways and/or downward with respect to the frame. However, its relatively large, rigid size can provide uniform orientation to a large number of cleaning members 13218 attached thereto.

Cleaning elements 13218 extending from the central pod are similar to the cleaning elements 12218 of toothbrush 12000 and generally include the same configuration, aspects and features as cleaning elements 12218 shown in FIG. 19. However, as central pod 13058 is a single pod that spans about the same distance as central pods 12032 and 12034 of toothbrush 12000 in FIG. 19, central pod 13058 includes additional cleaning elements in its central region. As shown in FIG. 23A, a central columnar cleaning element 13096 is located at a central portion of the central pod, which is similar to columnar cleaning elements 12270 of toothbrush 12000. Columnar cleaning element 13096 cooperates with columnar cleaning elements 12270 to effectively penetrate and engage oral surfaces and gaps between surfaces and to transmit downward force to the central pod when excessive cleaning force is applied to the cleaning elements. In addition, several radial cleaning elements 13098 extend from the central columnar cleaning element 13096 in a generally spoke-like configuration at a central region of the central pod. Radial cleaning elements engage features to be cleaned throughout a central portion of the pod, which provide a perimeter structure at side portions of the central pod. The perimeter structure enhances engagement of oral features to be cleaned and can assist with retaining dentifrice within the cleaning elements of the central pod during use.

Figure 24A:
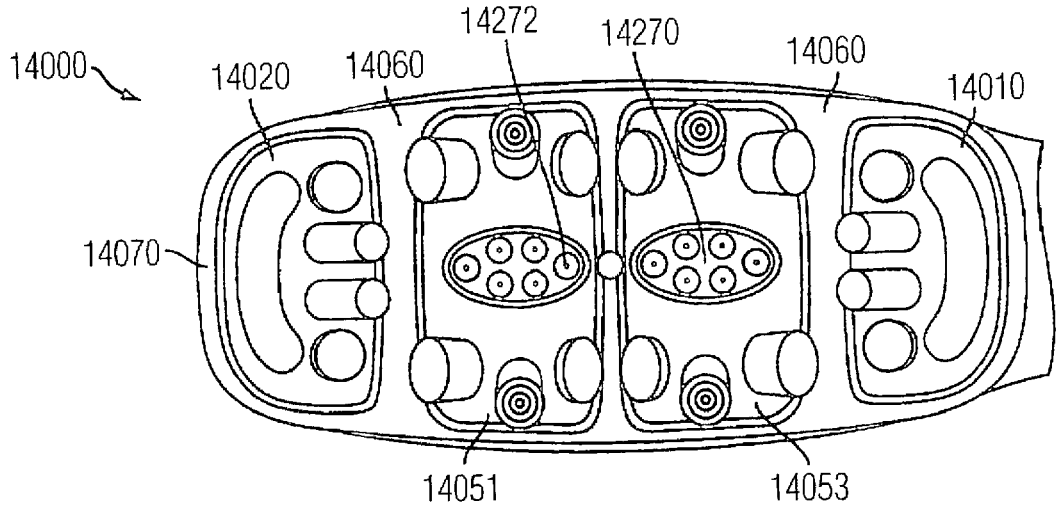
FIG. 24A is a top view of an oral care implement according to another embodiment of the invention.
Figure 24B:
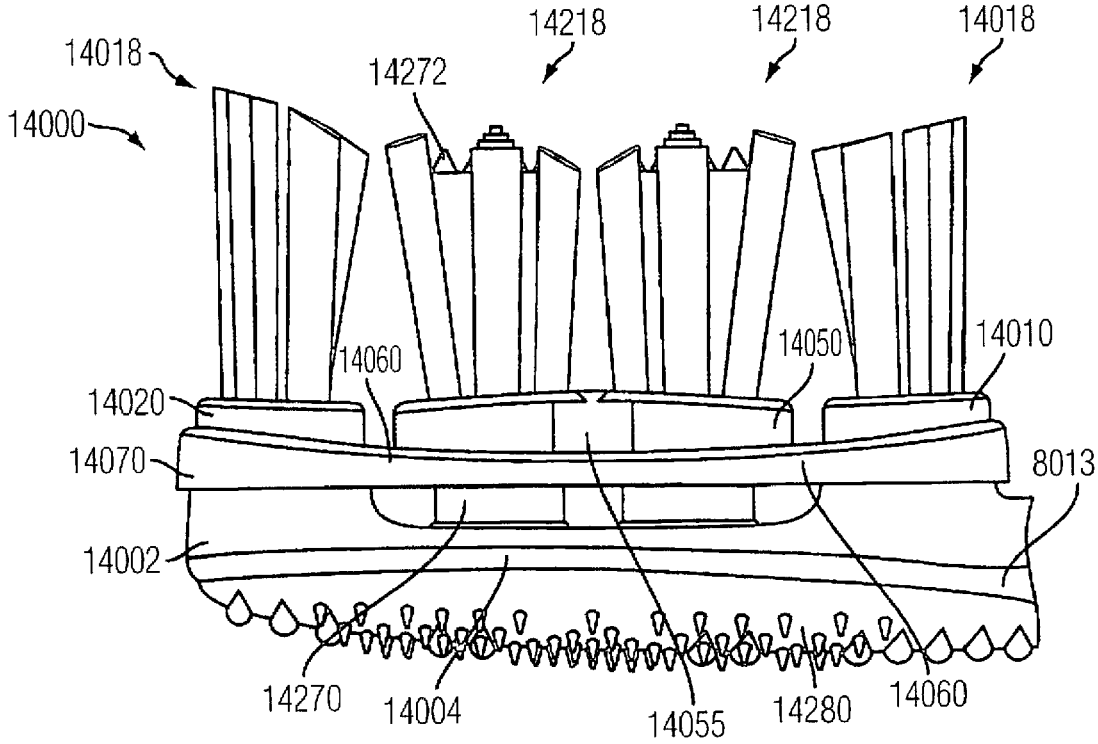
FIG. 24B is a side elevational view of the oral care implement of FIG. 24A.
Figure 25A:
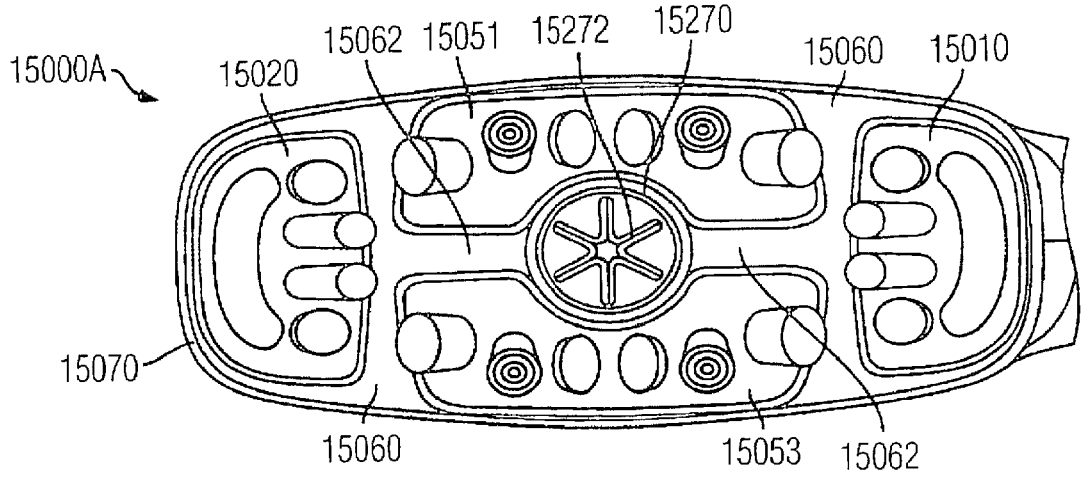
FIG. 25A is a top view of a head of an oral care implement according to another embodiment of the invention.
Figure 25B:
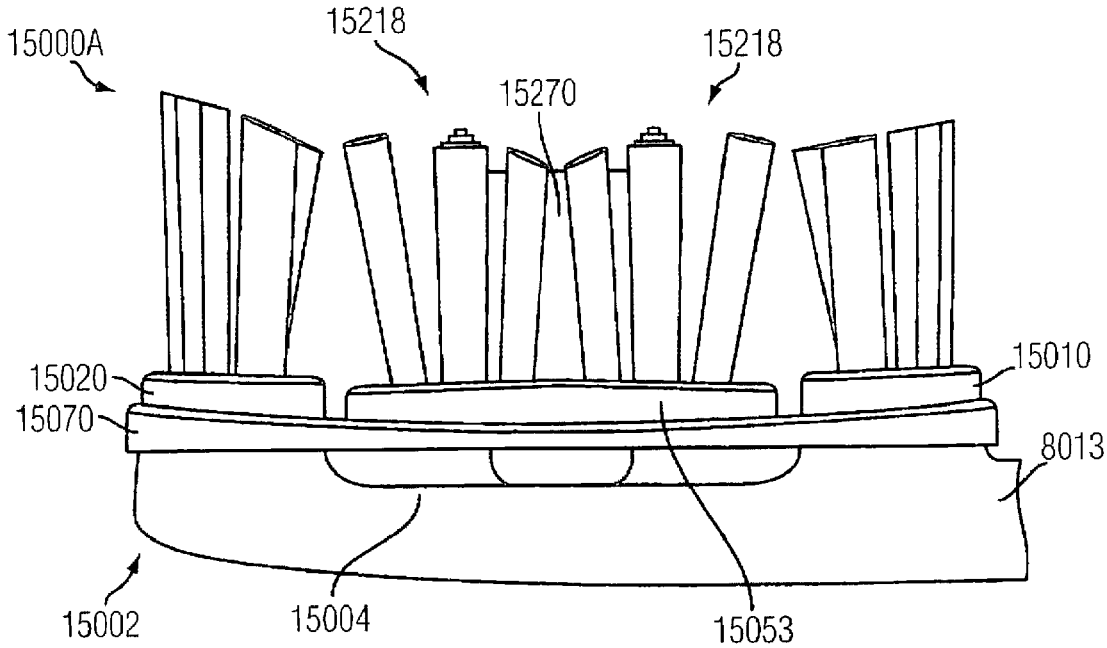
FIG. 25B is a side elevational view of the oral care implement of FIG. 25A.
Figure 25C:
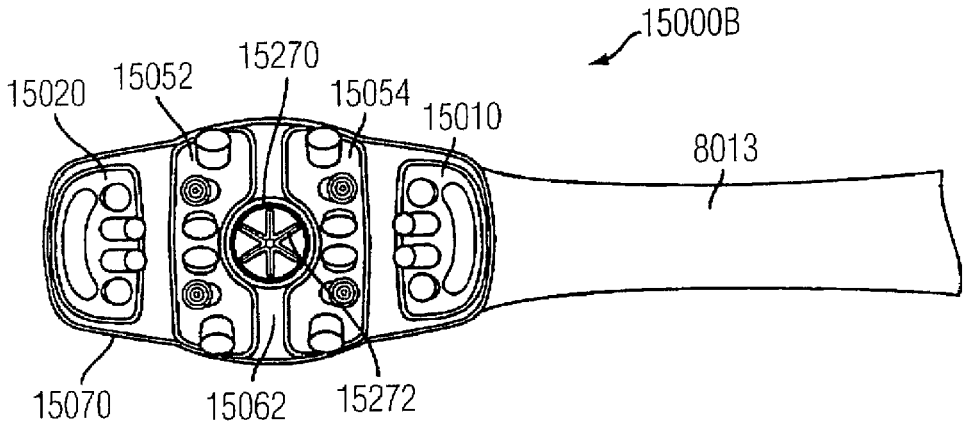
FIG. 25C is a top view of a head of an oral care implement according to another embodiment of the invention.
Figure 25D:
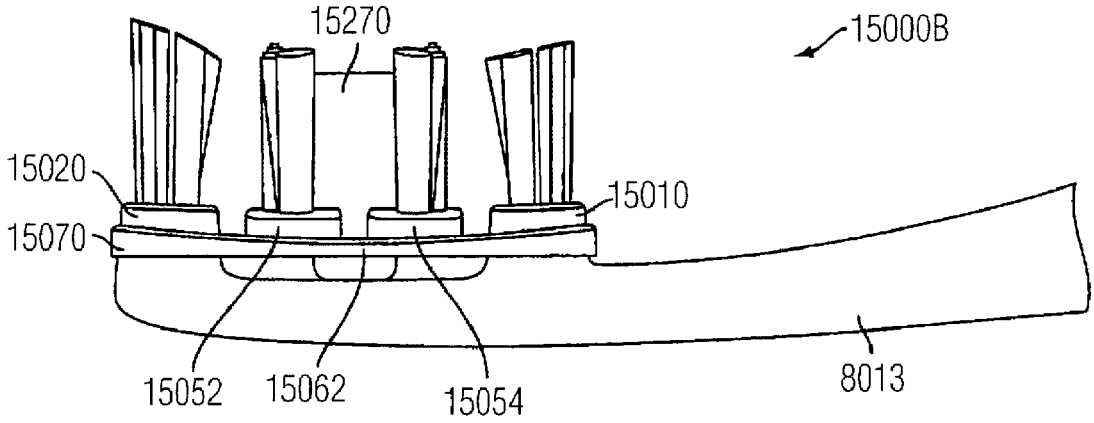
FIG. 25D is a side elevational view of the oral care implement of FIG. 25C.
Figure 25E:
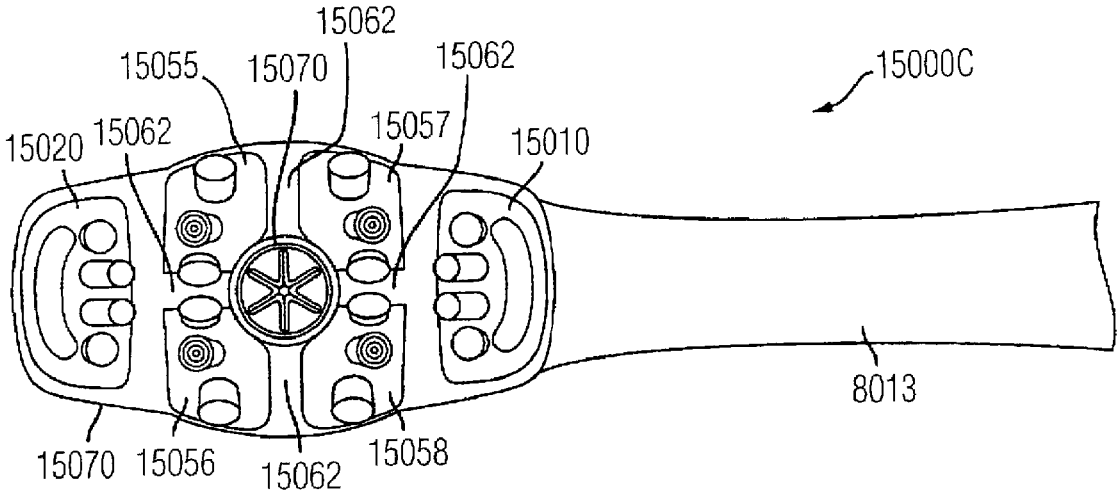
FIG. 25E is a top view of a head of an oral care implement according to another embodiment of the invention.

Referring now to FIGS. 24A and 24B, a toothbrush 14000 is shown that is similar to the embodiment illustrated in FIG. 21A and comprises a handle 8 103 and a head 14002 having a combination of fixed and suspended cleaning elements. Head 14002 includes a frame 14004, proximal and distal pods 14010 and 14020 having cleaning elements 14018, and a single central pod 14050 suspended between the proximal and distal pods. The handle 8103, head 14002 and proximal and distal pods 14010 and 14020 may be formed as a unitary construction from a thermoplastic, such as polypropylene. A soft tissue cleaner 14280 is generally the same as soft tissue cleaners 10280 and 12280 of FIGS. 10-13 and 19-20 respectively. However, various soft tissue cleaner configurations may be used, such as the soft tissue cleaners of FIGS. 14-18.

Central pod 14050 has an elastomeric section 14055 disposed in a middle portion of the central pod, or more particularly between a pair of pod segments. The elastomeric section is preferably made from a resilient material, such as a soft thermoplastic elastomer (TPE), while the central pod is preferably made from more rigid material, such as polypropylene. The central pod 14050 is held in place by a molded TPE membrane 14070 that connects with the proximal and distal pods 14010 and 14020 to form bridge supports 14060. The membrane 14070 may form a loop that encompasses the pair of fixed proximal and distal pods 14010 and 14020 and attaches to opposing sides of central pod 14050. Grooves (not shown) in side portions of the proximal and distal pods, as well as the central pod, may receive membrane 14070. In addition, membrane 14070 may be attached to the pods via an adhesive and/or a melt bond, for example.

The cleaning elements 14218 on the central pod 14050 are similar to the configuration of the cleaning elements shown in FIGS. 19 and 20, with the exception of a plurality of central, flexible cleaning elements 14270 extending from the frame 14004 and protruding through one or more openings (not shown) in the central pod 14050. Cleaning element 14270 further comprises massaging and/or polishing elements 14272 on its upper surface. While two cleaning elements 14270 are shown, it will be appreciated that only one, or more than two cleaning elements 14270 may be used as desired. Cleaning element 14270 may be attached to the frame 14004, or extend through the frame 14004 from the soft tissue cleaner 14280 on the opposite side of the head 14002. If the latter, the cleaning element 14270 may be molded simultaneously with the soft tissue cleaner 14280. In either case, a unitary structure defined by the membrane 14070 carrying pods 14010, 14020 and 14050, could be assembled to the base 14004 over the cleaning element(s) 14270. Other methods of construction are contemplated.

Membrane 14070 allows the central pod 14050 and cleaning elements 14218 to move toward frame 14004, guided by the cleaning elements 14270, when sufficient force is applied during a cleaning operation. Such movement provides additional functionality not described before. One such functionality is a tooth polisher in the middle of the head that is surrounded by fixed and movable cleaning elements 14018, 14218 respectively. In addition, the cleaning element 14270 includes massaging and/or polishing elements 14272 that are at a fixed height relative to the head 14004, yet are surrounded by cleaning elements 14218 that recede toward the head 14004 under brushing pressure, enabling the cleaning elements 14272 to be more efficacious during brushing.

When brushing pressure force is applied to the central pod 14050, segments 14051 and 14053 of the central pod 14050, as well as the cleaning elements 14270, will flex about the elastomeric section 14055. As a result, the cleaning elements 14218 extending from either end of the central pod 14050, as well as the cleaning elements 14270, can rotate toward one another. The central pod 14050 can flex back to its original position when the force on the central pod moving it toward the head 14002 diminishes.

Referring now to FIGS. 25A-25E, a toothbrush 15000A-C is shown that is similar to the embodiment illustrated in FIGS. 23A and 23B and comprises a handle 8103 and a head 15002 having a combination of fixed and suspended cleaning elements. Head 15002 includes a frame 15004, proximal and distal pods 15010 and 15020 having cleaning elements 15018, and a central pod 15050 defined by pod segments 15051-15054 (embodiments of FIGS. 25A through 25D) or pod segments 15055 through 15058 (embodiment of FIG. 25E) suspended between the proximal and distal pods. The handle 8103, head 15002 and proximal and distal pods 15010 and 15020 may be formed as a unitary construction from a thermoplastic, such as polypropylene.

The central pod segments 15051-15058 are held in place by a molded TPE membrane 15070 that connects with the proximal and distal pods 15010 and 15020 to form bridge supports 15060. The membrane 15070 may form a loop that encompasses the pair of fixed proximal and distal pods 15010 and 15020 and central pod segments 15051-15058, which segments may be separated by a flexible gap 15062 along the longitudinal axis (embodiment of FIGS. 25A and 25B) or lateral axis (embodiment of FIGS. 25C and 25D) of the head 15002. Alternatively, segments 15055-15058 of the embodiment of FIG. 25E may be separated by a flexible gap 15062 along both the longitudinal and lateral axes of the head. Grooves (not shown) in the pods may receive membrane 15070. In addition, membrane 15070 may be attached to the pods via an adhesive and/or a melt bond, for example.

The cleaning elements 15218 on the central pod segments are similar to the configuration of the cleaning elements shown in FIGS. 23A and 23B, with the exception of a central cleaning element 15270 having polishing ridges 15272 along its upper surface that protrudes through an opening (not shown) in the membrane 15070. Such cleaning element 15270 functions in a similar manner as cleaning element 14270 of FIGS. 24A and 24B, relative to the membrane 15070 and the central pod segments 15051, 15053 of FIGS. 25A and 25B. However, because the central pod segments 15051, 15053 are separated along the longitudinal axis of the head 15002 by a gap 15062, such segments 15051, 15053 will tend to rotate away from the protruding cleaning element 15270, or rotate around the cleaning element 15270, under brushing pressure, thereby simulating the movement of a bird's wings, resulting in increased efficacy and interproximal penetration. A similar movement is experienced along the transverse axis with segments 15052, 15054 of FIGS. 24C and 24D, and an even more extensive movement is experienced along the longitudinal and transverse axes with segments 15055-15058 of FIG. 25E. Thus, cleaning element 15270 provides a central pivot around which pod segments 15051-15058 can move.

Cleaning element 15270 may be attached to the frame 15004, or extend through the frame 15004 from a soft tissue cleaner (not shown) on the opposite side of the head 15002. If the latter, the cleaning element 15270 may be molded simultaneously with the soft tissue cleaner. In either case, a unitary structure defined by the membrane 15070 carrying pods 15010, 15020 and central pod 15050 segments 15051-15058, could be assembled to the base 15004 over the cleaning element 15270. Other methods of construction are contemplated.

Figure 26:
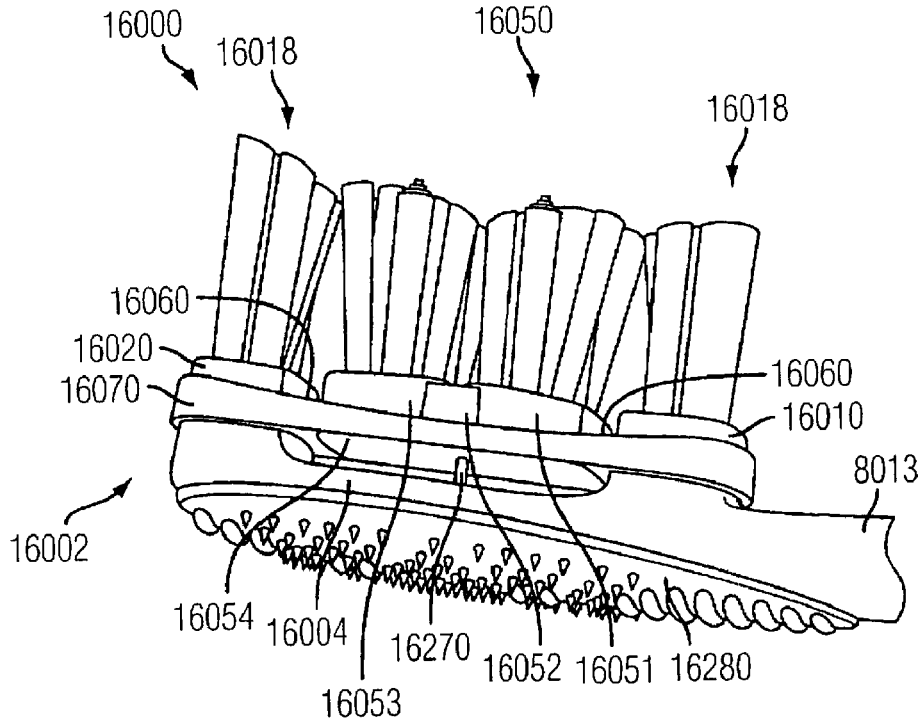
FIG. 26 is a bottom perspective view of a head of an oral care implement according to another embodiment of the invention.
Figure 27:
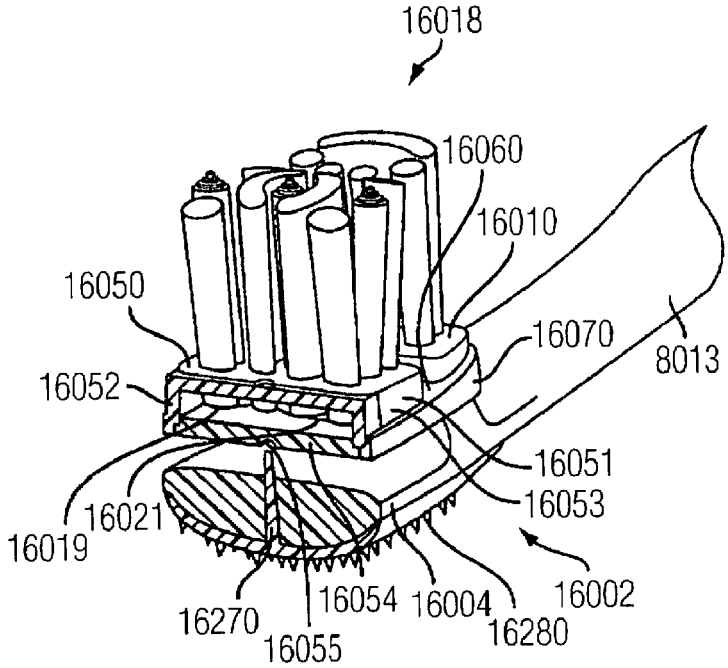
FIG. 27 is a cross-sectional view of the oral care implement of FIG. 26.

Referring now to FIGS. 26 and 27, a toothbrush 16000 comprises a handle 8103 and a head 16002 having a combination of fixed and suspended cleaning elements. Head 16002 includes a frame 16004, proximal and distal pods 16010 and 16020 having cleaning elements 16018, and a central pod 16050 defined by pod segments 16051 and 16053 suspended between the proximal and distal pods. The handle 8103, head 16002 and proximal and distal pods 16010 and 16020 may be formed as a unitary construction from a thermoplastic, such as polypropylene.

The central pod segments 16051 and 16053 may be separated by a bridge 16052 that is preferably flexible and formed from the same material as a molded TPE membrane 16070 that connects with the proximal and distal pods 16010 and 16020 to form bridge supports 16060. The membrane 16070 may form a loop that encompasses the pair of fixed proximal and distal pods 16010 and 16020 and central pod 16050 including segments 16051 and 16053, which segments may be separated by a flexible gap 16062 along the lateral axis of the head 16002 and/or along the longitudinal axis as shown in other embodiments (see, for example, FIGS. 25A-25E). Grooves (not shown) in the pods may receive membrane 16070. In addition, membrane 16070 may be attached to the pods via an adhesive and/or a melt bond, for example.

Proximal and distal pods 16010 and 16020 may be integral with the head frame 16004, such that the membrane extends around the central portion of such pods, or the pods may terminate at the edge of the membrane 16070 (see the bottom of pod 16050 in FIG. 27) and be attachable to the head frame 16004 by ultrasonic welding, adhesive or the like. Accordingly, membrane 16070 may serve as an outer frame to a plate of cleaning elements included on pods 16010, 16020 and 16050, which plate may be attachable as a single unit to the head frame 16004. Thus, the pods 16010, 16020 and 16050 may be assembled and manipulated as a single unit and attachable to the head frame 16004 as a single unit at the proximal and distal ends of the head frame 16004.

FIG. 27 illustrates the construction of a portion of pod 16050, and more specifically a portion of pod 16051, wherein the bottoms 16019 of cleaning elements 16018 are melted to form a mat 16021, which mat 16021 is captured between a pod housing 16053 and floor 16054. The mat 16021 prevents the cleaning elements 16018 from passing through the tuft holes in the pod housing 16053. The floor 16054, for example, could be adhered or welded to the housing 16053, with the floor 16054 being at least partially surrounded by the membrane 16070. Thus, the cleaning elements 16018 in this embodiment are captured and secured within the pod housing 16053 and floor 16054 in a manner known as anchor-free tufting (AFT), but such cleaning elements are not rigidly and securely fixed to any particular support structure in the manner of a stapled tuft secured within a tuft hole.

The cleaning elements 16018 on the proximal and distal pods 16010 and 16020 may be supported using an AFT process as described above, wherein they would be captured between the respective pod housing and the head frame, or they may be anchored to the pods 16010, 16020 if such pods constitute integral extensions of the head frame 16004. If they are provided using an AFT process, the connection between the pod housing and the head frame would constitute an edge connection, with the pod housing being welded, for example, to the head frame along the periphery of the pod housing to allow for the mat of melted bristle ends to reside between the pod housing and the head frame.

When brushing with the toothbrush of, for example, FIGS. 22A-22B, that has a toothbrush head that is comprised of several areas with affixed cleaning elements (proximal and distal ends) interconnected with a flexible, central rubber-like field, the central area can bottom and touch the head frame below in an uncontrollable fashion (see FIG. 22B). As a result there may be a clanking noise, a significant "slippage/stretching" of the central portion of the flexible field with an imbedded block(s) of cleaning elements that may cause a damage either to the structure or to the user. By incorporating supports that protrude upwards from the brush head, the flexible field's movements can be controlled with an intent to enable the flexible field to move in a particular fashion relative to the brush head.

Figure 28:
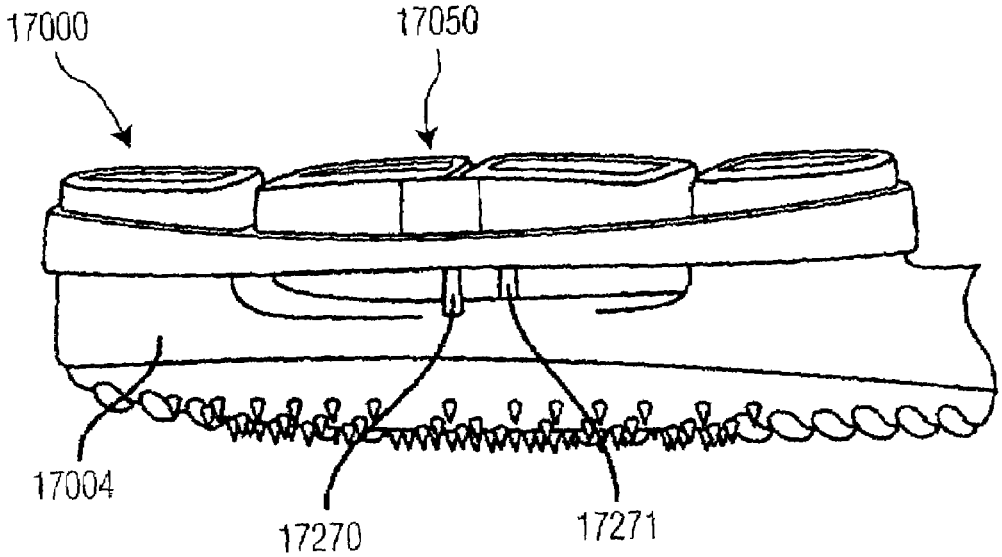
FIG. 28 is a side elevational view of the oral care implement according to another embodiment of the invention.
Figure 29:
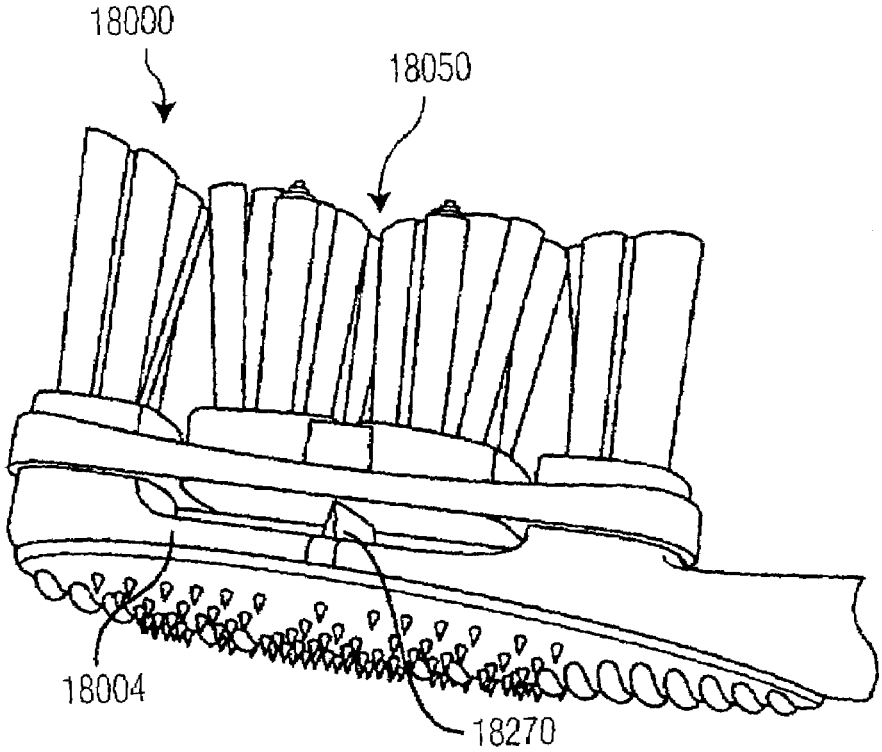
FIG. 29 is a bottom perspective view of a head of an oral care implement according to another embodiment of the invention.

FIGS. 26 and 27 illustrate one example of a single, central protrusion 16270 extending from a soft tissue cleaner 16280 on the back of the head 16002 to a depression or notch 16055 provided in the floor 16054 of the tuft block 16050. Such protrusion 16270 is preferably formed or unitarily molded together with the soft tissue cleaner 16280 of a flexible material, although it does not have to be, and provides a pivot point for pod 16050. This enables pod 16050 to move in a controlled fashion relative to the head frame 16004. Depending on the flexibility of the protrusion 16270, pod 16050 may also be capable of normal movement or movement toward the head frame 16004 (again, see FIG. 22B for example). Alternatively, the protrusion 16270 may be rigid and extend from the head frame 16004 to provide a rigid pivot point that resists normal movement of the pod 16050 toward the head frame 16004. Or course, while a single, central protrusion 16270 is illustrated in FIGS. 26 and 27, the number and type of protrusions or supports may vary as shown in, but not limited to, FIG. 28 (multiple supports 17270 and 17271 extending between head frame 17004 and central pod 17050) and FIG. 29 (transverse bar support 18270 extending from the head frame 18004 along the transverse axis of the central pod 18050 of toothbrush 18000, making line contact with the central pod 18050). Each of the embodiments of FIGS. 26-29 enables unique movement of the flexible pod relative to the head frame, with the structure illustrated in FIGS. 26-27 enabling at least a 360 degree pivot, the structure illustrated in FIG. 28 enabling a more restrictive pivoting movement, and the structure illustrated in FIG. 29 enabling a rocking movement over protrusion 18270.

Figure 30:
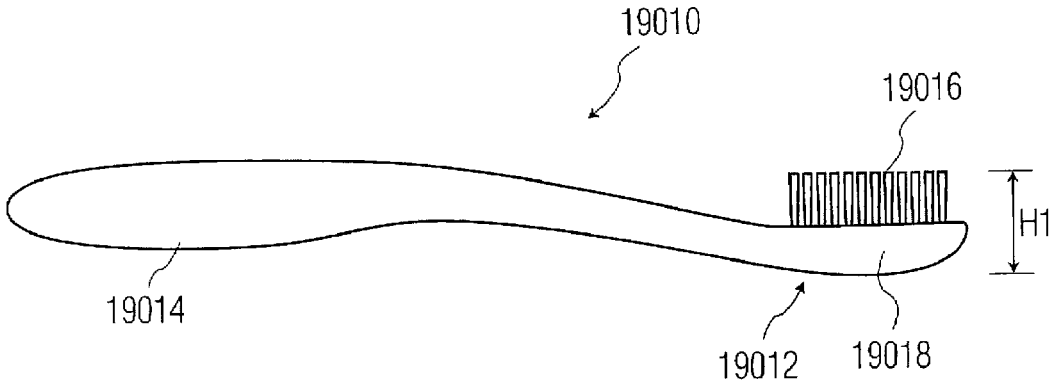
FIG. 30 PRIOR ART
FIGS. 30 and 31 are side views of toothbrushes known in the art.
Figure 33:
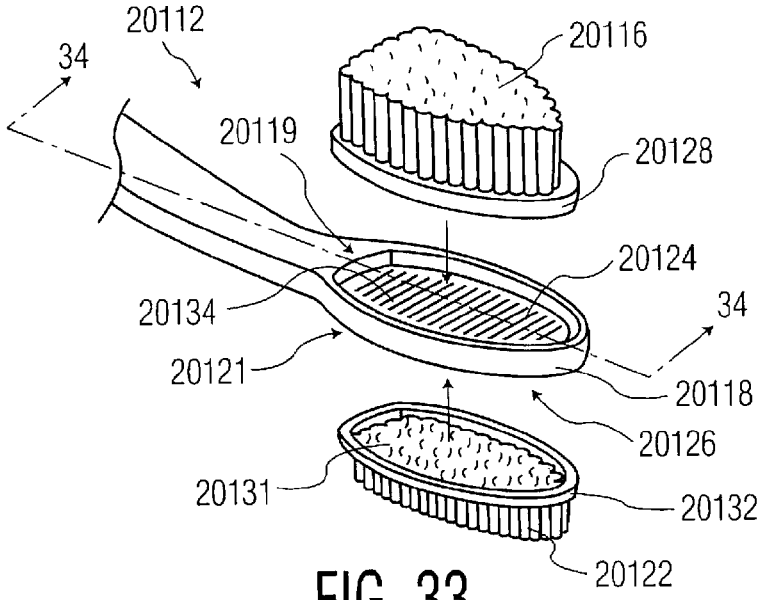
FIG. 33 is an exploded perspective view of the oral care implement head of FIG. 32.

FIG. 33 schematically illustrates a head 20112 of an oral care implement 20110, which may be placed on the handle of a conventional toothbrush, such as handle 19014 of conventional toothbrush 19010 shown in FIG. 30. Head 20112 generally includes a head platform 20118 having a first face 20119, a second face 20121, a first set of cleaning elements 20116 and a second set of cleaning elements 20122. The first set of cleaning elements extends outwardly from the first face and the second set of cleaning elements extends outwardly from the second face.

Figure 32:
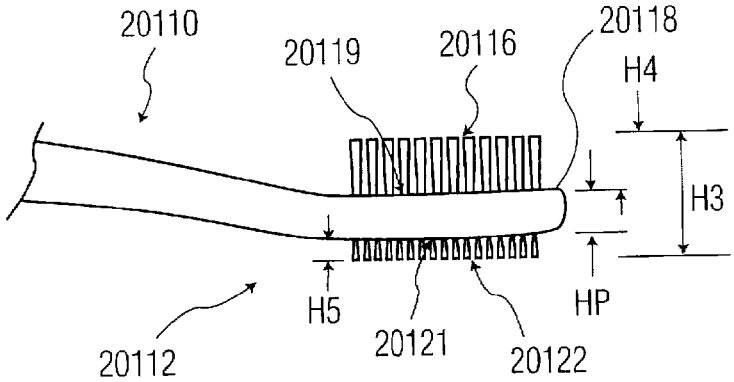
FIG. 32 is a side view of a head portion of an oral care implement configuration according to one or more aspects of an illustrative embodiment.

In the configuration shown in FIG. 32, head platform 20118 includes only two faces from which cleaning elements extend. It is understood that the head platform could include more than two faces from which cleaning elements extend. Further, it is understood that the faces having cleaning elements could be arranged in various configurations that may or may not be opposite to another face. For instance, another configuration of head 20112 could include a head platform with three faces from which cleaning elements extend that are arranged in a generally triangular arrangement. However, as discussed further below, the configuration of head platform 20118 with opposite faces, a relatively thin platform height HP, and a relatively thin overall height H3 provides various advantages during use.

Cleaning elements 20116 and 20122 as shown may extend perpendicularly from their respective faces 20119 and 20121. Further, the cleaning elements may extend in opposite directions from each other. However, it is understood that the cleaning elements may be configured in other orientations. For example, the cleaning elements can be angled with respect to their face and with respect to each other, Cleaning elements 20116 and 20122 may include a variety of oral cleaning elements, such as tooth cleaning elements, which can be used for wiping, cleaning and massaging the user's teeth and gums, and soft tissue cleaning elements, which can be used for scrubbing, scraping and massaging the user's tongue, inside of cheeks, etc. Any suitable form of oral cleaning elements may be used. However, as discussed further below, it is preferable to include filament bristles with both the tooth cleaning elements and the soft tissue cleaning elements. The term "oral cleaning elements" is used in a generic sense and generally refers to filament bristles, elastomeric fingers or walls that have any desirable shape, tissue engaging projections such ridges and nubs, etc. As used herein, a "nub" is generally meant to include a column-like protrusion (without limitation to the cross-sectional shape of the protrusion), which is upstanding from a base surface.

Preferably, cleaning elements 20116 and 20122 include filament bristles, either alone or in combination with other types of oral cleaning elements. Cleaning elements 20116 are generally tooth cleaning elements, which may include elastomeric fingers or walls along with filament bristles. As such, cleaning elements 20116 have a height H4 from 10 mm to 13 mm, which provide sufficient length and flexibility for engaging gaps and crevices between the user's teeth and between their teeth and gums and for brushing or wiping away particles engaged by the cleaning elements.

Cleaning elements 20122 are generally soft tissue cleaning elements, which may include tissue engaging projections, such as ridges and nubs, and/or elastomeric fingers or walls along with relatively short filament bristles. Such tissue engaging elements can help reduce a major source of bad breath and improve hygiene. Cleaning elements 20122 have a height H5 from 1 mm to 6 mm and preferably from 1.5 mm to 4 mm.

Filament bristles having a height in the range of 1 mm to 6 mm and preferably in the range of 1.5 mm to 4 mm are relatively short in comparison to their column width, which preferably is in the range of 0.06 to 0.18 mm+/−to 0.02 mm for individual filaments and in the range of 1 mm to 2 mm+/−0.2 mm for individual bundles of bristles. As such, filament bristles of cleaning elements 20122 have a relatively high column strength in comparison with filament bristles of tooth cleaning elements 20116, which are longer and more flexible than tissue cleaning elements 20122. Due to their thin diameter and their high column strength, the relatively short tissue cleaning elements and, in particular, the relatively short filament bristles are able to penetrate very well into the user's soft oral tissues.

In the configuration shown in FIG. 32, oral cleaning elements 20122 are able to engage soft tissues within the user's mouth, such as the inside of their cheeks, while the user simultaneously cleans their teeth. Thus, more effective oral cleaning is provided by oral cleaning implement 20110 than conventional toothbrush 19010 or conventional combination toothbrush/tongue cleaner 19030. This is true even though combination device 19030 includes soft elastomeric tongue cleaning projections 19020, which can penetrate a user's soft oral tissues, but do not penetrate as well as relatively short, thin filament bristles 20122, and which fail to provide the brushing action of filament bristles 20122.

In general, soft tissue cleaning elements 20122 enable the removal of microflora and other debris from the tongue and other soft tissue surfaces within the mouth. The tongue, in particular, is prone to develop bacterial coatings that are known to harbor organisms and debris that can contribute to bad breath. These microfloras can be found in the recesses between the papillae on most of the tongue's upper surface as well as along other soft tissue surfaces in the user's mouth. When engaged or otherwise pulled against a tongue surface, for example, the filament bristles of tissue cleaning elements 20122 can provide for gentle engagement with the soft tissue while reaching downward into the recesses of adjacent papillae of the tongue and while providing a brushing action within the recesses.

The columnar filament construction of the bristles also enables the soft tissue cleaning elements to follow the natural contours of the oral tissue surfaces, such as the tongue, cheeks, lips, and gums of a user. In addition, the filament bristles are able to flex as needed to traverse and clean the soft tissue surfaces in the mouth along they are moved. The flexibility of the filament bristle tissue cleaning elements, their small diameter, and their relatively high column strength allow them to effectively penetrate soft oral tissues and to engage and brush out microflora and other debris much better than other types of tissue cleaning elements.

Figure 31:
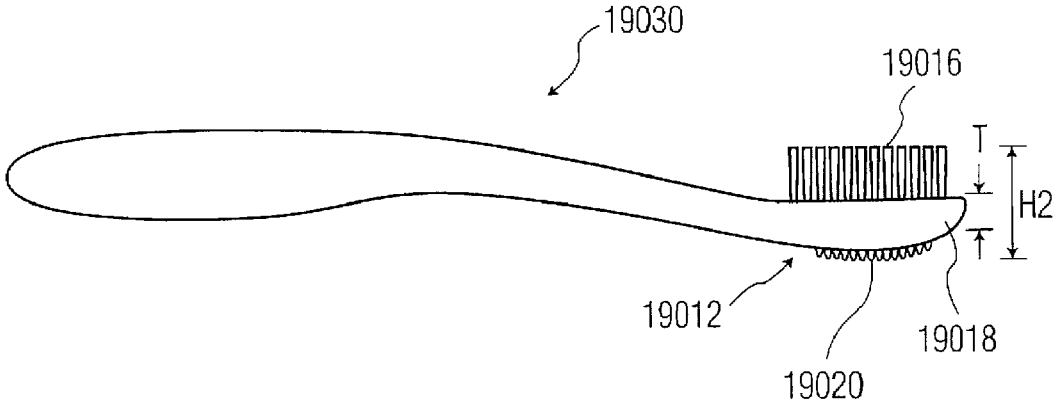
FIG. 31 PRIOR ART

Conventional combination toothbrush/tongue cleaner devices, such as device 19030 shown in FIG. 31, have failed to provide filament bristles in tongue cleaner 19020. This is because conventional techniques for affixing filament bristles to a toothbrush, such as the conventional method of stapling folded bristle bundles into a head, would require a much thicker head than would be comfortable for most adult users in order to accommodate bristles on opposite sides of the toothbrush. As such, conventional toothbrush/tongue cleaner devices include a pad of elastomeric tongue cleaning elements glued to the back of the toothbrush head, or a plurality of hard projections molded on the back of the toothbrush head. However, such conventional devices fail to provide filament bristle soft tissue cleaning elements 20122 along with filament bristle tooth cleaning elements 20116 on the head of the same device while having a head thickness small enough for comfortable use by an adult.

To further enhance the effectiveness of oral care implement device 20110, device 20110 can optionally include a vibratory device (not shown) to vibrate the oral care implement or a portion thereof, such as the head 20112 or a portion thereof. The vibration-producing device can be used to vibrate tooth cleaning elements 20116 and/or soft tissue cleaning elements 20122.

A wide variety of vibratory devices can be used to produce vibrations over a wide range of frequencies to meet the needs of a particular application. Various types of vibratory devices are commercially available, such as transducers. One example of a vibratory device provides frequencies in the range of about 100 to 350 kHz. The vibration frequencies may be of different waveforms, including sinusoid, square, saw tooth and the like. Nevertheless, other values and waveforms are possible. A vibratory device may be located in head of the toothbrush or neck thereof. When activated, vibratory device is powered by battery (and controlled by electronics on circuit board or switching system) so as to induce vibrations in head of the toothbrush and thereby enhances teeth-cleaning action imparted by the tooth cleaning elements.

In alternate embodiments, a vibratory device may include a micro motor attached to a shaft, with the shaft coupled to an eccentric rotating about an axis parallel to the longitudinal axis of the toothbrush. In still other embodiments, a vibratory-producing device includes an eccentric that is driven by a micro motor in a translatory manner.

A switch, such as a button, toggle switch, rotating dial, or the like, can be provided for activating the vibratory device. A vibratory device often has a power source, such as a battery. Activating the switch can cause the vibration-producing device to operate for a user-defined interval (e.g., during the time that a button is depressed or a switch is in an engaged position), or alternatively can activate a timing circuit that causes the vibratory device to operate for a predetermined interval. If a timing circuit is used, the associated interval either may be preset or may be adjustable, e.g., by a user-activated rotating dial.

Figure 34:
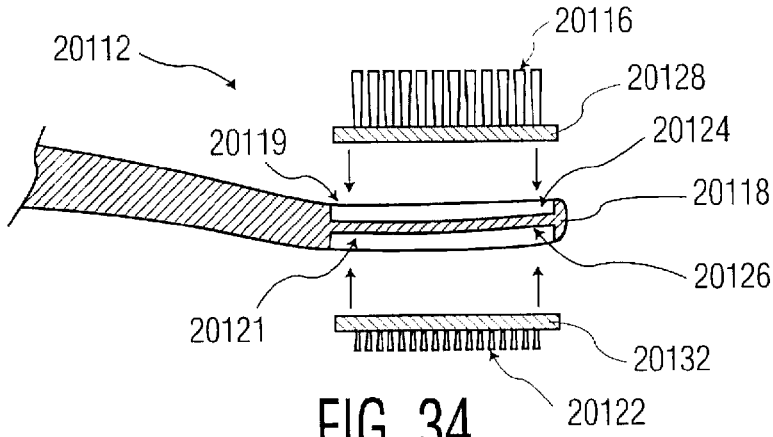
FIG. 34 is an exploded section view of the oral care implement head of FIG. 32 taken along line 34-34 of FIG. 33.
Figure 35:
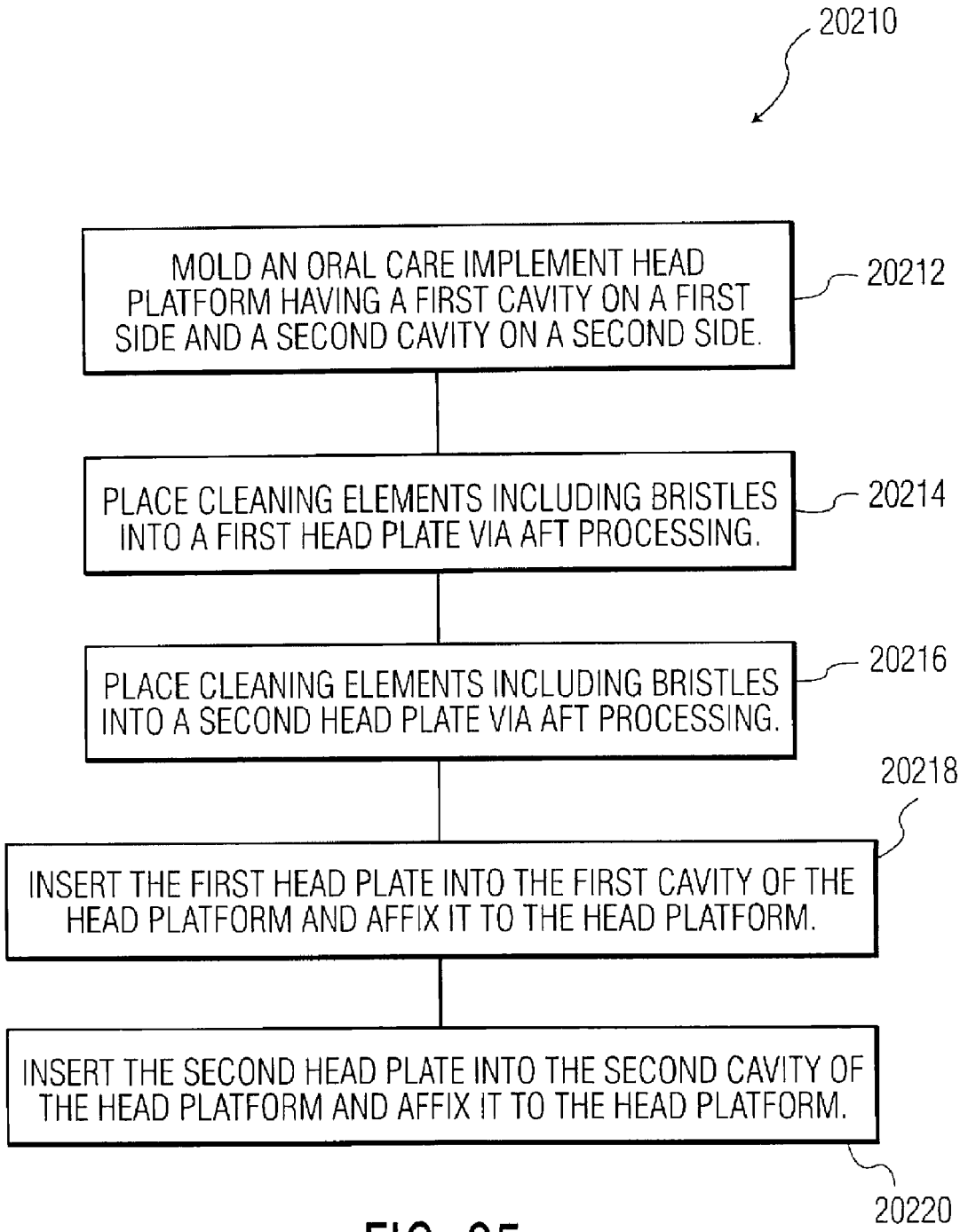
FIG. 35 illustrates a method for forming an oral care implement having a plurality of bristled heads according to one or more aspects of an illustrative embodiment.

FIGS. 33-35 illustrate a method 20210 for forming an oral cleaning device, such as oral care implement 20110, having a pair of faces that include filament bristles (i.e., tufted faces), which permits the head to have an overall thickness of 20 mm or less. As shown in FIGS. 33 and 34, method 20210 can be practiced via anchor-free tufting (AFT) techniques. Accordingly, head 20112 includes a first carrier plate 20128 to which tooth cleaning elements 20116 are affixed via AFT processing and a second carrier plate 20132 to which oral cleaning elements 20122 are affixed via AFT processing. The carrier plates have a plurality of cutouts (not shown) through which clusters of bristle filaments 20116, and optionally elastomeric cleaning elements 20116, are guided. The rear ends of the bristle filaments are melted to affix them to their respective carrier plate. The melted portions form a base 20131 that adheres to the carrier plate and bonds the bristle bundles to each other. If elastomeric cleaning elements are also provided, they can be melted along with the bristles or glued to the carrier plate.

The carrier plates 20128 and 20132 are relatively thin (e.g., 1 mm or less) and are received into corresponding recesses 20124 and 20126 formed in the faces 20119 and 20121 of the head platform 20112. The carrier plates may be affixed to the head platform via appropriate methods such as ultrasonic welding, laser welding, hot air welding gluing, a snap-fit connection in combination with overmolding, or any other plastic joining technique. Other suitable plastic joining techniques will become readily apparent to those skilled in the art, given the benefit of this disclosure. Preferably, carrier plates 20128 and 20132 are affixed via ultrasonic welding to membrane 20134 of the head platform, which provides a non-visible, high strength bond to the head platform at a relatively low manufacturing cost.

As illustrated in FIG. 35, a method 20210 for forming such an oral cleaning device can include the step 20212 of molding an oral care implement head platform 20118 having a first cavity 20124 on a first side and second cavity 20126 on a second side. It can further include the steps 20214 of guiding tooth cleaning elements 20116 including bristles into cutouts of first carrier plate 20128 via AFT processing and the step 20216 of guiding soft tissue cleaning elements 20122 including bristles into cutouts of second carrier plate 20132 via AFT processing. The method also includes the step 20218 of inserting the first carrier plate 20128 into the first cavity 20124 and affixing it to head platform 20118 and the step 20220 of inserting the second carrier plate 20132 into the second cavity 20126 and affixing it to head platform 20118.

As noted above, the carrier plates are preferably affixed via ultrasonically welding them to the head platform, such as welding them to platform 134 of the head platform. However, they may be affixed via other methods, such as gluing them to the head platform or snap fitting them into the head platform and overmolding another material around portions of the head platform and the carrier plates. It is understood that the steps of method 20210 may be performed in various orders and that many steps may be performed simultaneously. For instance, steps 20214 and 20216 can be sequentially in any order or can be performed simultaneously.

Figure 36:
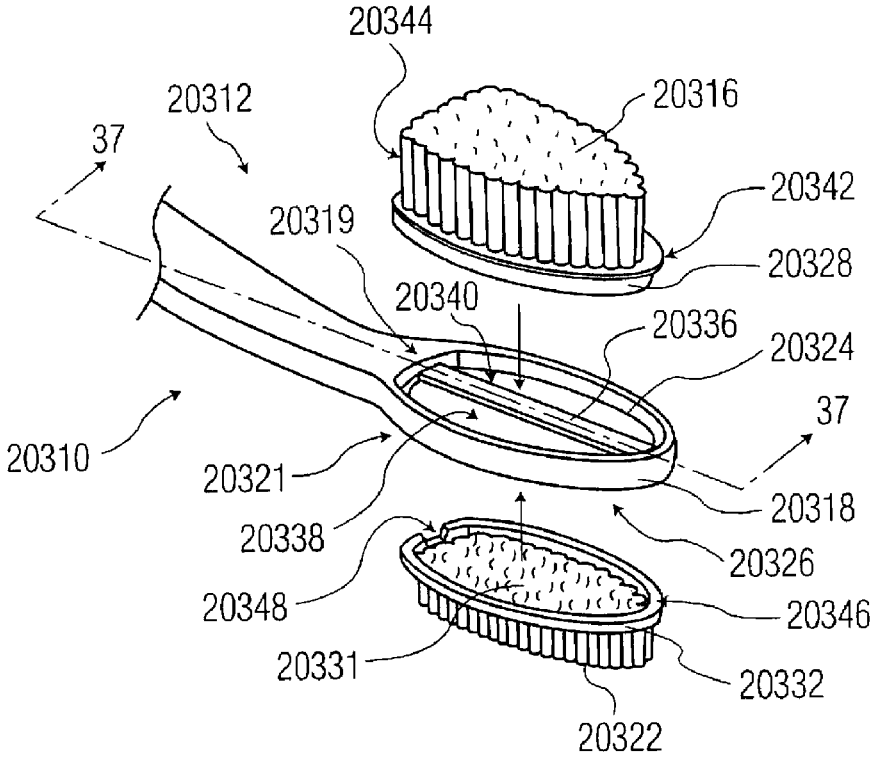
FIG. 36 is an exploded perspective view of an oral care implement head according to one or more aspects of an illustrative embodiment.
Figure 37:
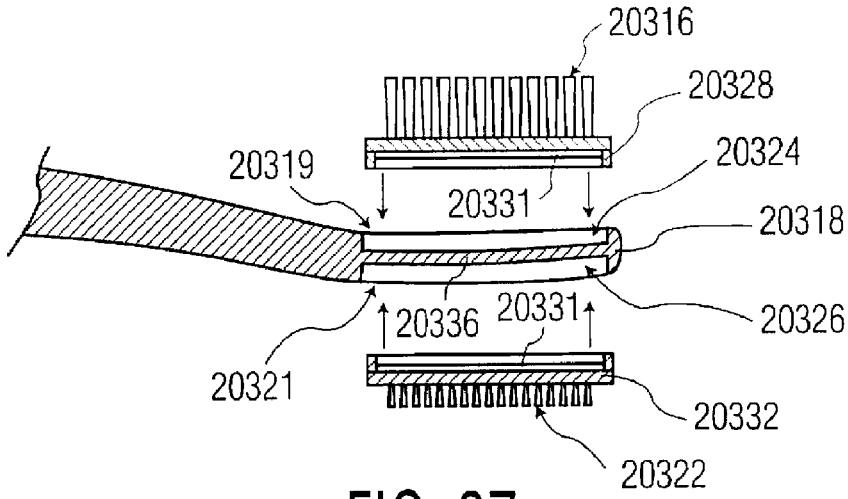
FIG. 37 is an exploded section view of the oral care implement head of FIG. 36 taken along line 37-37 of FIG. 36.

Referring now to FIGS. 36 and 37, a head portion 20312 is shown of an oral care implement 20310, which generally includes the same aspects and features as oral care implement 20110 and head portion 20112 except as discussed hereafter. Like numbers in FIGS. 36 and 37 refer to like features of FIGS. 33 and 34. As shown in FIGS. 36 and 37, head platform 20318 includes a support rib 20336 disposed between first cavity 20324 and second cavity 20326. Gaps 20338 and 20340 are formed on each side of support rib 20336, which are openings connecting first cavity 20324 and second cavity 20326. Each of the carrier plates 20328 and 20332 include a rim 20333 and 20335 along the portion that is received into its corresponding cavity 20324 and 20326 of the head platform. Each rim includes a pair of recesses 20342 and 20344 or 20346 and 20348, which engage support rib 20336 of the head platform when attached thereto.

The configuration of FIGS. 36 and 37 permit opposing carrier plates 20328 and 20332 to be attached directly to each other. Such a configuration permits head platform 20318 to be even thinner than head platform 20118. Having a thinner head platform provides the advantage of permitting tooth cleaning elements 20316 and/or soft tissue cleaning elements 20322 to be longer than in the configuration of FIGS. 33 and 34 while maintaining the overall height of the toothbrush head at height H3 shown in FIG. 32. In addition, directly attaching carrier plates 20328 and 20332 to each other and to support rib 20338 provides the advantages of increased stability and support. Preferably, carrier plates 20328 and 20332 are ultrasonically welded to each other and to support rib 20338. However, other acceptable attachment mechanisms may be utilized.

Figure 38:
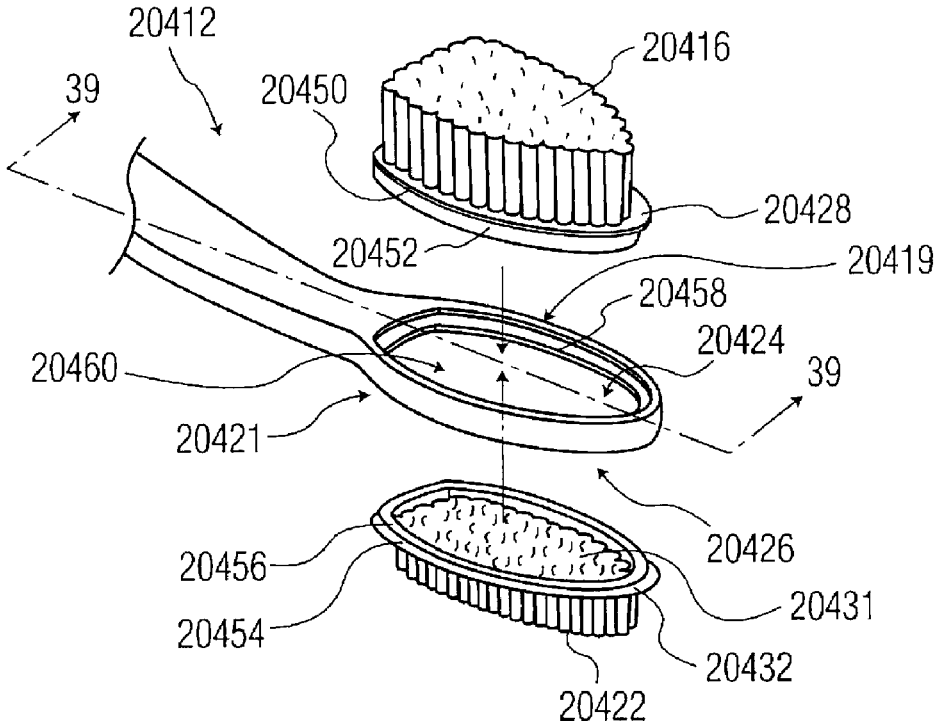
FIG. 38 is an exploded perspective view of an oral care implement head according to one or more aspects of an illustrative embodiment.
Figure 39:
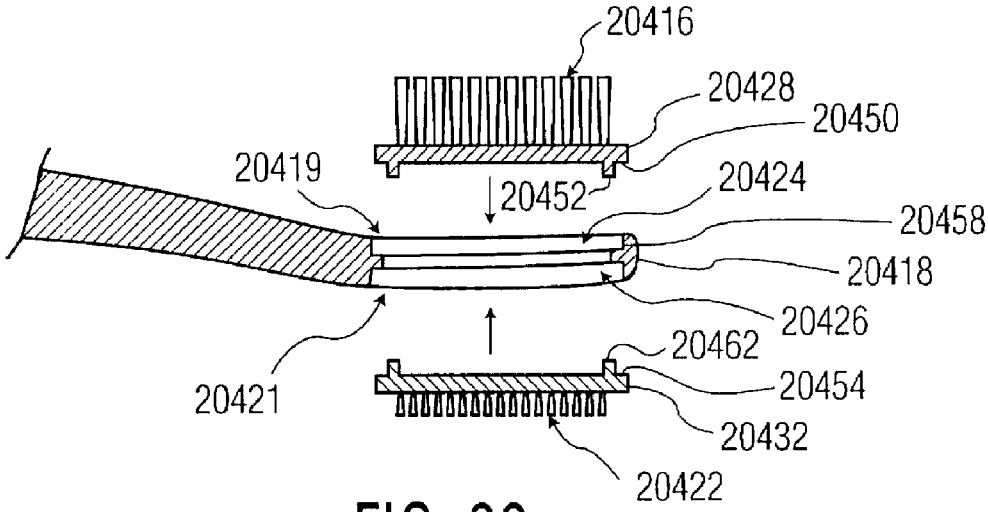
FIG. 39 is an exploded section view of the oral care implement head of FIG. 38 taken along line 39-39 of FIG. 38.

Referring now to FIGS. 38 and 39, a head portion 20412 is shown of an oral care implement 20410, which generally includes the same aspects and features as oral care implements 20110 and 20310 and head portions 20112 and 20312 except as discussed hereafter. Like numbers refer to like features of FIGS. 33, 34, 36 and 37. As shown in FIGS. 38 and 39, head platform 20418 includes a support ledge 20458 disposed between first cavity 20424 and second cavity 20426. Support ledge 20458 outlines an opening 20460, which connects first cavity 20424 and second cavity 20426. Each of the carrier plates 20428 and 20432 include a rim 20452 and 20462 along the portion that is received into its corresponding cavity 20424 and 20426 of the head platform. The rims 20452 and 20462 are disposed inside of the outer edge of their respective carrier plate to form shoulders 20450 and 20454. The shoulders and rims of each carrier plate engage support ledge 20458 of the head platform when attached thereto.

As with FIGS. 36 and 37, the configuration of FIGS. 38 and 39 permit opposing carrier plates 20428 and 20432 to be attached directly to each other in an alternative configuration from FIGS. 36 and 37. Such a configuration also permits head platform 20418 to be thinner than head platform 20118 and provides similar advantages to the configuration of FIGS. 37 and 37. In addition, due to its location proximate the rim regions of each carrier plate, support ledge 20458 provides significant support to each of the carrier plates. Preferably, carrier plates 20428 and 20432 are ultrasonically welded to each other and to support ledge 20458. However, other acceptable attachment mechanisms may be utilized.

In an alternative configuration (not shown), the head platform can include both a support ledge 20458 and a support rib 20338 to securely affix the carrier plates to the head platform while permitting the carrier plates to be attached to each other as well. It is further understood that other configurations may be employed to maintain a relatively thin head platform to which the carrier plates can be affixed while optionally permitting the carrier plates to be affixed to each other.

Figure 40:
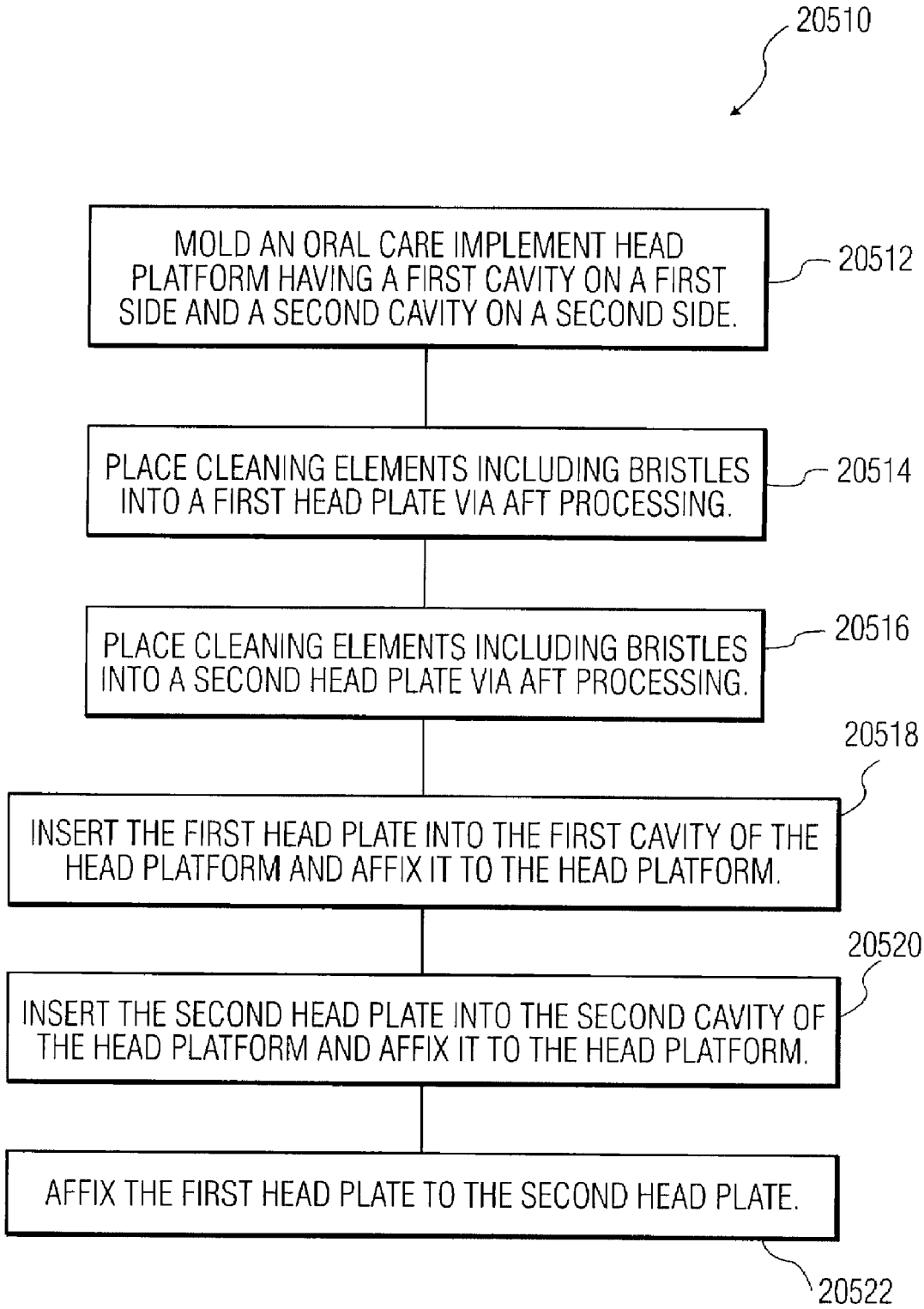
FIG. 40 illustrates a method for forming an oral care implement having a plurality of bristled heads according to one or more aspects of an illustrative embodiment.

FIG. 40 illustrates a method 20510 for forming an oral care implement in which the carrier plates can be attached to the head platform and to each other. Method 20520 generally includes the same steps and features as method 20210, except that it includes the additional step 20522 of affixing the first carrier plate to the second carrier plate. Step 20522 can be performed along with step 20520 when the second carrier plate is affixed to the head platform.

Figure 41:
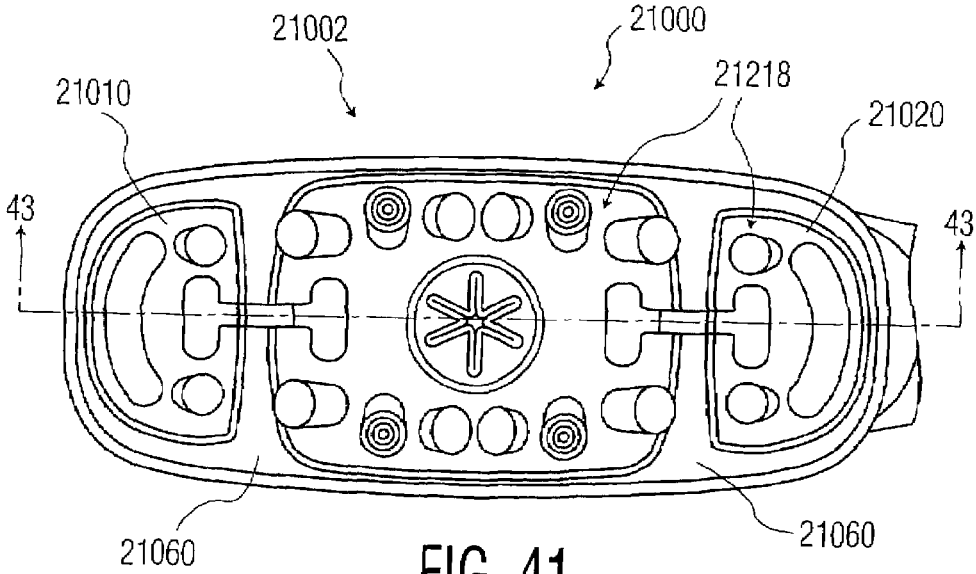
FIG. 41 is a top view of a head portion of an oral care implement configuration according to one or more aspects of an illustrative embodiment.
Figure 42:
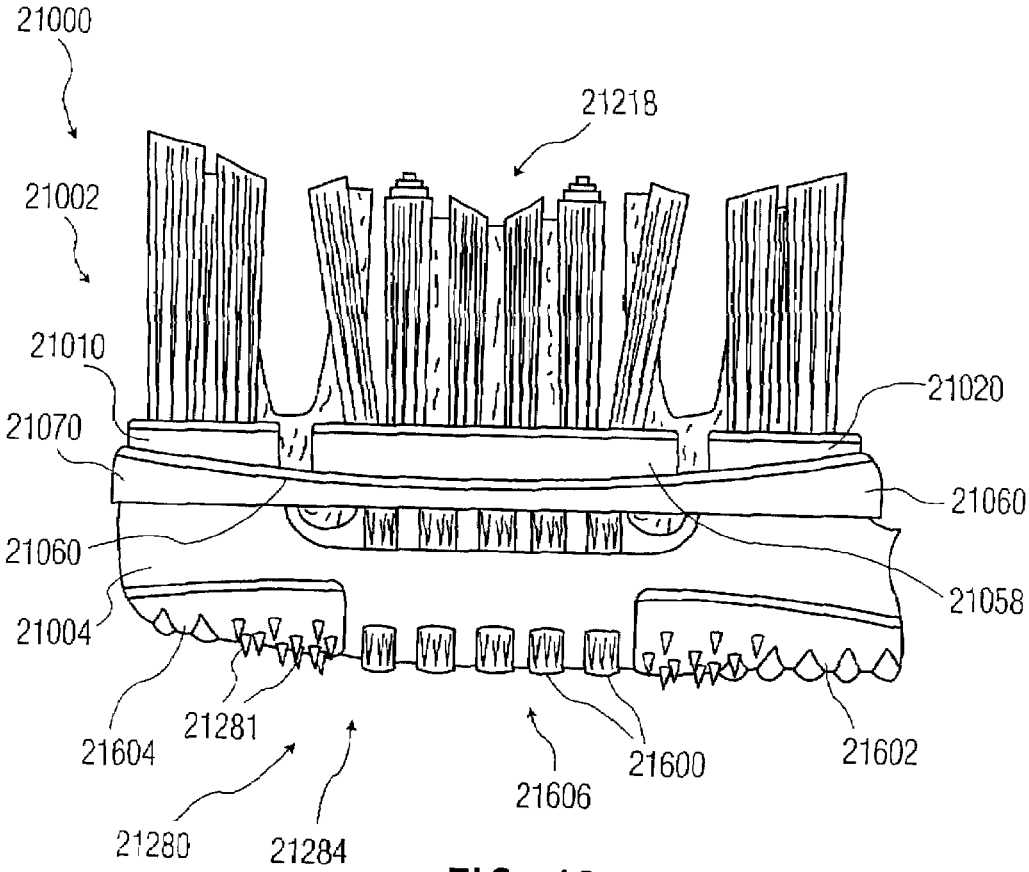
FIG. 42 is a side view of the head portion of FIG. 41.
Figure 43:
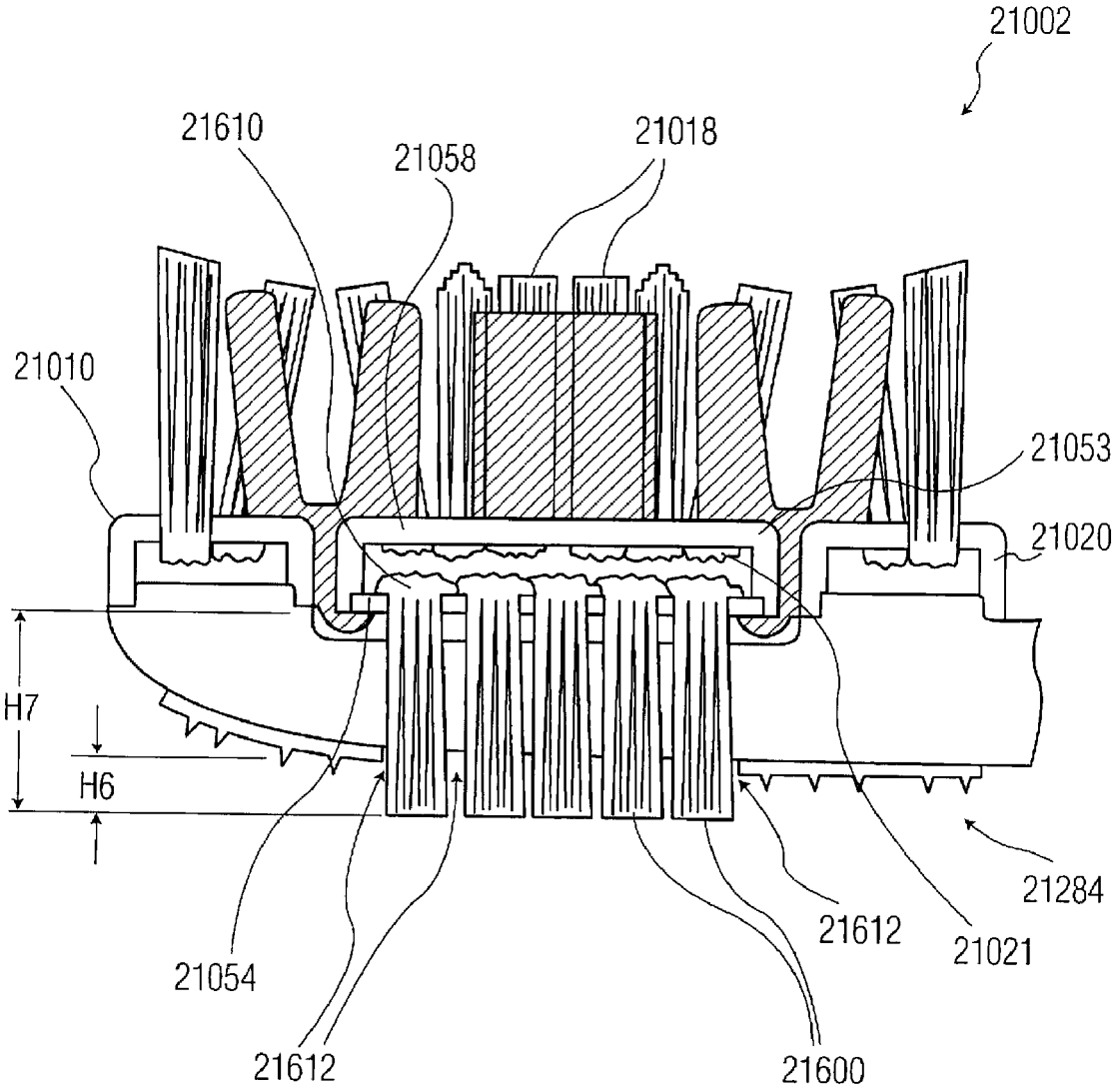
FIG. 43 is a cross-sectional view of the head portion of FIG. 41 taken along line 43-43.

Referring now to FIGS. 41-43, a head portion of an oral care implement 21000 is shown that is similar to oral care implement 13020 illustrated in FIGS. 23A and 23B and generally has the same the aspects and features as oral care implement 13020, except as discussed below and shown in FIGS. 41-43. The arrangement of cleaning elements 21218 is for example purposes and can include other arrangements, such as those shown throughout the application and variations thereof. Soft tissue cleaner 21280 disposed on a rear side of its head is generally the same as soft tissue cleaners 10280 and 12280 of FIGS. 10-13 and 19-20 respectively, except with respect to longitudinally movable cleaning elements 21600 and as discussed below and shown in FIGS. 41-43. As such, a proximate portion 21602 of soft tissue cleaner 21280 and a distal portion 21604 of soft tissue cleaner 21280 are similar to those portions of soft tissue cleaners 10280 and 12280. However, various other soft tissue cleaner configurations may be used, such as aspects of the soft tissue cleaners of FIGS. 14-18.

As shown in FIG. 41, oral care implement 21000 generally includes a head 21002, a handle (not shown) such as handle 8103 of oral care implement 13020, bases or pods 21010, 21020 and 21058, cleaning elements 21218 extending from the pods, and a soft tissue cleaner 21280 disposed on a rear side of the head. Pod 21010 is a proximal pod located proximate the handle and pod 21020 is a distal pod located at a distal portion of the oral care implement. Central pod 21058 is suspended between proximal pod 21010 and distal pod 21020 via bridge supports 21060. Although a single central pod is shown, it is understood that additional central pods may be included. The bridge supports 21060 may include a pair of substantially parallel supports (not shown) separated by a gap (not shown) covered by a flexible support material (see e.g., FIG. 19). Further, bridge supports 21060 may be formed from a flexible support material alone without including parallel supports or other support structures. The flexible bridge supports may be formed from a resilient material, such as a thermoplastic elastomer. Other rubber-like materials may be used, such as other thermoplastics, or a thermoplastic urethane, or a plastomer, or any combination thereof.

Soft tissue cleaner 21280 includes a proximate portion 21602, a distal portion 21604, and longitudinally movable cleaning elements portion 21606, which includes longitudinally movable cleaning elements 21600. Proximate portion 21602 and distal portion 21604 are similar to those portions of soft tissue cleaners 10280 and 12280 and generally include a plurality of projections 21281 extending from a rear face 21284 on a second side of head 21002, which is generally opposite from the direction in which tooth cleaning elements 21218 extend. Soft tissue cleaning projections 21281 may be separately molded or glued to the rear face or otherwise attached thereto. In addition, they may be integrally formed with head 21002. The projections could each be made from a material different from other projections and/or different from other component. Soft materials, such as a thermoplastic elastomer (TPE) or the like, can be fixed to head 21002 to form the projections. However, others material used to make oral care implements may be appropriate for the soft tissue cleaner projections.

Longitudinally movable cleaning elements 21600 are cleaning elements that are attached to the underside of central pod or carrier 21058 and extend through the frame or platform 21004 to the underside of the toothbrush head to form part of soft tissue cleaner 21280. Thus, cleaning elements 21600 are movable in the direction of their longitudinal axes when central pod 21058 moves toward and away from head platform 21004. As such, cleaning elements 21600 can have a changeable height with respect to the rear face 21284 of head 21002 due to being mounted on a flexibly mounted carrier 21058. This can permit cleaning elements 21600 to adjust to the contour of soft tissues being cleaned within a user's mouth and enhance their effectiveness.

Cleaning elements 21600 can include a variety of oral cleaning elements, such as tooth cleaning elements, which can be used for wiping, cleaning and massaging the user's teeth and gums, and soft tissue cleaning elements, which can be used for scrubbing, scraping and massaging the user's tongue, inside of cheeks, etc. Any suitable form of oral cleaning elements may be used. However, longitudinally movable cleaning elements 21600 preferably include bristles, either alone or in combination with other types of oral cleaning elements. The bristles can include filament bristles, such as nylon bristles, and thermoplastic bristles, such as polypropylene bristles.

Cleaning elements 21600 are generally soft tissue cleaning elements that can help to reduce a major source of bad breath and improve hygiene. Cleaning elements 21600 can have a height H6 from rear face 21284 from 1 mm to 6 mm in the relaxed condition and preferably from 1.5 mm to 4 mm. It is understood that height H6 can change during use when the longitudinally movable cleaning elements engage soft tissue.

For configurations in which cleaning elements 21600 are bristles, the height H6 is relatively short in comparison to their column width, which preferably is in the range of 0.06 to 0.18 mm+/−to 0.02 mm for individual bristles and in the range of 1 mm to 2 mm+/−0.2 mm for individual bundles of bristles. As such, bristles of longitudinally movable cleaning elements 21600 have a relatively high column strength for the portion extending past rear face 21284 in comparison with bristles used for tooth cleaning elements, which are longer and more flexible than longitudinally movable cleaning elements 21600. Due to their thin diameter and their high column strength, the relatively short soft tissue cleaning elements and, in particular, the relatively short bristles are able to penetrate very well into the user's soft oral tissues. It is understood that bristles having other diameters and heights H6 can be used in other beneficial configurations.

In the configuration shown in FIG. 41-43, cleaning elements 21600 are able to engage soft tissues within the user's mouth, such as the inside of their cheeks, while the user simultaneously cleans their teeth. Thus, more effective oral cleaning is provided by oral cleaning implement 21000 than conventional toothbrush 19010 or conventional combination toothbrush/tongue cleaner 19030 when cleaning elements 21600 include bristles. This is true even though combination device 19030 includes soft elastomeric tongue cleaning projections 19020, which can penetrate a user's soft oral tissues, but do not penetrate as well as relatively short, thin bristles 21600, and which fail to provide the brushing action of bristles 21600.

In general, soft tissue cleaning elements 21600 enable the removal of microflora and other debris from the tongue and other soft tissue surfaces within the mouth. The tongue, in particular, is prone to develop bacterial coatings that are known to harbor organisms and debris that can contribute to bad breath. These microfloras can be found in the recesses between the papillae on most of the tongue's upper surface as well as along other soft tissue surfaces in the user's mouth. When engaged or otherwise pulled against a tongue surface, for example, the cleaning elements 21600, particularly when the cleaning elements include bristles, can provide for gentle engagement with the soft tissue while reaching downward into the recesses of adjacent papillae of the tongue and while providing a brushing action within the recesses.

The columnar construction of bristles when used with cleaning elements 21600, as well as their flexible mount and ability to change height, enables cleaning elements 21600 to follow the natural contours of the oral tissue surfaces, such as the tongue, cheeks, lips, and gums of a user. In addition, the bristles are able to flex as needed to traverse and clean the soft tissue surfaces in the mouth along they are moved. The longitudinal movability of the bristle cleaning elements 21600, their flexibility, their small diameter, and their relatively high column strength allow them to effectively penetrate soft oral tissues and to engage and brush out microflora and other debris much better than other types of tissue cleaning elements. Further, when oral care implement 21000 is used to simultaneously clean a user's teeth and engage soft tissues, the movement of central pod 21058 due to engaging the user's teeth can cause the height of cleaning elements 21600 to vary and, thereby, better massage and penetrate the user's soft oral tissues.

FIG. 43 illustrates a potential construction configuration of a portion of central pod 21058 and longitudinally movable cleaning elements 21600. Similar to the construction of central pod 16051 of toothbrush 16000 shown in FIGS. 26 and 27, the bottoms of cleaning elements 21018 are melted to form a mat 21021 that is captured between a pod housing 21053 and floor 21054. The mat 21021 prevents the cleaning elements 21018 from passing through the tuft holes in the pod housing 21053. The floor 21054, for example, could be adhered or welded to the housing 21053, with the floor 21054 being at least partially surrounded by the membrane 21070 (see FIG. 42). Thus, the cleaning elements 21018 in this configuration are captured and secured within the pod housing 21053 and floor 21054 in a manner known as anchor-free tufting (AFT).

In the configuration of FIG. 43, both pod housing 21053 and pod floor 21054 are carrier plates or carrier components for retaining cleaning elements 21018 and 21600 via AFT techniques, even though they may or may not be flat in the general sense of a carrier plate. As such, the bottoms of cleaning elements 21600 are also melted to form a mat 21610 that is also captured between the pod housing and floor. The cleaning elements 21018 and 21600 can be adhered to their respective carrier plates 21053 and 21054, which can thereafter be attached to each other via adhesive, ultrasonic welding techniques, or other connection mechanisms. In the assembled configuration, longitudinally movable cleaning elements 21600 extend through one or more apertures, which can include tunnels 21612 of head platform 21004, to movably penetrate the head platform and extend beyond rear face 21284.

Figure 44:
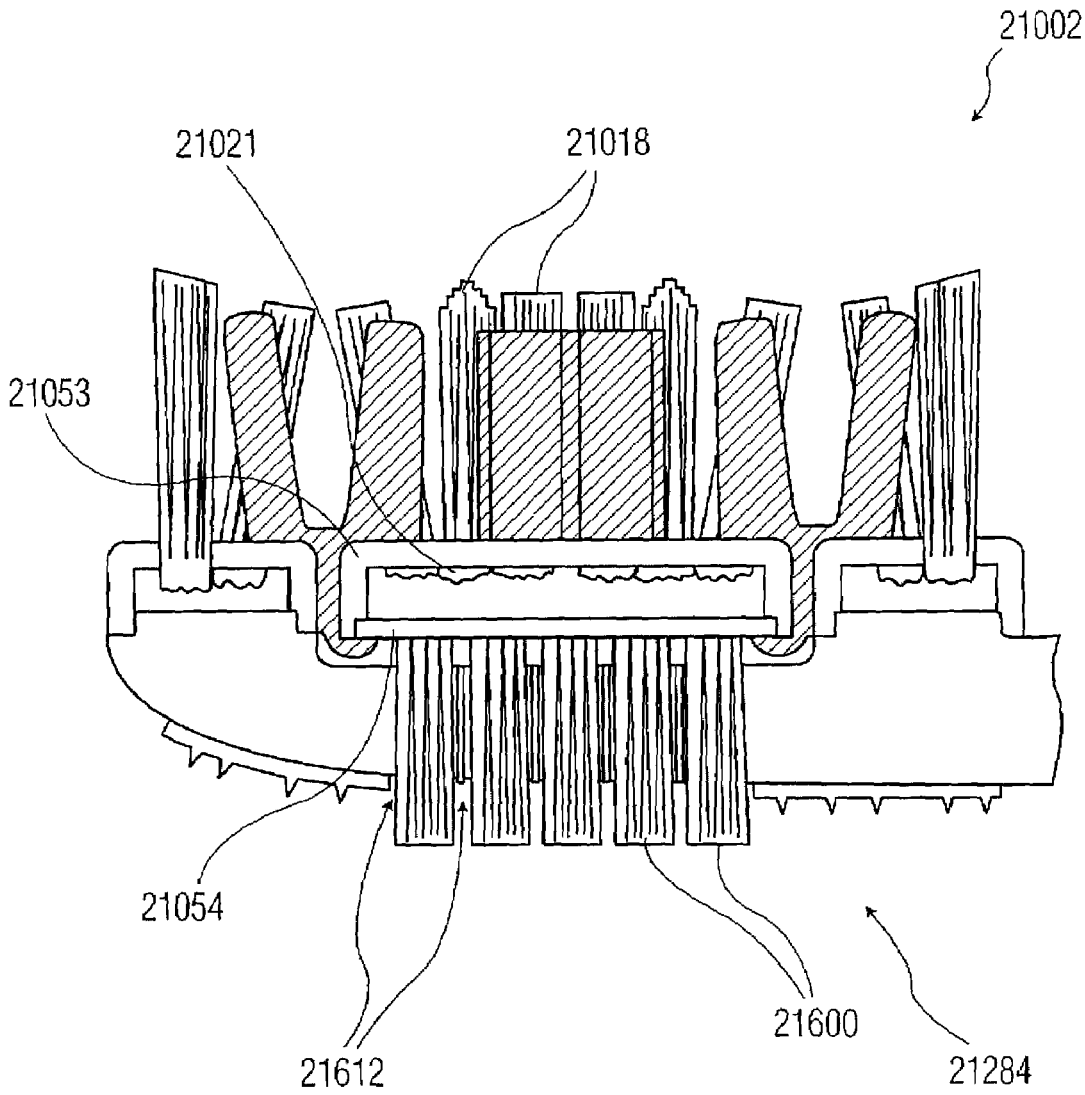
FIG. 44 is a cross-sectional view of alternative configuration of the head portion of FIG. 42 taken along line 43-43.

FIG. 44 illustrates another potential construction configuration of a portion of central pod 21058 and longitudinally movable cleaning elements 21600. Similar to the construction of FIG. 43, the bottoms of cleaning elements 21018 are melted to form a mat 21021 that is captured between a pod housing 21053 and floor 21054 via AFT techniques. However, in this configuration, cleaning elements 21600 are elastomeric cleaning elements that are molded on an outer surface 21620 of floor 21054. The elastomeric cleaning elements can be formed from a resilient material, such as a thermoplastic elastomer. Other rubber-like materials may be used, such as other thermoplastics, a thermoplastic urethane, a plastomer, or any combination thereof. In one configuration, cleaning elements 21600 could be bristles formed from polypropylene. The elastomeric cleaning elements can be made from the same or different material than floor 21054. As with the configuration of FIG. 43, in the assembled configuration, longitudinally movable cleaning elements 21600 extend through tunnels 21612 of head platform 21004 to movably penetrate the head platform and extend beyond rear face 21284. In yet another configuration illustrated by FIG. 44, longitudinally movable cleaning elements 21600 can be made from the same material as floor 21054 and can be molded thereto along with molding floor 21054.

To further enhance the effectiveness of the device, oral care implement 21000 can optionally include a vibratory device (not shown) to vibrate the oral care implement or a portion thereof, such as the head 21002 or a portion thereof. The vibration-producing device can be used to vibrate tooth cleaning elements 21018 and longitudinally movable cleaning elements 21600. The use of a vibration-producing device can further enhance the effectiveness of longitudinally movable cleaning elements 21600 by inducing oscillating movements in central pod 21058 and thereby to cleaning elements 21600.

A wide variety of vibratory devices can be used to produce vibrations over a wide range of frequencies to meet the needs of a particular application. Various types of vibratory devices are commercially available, such as transducers. One example of a vibratory device provides frequencies in the range of about 100 to 350 kHz. The vibration frequencies may be of different waveforms, including sinusoid, square, saw tooth and the like. Nevertheless, other values and waveforms are possible. A vibratory device may be located in head of the toothbrush or neck thereof. When activated, vibratory device is powered by battery (and controlled by electronics on circuit board or switching system) so as to induce vibrations in head of the toothbrush and thereby enhances teeth-cleaning action imparted by the tooth cleaning elements.

In alternate embodiments, a vibratory device may include a micro motor attached to a shaft, with the shaft coupled to an eccentric rotating about an axis parallel to the longitudinal axis of the toothbrush. In still other embodiments, a vibratory-producing device includes an eccentric that is driven by a micro motor in a translatory manner.

A switch (not shown), such as a button, toggle switch, rotating dial, or the like, can be provided for activating the vibratory device. A vibratory device often has a power source, such as a battery. Activating the switch can cause the vibration-producing device to operate for a user-defined interval (e.g., during the time that a button is depressed or a switch is in an engaged position), or alternatively can activate a timing circuit that causes the vibratory device to operate for a predetermined interval. If a timing circuit is used, the associated interval either may be preset or may be adjustable, e.g., by a user-activated rotating dial.

Figure 45:
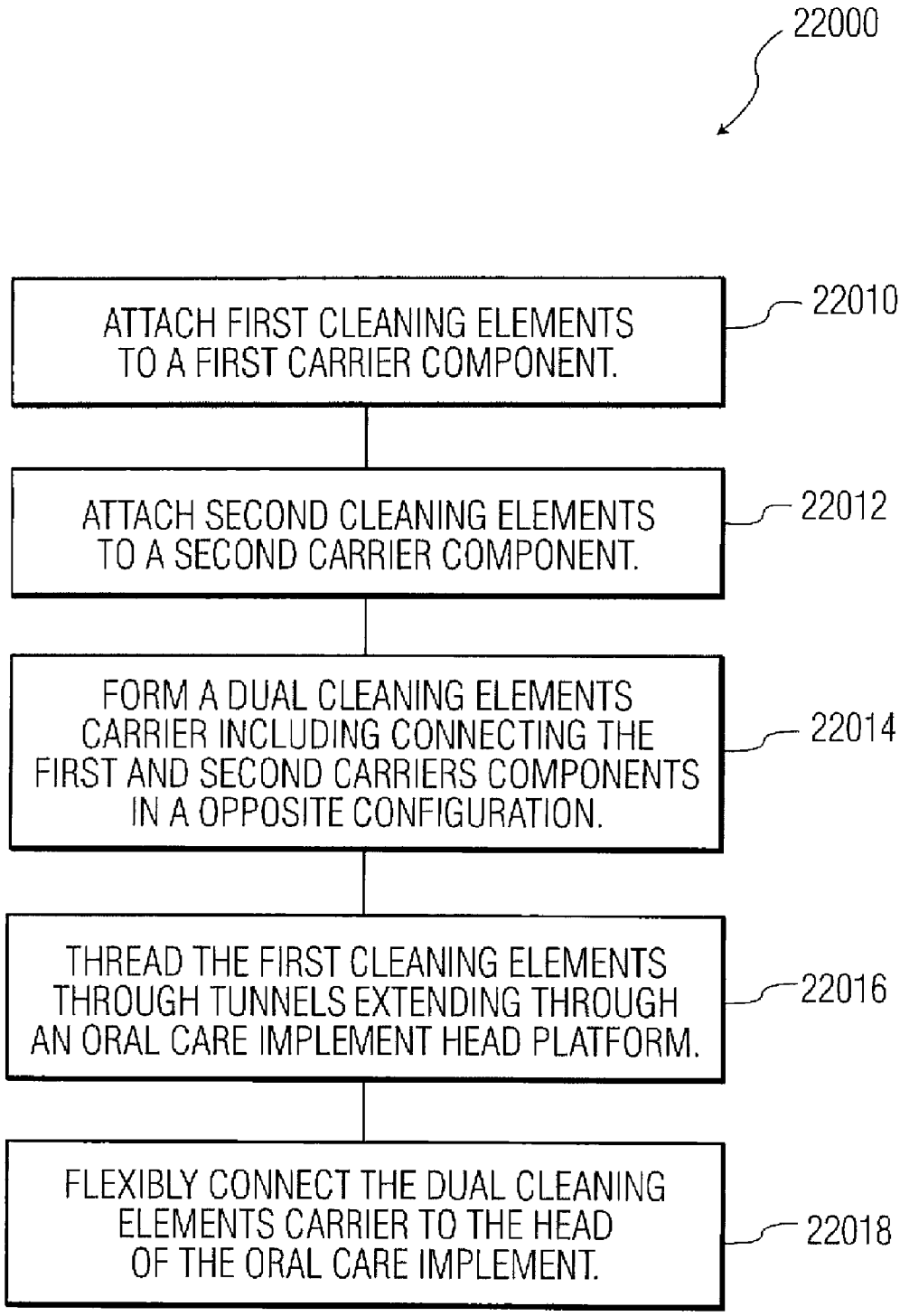
FIG. 45 illustrates a method for forming an oral care implement according to one or more aspects of an illustrative embodiment.

Referring now to FIG. 45, a method 22000 is shown for forming an oral care implement, such as oral care implement 21000. Method 22000 includes the step 22010 of attaching first cleaning elements, such as longitudinally movable cleaning elements 21600, to a first carrier component, such as pod floor 21054. As noted for the configuration of FIG. 44, cleaning elements 21600 could be attached via AFT processing, injection molding, adhesive connections, etc. The method further includes the step 22012 of attaching second cleaning elements, such at least some of cleaning elements 21018, to a second carrier component, such as pod housing 21053. As noted above, the cleaning elements could be attached via AFT processing and/or other techniques.

Method 22000 further includes the step 22014 of forming a dual cleaning elements carrier, such as central pod 21058, including connecting the first and second carrier components in an opposite configuration. If steps 22010 and 22012 have been performed prior to step 22014, then the first and second cleaning elements would extend in opposite directions. Step 22016 includes threading the second cleaning elements through one or more apertures extending through an oral care implement head platform, such as tunnels 21612 of head platform 21004. The method further includes the step 22016 of flexibly connecting the dual cleaning elements carrier to the head of the oral care implement, such as via membrane 21070.

As various changes could be made in the above without departing from the scope of the invention, it is intended that all matter contained in this application, including all mechanisms and/or modes of interaction described above, shall be interpreted as illustrative only and not limiting in any way the scope of the appended claims. Further, as noted above, it is intended that oral care implements according to the invention and associated methods may utilize various combinations of aspects, features and configurations discussed within the application.

We claim:

1. An oral care implement comprising:

a handle;

a head attached to the handle and having a head platform, the head platform having a first face and an opposite second face, the head platform forming at least one aperture extending therethrough between the first and second faces; and a first pod flexibly mounted to the head platform proximate the first face and being movable relative to the head platform in opposite directions normal to the first face; and a plurality of soft tissue cleaning elements extending from the first pod to the first face and through the at least one aperture to the second face;

wherein the soft tissue cleaning elements are movable in opposite directions normal to the first face along with the first pod.

2. The oral care implement of claim 1, wherein the head platform forms a plurality of apertures extending therethrough between the first and second faces and the soft tissue cleaning elements pass through the plurality of apertures.

3. The oral care implement of claim 1, further comprising a plurality of tooth cleaning elements extending from the first pod in a direction away from the first face.

4. The oral care implement of claim 1, the oral care implement further comprising:

at least one central pod including the first pod;

a pair of fixed pods rigidly attached to the head platform at the first face;

at least one suspension member supporting the first pod between the pair of fixed pods.

5. The oral care implement of claim 1, wherein the soft tissue cleaning elements include first bristles.

6. The oral care implement of claim 5, wherein the first bristles include filament bristles attached to the first pod via an anchor-free tufting (AFT) attachment.

7. The oral care implement of claim 5, wherein the first bristles include elastomeric bristles attached to an exterior surface of the first pod.

8. The oral care implement of claim 7, wherein the elastomeric bristles include bristles formed from polypropylene.

9. The oral care implement of claim 5, wherein the first pod includes a first carrier component and a second carrier component, the plurality of soft tissue cleaning elements further including second bristles, and the second bristles are attached to and carried by the second carrier component via an anchor-free tufting (AFT) attachment.

10. The oral care implement of claim 9, wherein the second bristles further include elastomeric cleaning elements attached to the second carrier component.

11. An oral care implement comprising:

a handle;

a head attached to the handle and having a head platform;

a proximal fixed pod and a distal fixed pod extending from a first face of the head platform;

at least one central pod supported above the first face by the fixed pods and at least one suspension member, the at least one central pod being movable relative to the head platform and being movable in opposite directions normal to the first face, the at least one central pod further comprising:

a plurality of first cleaning elements extending from the at least one central pod in a first direction through the head platform to a second face of the head platform opposite the first face; and a plurality of second cleaning elements extending from the at least one central pod in a second direction away from the first face.

12. The oral care implement of claim 11, wherein the at least one central pod includes a first carrier component and the first cleaning elements include first bristles attached to the first carrier component.

13. The oral care implement of claim 12, wherein the first bristles includes filament bristles attached to the first carrier component via an anchor-free tufting (AFT) attachment.

14. The oral care implement of claim 12, wherein the first bristles include elastomeric bristles attached to an exterior surface of the first carrier component.

15. The oral care implement of claim 14, wherein the elastomeric bristles include bristles formed from polypropylene.

16. The oral care implement of claim 12, wherein the at least one central pod includes a second carrier component, the second cleaning elements include second filament bristles, and the second filament bristles are attached to the second carrier component via an anchor-free tufting (AFT) attachment.

17. The oral care implement of claim 16, wherein the second cleaning elements further include elastomeric cleaning elements attached to the second carrier component.

18. The oral care implement of claim 11, wherein the head platform has a plurality of tunnels formed therethrough and the plurality of first cleaning elements extend from the at least one central pod through the tunnels of the head platform to the second face of the head platform.

* * * * *